US007348115B2

(12) United States Patent
Yamanami et al.

(10) Patent No.: US 7,348,115 B2
(45) Date of Patent: Mar. 25, 2008

(54) ELECTROPHOTOGRAPHIC PHOTOCONDUCTOR, PROCESS CARTRIDGE, IMAGE FORMING APPARATUS AND IMAGE FORMING METHOD

(75) Inventors: Hirofumi Yamanami, Sunto-gun (JP); Yukari Yamada, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/091,917

(22) Filed: Mar. 29, 2005

(65) Prior Publication Data

US 2005/0170271 A1 Aug. 4, 2005

Related U.S. Application Data

(62) Division of application No. 10/310,764, filed on Dec. 6, 2002, now Pat. No. 7,267,914.

(30) Foreign Application Priority Data

Dec. 6, 2001 (JP) ..... 2001-372852
Jun. 10, 2002 (JP) ..... 2002-168628
Sep. 18, 2002 (JP) ..... 2002-271227

(51) Int. Cl.
*G03G 5/14* (2006.01)

(52) U.S. Cl. ..... 430/60; 430/131; 430/100; 430/65; 399/159

(58) Field of Classification Search ..... 430/66, 430/63, 65, 970, 100, 131, 60
See application file for complete search history.

(56) References Cited

U.S. PATENT DOCUMENTS

| | | | | |
|---|---|---|---|---|
| 4,775,605 | A | | 10/1988 | Seki et al. |
| 4,822,705 | A | | 4/1989 | Fukagai et al. |
| 4,863,822 | A | | 9/1989 | Fukagai et al. |
| 5,008,706 | A | | 4/1991 | Ohmori et al. |
| 5,339,138 | A | | 8/1994 | Mishima et al. |
| 5,363,176 | A | | 11/1994 | Ishihara et al. |
| 5,550,000 | A | | 8/1996 | Takegawa et al. |
| 5,556,728 | A | * | 9/1996 | Nogami et al. ..... 430/64 |
| 5,589,314 | A | * | 12/1996 | Etoh et al. ..... 430/970 |
| 5,670,284 | A | | 9/1997 | Kishi et al. |
| 5,677,096 | A | | 10/1997 | Suzuki |
| 6,026,262 | A | | 2/2000 | Kinoshita et al. |
| 6,074,791 | A | | 6/2000 | Jennings et al. |
| 6,355,390 | B1 | | 3/2002 | Yamanami et al. |

FOREIGN PATENT DOCUMENTS

| | | | |
|---|---|---|---|
| DE | 196 38 447 A1 | | 4/1997 |
| EP | 0 394 142 | | 10/1990 |
| JP | 63-206761 | | 8/1988 |
| JP | 01200261 A | * | 8/1989 |
| JP | 02-222985 | | 9/1990 |
| JP | 04-294363 | | 10/1992 |
| JP | 06-089057 | | 3/1994 |
| JP | 06-107964 | | 4/1994 |
| JP | 07-234529 | | 9/1995 |
| JP | 07-319181 | | 12/1995 |
| JP | 08-022134 | | 1/1996 |
| JP | 08-254844 | | 10/1996 |
| JP | 09-106085 | | 4/1997 |
| JP | 09-319121 | | 12/1997 |
| JP | 11-338176 | | 12/1999 |
| JP | 11-338177 | | 12/1999 |
| JP | 11-338178 | | 12/1999 |
| JP | 11-338179 | | 12/1999 |
| JP | 2000-122313 | | 4/2000 |
| JP | 2000-231214 | | 8/2000 |
| JP | 2000-267309 | | 9/2000 |
| JP | 2000-292950 | | 10/2000 |
| JP | 2001-075296 | | 3/2001 |
| JP | 2001-109173 | | 4/2001 |
| JP | 2001-175010 | | 6/2001 |
| JP | 2001-242647 | | 9/2001 |
| JP | 2001-281892 | | 10/2001 |

OTHER PUBLICATIONS

Borsenberger, Paul M., et al, Organic Photoreceptors for Imaging Systems, New Yor, Marcel-Dekker, Inc., (1993) pp. 6-17.

* cited by examiner

*Primary Examiner*—Christopher D. RoDee
(74) *Attorney, Agent, or Firm*—Oblon, Spivak, McClelland, Maier & Neustadt, P.C.

(57) ABSTRACT

An electrophotographic photoconductor, including an electrically conductive substrate, an undercoat layer containing a filler and a binder resin and provided on the substrate, and a photoconductive layer provided on the undercoat layer and containing a binder resin. At least one compound selected from crown ethers, polyalkyleneglycol ethers, polyethyleneglycol monocarboxylic acid esters, polyethyleneglycol dicarboxylic acid esters, and hydroxy-terminated random or block copolymers containing oxypropylene and oxyethylene groups is incorporated into (a) the undercoat layer or (b) into a charge generating layer of the photoconductive layer. In the case of (a), the photoconductive layer is a dried coating of a composition containing at least one solvent selected from cyclic ethers, ketones and aromatic hydrocarbons.

10 Claims, 7 Drawing Sheets

ELECTROPHOTOGRAPHIC PHOTOCONDUCTOR, PROCESS CARTRIDGE, IMAGE FORMING APPARATUS AND IMAGE FORMING METHOD

BACKGROUND OF THE INVENTION

This invention relates to an electrophotographic photoconductor for use in an image forming machine such as a laser beam printer, a facsimile, a digital copying apparatus. The present invention is also directed to an image forming apparatus, to an image forming method and to a process cartridge using the electrophotographic photoconductor.

Conventionally, many organic electrophotographic photoconductors using an organic conductive material have been developed and mounted in a large number of copying machines and printers. With rapid digitization of electrophotography in recent years, a demand for an electrophotographic photoconductor having characteristics corresponding to digitization is increasing.

In recent digital copying machines and printers, a reverse developing system is dominating. In a reverse development system, the charges on parts corresponding to black parts (colored parts) of a draft on the photoconductor are erased by exposure to light and a toner image is formed on the light-exposed parts, not on unexposed parts. When an electrophotographic photoconductor is used in a reverse development system, toner adheres locally in non-image parts and causes image defects such as black spots and surface stain. This phenomenon is caused by local neutralization of the charges on the photoconductor surface due to charge infection from a conductive support or a lower layer.

To prevent black spots and surface stain which take place at the time of reverse development, it is proposed to provide an undercoat layer for preventing charge injection from the conductive support or a lower layer between the support and a photoconductive layer (comprising a charge generating layer and a charge transporting layer). Such an undercoat layer needs to cause no adverse effects on the properties of the photoconductor even in repetitive use. However, with an undercoat layer made of a single resin material, it is difficult to realize this property. Also, in order to prevent charge injection from the conductive support or a lower layer, the thicker the undercoat layer, the better. However, it is very difficult to form a thick undercoat layer with a single resin material. Thus, a method in which conductive particles are dispersed in the resin for the undercoat layer is proposed.

In the case of photoconductors for use in laser printers or the like in which an image is written with a coherent light such as a laser beam, it is proposed to disperse a white filler having a high reflective index in the resin for the undercoat layer to prevent moire.

Also, as a method for preventing black spots and surface stain which take place at the time of reverse development, it is proposed to increase the thickness of the photoconductive layer to decrease the electric field applied to the photoconductor and not to allow charge injection from the conductive support or a lower layer.

In conventional reverse development systems, a corona charging system is employed. However, repetition of electrophotographic process using a corona charging system increases ozone and impairs the safety in use. Thus, in recent years, contact charging systems are used. A contact charging system generates much less ozone than a corona discharging system and thus causes no problem of environmental safety.

However, a contact charging system has a peculiar problem of discharge breakdown caused by directly applying a high voltage to a photoconductor. In reverse development, discharge breakdown causes large black spots. Also, when the photoconductor is mounted in an image forming apparatus with a reverse development system, the absolute value of the potential of light-exposed parts increases, resulting in a decrease in image density.

To prevent discharge breakdown, it is necessary to increase the thickness of the undercoat layer to hide the defects on the conductive support surface such as flaws and unevenness. It is also effective to increase the thickness of the photoconductive layer to decrease the electric field applied to the electrophotographic photoconductor. However, such an increase of the thickness causes non-uniformity in image density of solid or half tone images.

SUMMARY OF THE INVENTION

As described previously, in the case of a photoconductor for use in a reverse development system, measures of increasing the thickness of the undercoat layer or the photoconductive layer are taken to prevent black spots and surface stain due to repetitive use and discharge breakdown in contact charging. However, with an increase of the thickness of the undercoat layer, it has been found to be more difficult to uniformly disperse filler particles therein and, in practice, dispersion of the filler is apt to be non-uniform. On the other hand, as the thickness of the photoconductive layer increases, it is necessary to increase the amount of a coating liquid for the photoconductive layer applied onto the undercoat layer. In this case, the solvent of the coating liquid tends to permeate the undercoat layer at locations where the dispersion of the filler is not uniform, resulting in swelling of the undercoat layer. Since the swelled regions of the photoconductor have different photosensitivity, image density variations occur in both solid image and half tone image produced by reverse development.

In the case of reverse development, the photoconductor is likely to have a decrease in sensitivity and an increase in residual potential during repetitive use. It has also been found that a solvent remaining in the photoconductive layer is one of the causes for a decrease of the image density during use. While an increase of the drying temperature and/or drying time for the formation of the photoconductive layer may prevent the retention of the solvent, the heat during the drying adversely affects the characteristics of the photoconductor.

In accordance of first aspect of the present invention, there is provided an electrophotographic photoconductor, comprising:

an electrically conductive substrate, an undercoat layer provided on said substrate, and a photoconductive layer provided on said undercoat layer, wherein said undercoat layer comprising a binder resin, an inorganic filler, and at least one compound selected from the group consisting of crown ethers, polyalkyleneglycol ethers, polyethyleneglycol monocarboxylic acid esters, polyethyleneglycol dicarboxylic acid esters, and hydroxy-terminated random or block copolymers containing oxypropylene and oxyethylene groups, and wherein said photoconductive layer is a dried coating of a composition containing at least one solvent selected from the group consisting of cyclic ethers, ketones and aromatic hydrocarbons.

The present invention also provides an image forming apparatus comprising the above photoconductor according to first aspect, a charging device for charging a surface of said photoconductor, an exposing device for exposing the charged surface to form an electrostatic latent image, a developing device for reverse-developing the latent image with a toner, and a transferring device for transferring the developed image to a transfer sheet.

The present invention further provides an image forming process comprising exposing the photoconductor according to the first aspect with light to form an electrostatic latent image thereon, reverse-developing said latent image with a toner, and transferring the developed image to a transfer sheet.

The present invention further provides a process cartridge freely detachable from an image forming apparatus, comprising the above photoconductor according to the first aspect, and at least one device selected from the group consisting of a charger, an image exposing device, a developing device, an image transferring device, and a cleaning device.

The present invention further provides a method of producing a photoconductor, comprising:

forming, on an electrically conductive substrate, an undercoat layer comprising a binder resin, an inorganic filler, and at least one compound selected from the group consisting of crown ethers, polyalkyleneglycol ethers, polyethyleneglycol monocarboxylic acid esters, polyethyleneglycol dicarboxylic acid esters, and hydroxy-terminated random or block copolymers containing oxypropylene and oxyethylene groups, applying to the undercoat layer a first coating liquid comprising a charge generating material and at least one solvent selected from the group consisting of cyclic ethers, ketones and aromatic hydrocarbons to form a charge generating layer, and applying to the charge generating layer a second coating liquid comprising a charge transporting material and at least one solvent selected from the group consisting of cyclic ethers, ketones and aromatic hydrocarbons to form a charge transporting layer.

According to the second aspect of the present invention, there is provided an electrophotographic photoconductor, comprising:

an electrically conductive substrate, an undercoat layer provided on said substrate and comprising a binder resin, and an inorganic filler, a charge generating layer provided on said undercoat layer and comprising a charge generating material, a binder resin, and at least one compound selected from the group consisting of crown ethers, polyalkyleneglycol ethers, polyethyleneglycol monocarboxylic acid esters, polyethyleneglycol dicarboxylic acid esters, and hydroxy-terminated random or block copolymers containing oxypropylene and oxyethylene groups, and a charge transporting layer provided on said charge generating layer and comprising a charge transporting material, and a binder resin.

The present invention also provides an image forming apparatus comprising the photoconductor according to the second aspect, a charging device for charging a surface of said photoconductor, an exposing device for exposing the charged surface to form an electrostatic latent image, a developing device for reverse-developing the latent image with a toner, and a transferring device for transferring the developed image to a transfer sheet.

The present invention further provides an image forming process comprising exposing the photoconductor according to the second aspect with light to form an electrostatic latent image thereon, reverse-developing said latent image with a toner, and transferring the developed image to a transfer sheet.

It is, therefore, an object of the present invention to provide an electrophotographic photoconductor which has solved the above problems of the conventional techniques.

Another object of the present invention is to provide an electrophotographic photoconductor which does not cause image density variations of solid images and half tone images.

It is a further object of the present invention to provide an electrophotographic photoconductor which has long service life and which does cause image defects such as black spots and background stains attributed to discharge breakdown even when repeatedly used under various environments such as low temperature and low humidity conditions and high temperature and high humidity conditions.

It is a further object of the present invention to provide an image forming apparatus, an image forming process, a process cartridge and a method of producing a photoconductor.

It is yet a further object of the present invention to provide an electrophotographic photoconductor which does not have a decrease in sensitivity and an increase in residual potential and does not cause a decrease in image density even when repeatedly used.

It is a further object of the present invention to provide an image forming apparatus having a photoconductor which has no fluctuation in the potential of light-exposed parts even when repeatedly used in a reverse development system and thus capable of producing high quality images with uniform density and free from image defects such as black spots due to discharge breakdown.

It is a further object of the present invention to provide a color image forming apparatus having photoconductors which have no fluctuation in the potential of light-exposed parts even when repeatedly used in a reverse development system and thus capable of producing high quality images with uniform density and free from color tone shift.

It is a further object of the present invention to provide an image forming method using a photoconductor which has no fluctuation in the potential of light-exposed parts even when repeatedly used in a reverse development system and thus capable of producing high quality images with uniform density and free from image defects such as black spots due to discharge breakdown.

BRIEF DESCRIPTION OF THE DRAWINGS

Other objects, features and advantages of the present invention will become apparent from the detailed description of the preferred embodiments of the invention which follows, when considered in the light of the accompanying drawings, in which.

DETAILED DESCRIPTION OF THE PREFERRED EMBODIMENTS OF THE INVENTION

Figure 1:
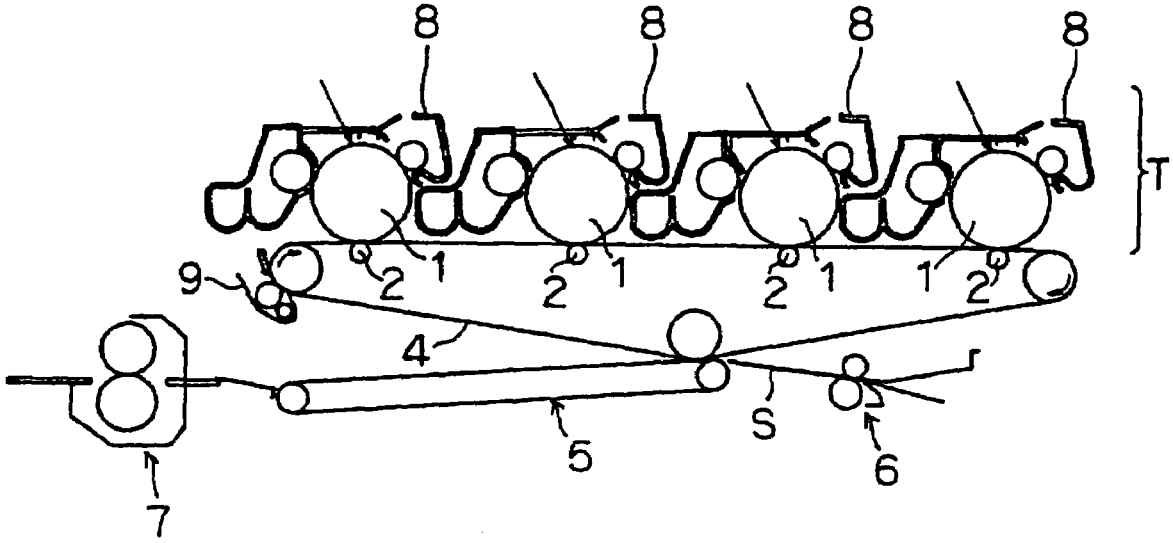
FIG. 1 is a view for explaining a tandem color image forming apparatus.

The first aspect of the present invention provides an electrophotographic photoconductor, which comprises (A) an electrically conductive substrate, (B) an undercoat layer provided on the substrate, and (C) a photoconductive layer provided on the undercoat layer. These constituents (A)-(C) will be described in detail below.

Substrate (A):

A conductive support for use in the present invention may be a metal support such as aluminum, nickel or stainless; a plastic support in which a conductive filler such as carbon powder is dispersed; or an insulating material (plastic, plastic film or the like) on which a metal is vapor deposited or a conductive paint is applied.

Undercoat Layer (B):

The undercoat layer comprises a binder resin, an inorganic filler, and at least one swelling preventing compound selected from crown ethers, polyalkyleneglycol ethers, polyethyleneglycol monocarboxylic acid esters, polyethyleneglycol dicarboxylic acid esters, and hydroxy-terminated copolymers containing oxypropylene and oxyethylene groups. The copolymer may be a random copolymer or a block copolymer. The swelling preventing compound is preferably used in an amount of 0.1-30 parts by weight per 100 parts by weight of the binder resin for reasons of effective swelling preventing properties without adversely affecting the desired characteristics of the photoconductor.

The inorganic filler for use in the undercoat layer may be a filler generally used in this field, preferably a white or whitish filler having absorption in the visible and the near infrared in view of enhancement of the sensitivity of a resulting photoconductor. Specific examples of the filler include white fillers such as titanium oxide, zinc white, zinc sulfate, white lead and lithopone; and extenders such as aluminum oxide, silica, calcium carbonate, and barium sulfate. Above all, titanium oxide is preferred since it has a refractive index which is larger than that of other white fillers, is stable both chemically and physically, and has high hiding power and whiteness. Both rutile type titanium oxide and anatase type titanium oxide may be suitably used for the purpose of the present invention. Titanium oxide treated with an inorganic oxide such as alumina or silica for improving the dispersibility, weatherability and stability against discloration is commercially available. Such a treated titanium oxide, however, tends to increase temperature and/or humidity dependency of the service life of the photoconductor. Therefore, the use of non-treated titanium oxide is desired for reasons of prevention of image defects during repeated image formation in various environments.

The crown ether to be used in the undercoat layer preferably has 3 to 8 oxygen atoms in the ring thereof. Illustrative of suitable crown ethers are: benzo-9-crown-3 ether (formula C-1 below)

(C-1)

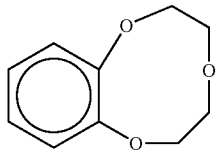

12-crown-4 ether (C-2)

(C-2)

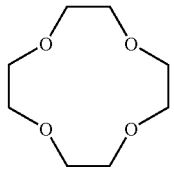

18-crown-6 ether (C-3)

(C-3)

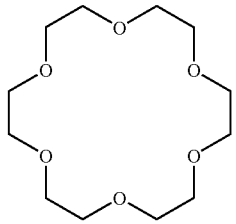

dibenzo-18-crown-6 ether (C-4)

(C-4)

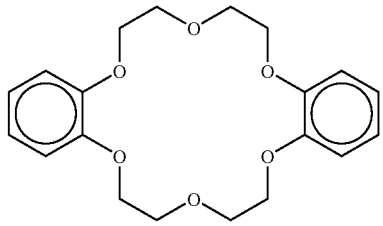

tribenzo-18-crown-6 ether (C-5)

(C-5)

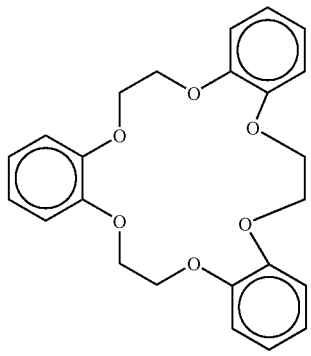

18-crown-6-furan (C-6)

(C-6)

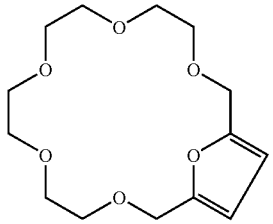

perhydrobenzo-18-crown-6 ether (C-7)

(C-7)

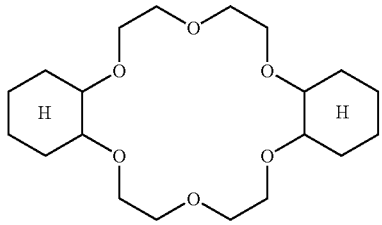

tetrabenzo-24-crown-8 ether (C-8)

(C-8)

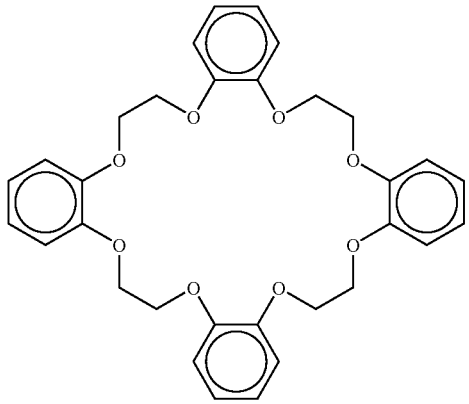

dibenzo-24-crown-8 ether (C-9)

(C-9)

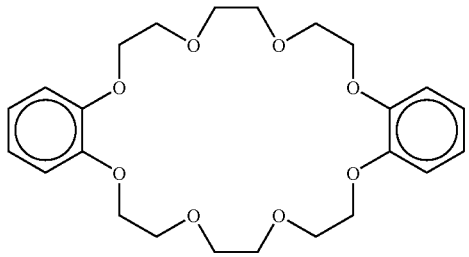

dicyclohexano-24-crown-8 ether (C-10)

(C-10)

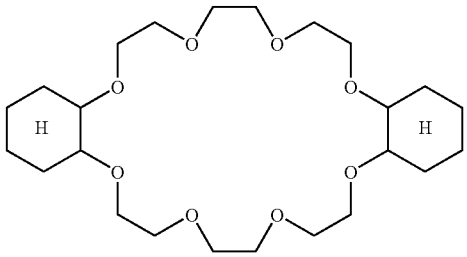

18-crown-6 ether (C-11)

(C-11)

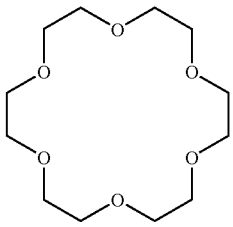

15-crown-5 ether (C-12) and (C-12)

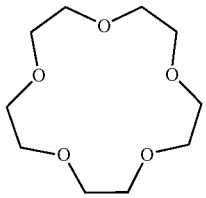

21-crown-7 ether (C-13)

(C-13)

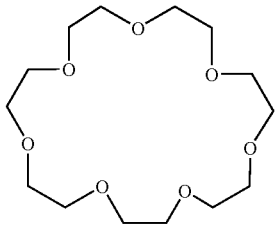

The polyalkyleneglycol ether to be used in the undercoat layer may include polyethylene glycol monoalkylether represented by the following formula (I) and polypropylene glycol monoalkylether represented by the following formula (II):

$$R—O—(CH_2CH_2O)_n—H \quad (I)$$

$$R—O—(CH_2CH_2CH_2O)_n—H \quad (II)$$

wherein R represents a alkyl group having 1 to 30, preferably 1-20, carbon atoms or a substituted or non-substituted aryl group, preferably an alkyl-substituted phenyl group having 1 to 20 carbon atoms, n represents an average addition mole number, which is an integer at least one, preferably between 1 to 100.

Such polyalkylene glycol ethers are conventionally known, and, various commercially available products can be used in the present invention. In the present invention, a polyalkyleneglycol monoalkylether having a molecular weight of 70 to 10000, preferably 200 to 5000, is preferably used.

Specific examples of the compounds represented by the general formula (I) include but are not limited to Emulmine 40, 50, 60, 70, 110, 140, 180, M-20, 240, L-90-S-800-100 and L-380 made by Sanyo Chemical Industries, Ltd., Adeka Estol OEG and SEG series made by Asahi Denka Co., Ltd., Noigen ET series, Noigen EA series and Emulsit L series made by Daiichi Kogyo Seiyaku Co., Ltd., Nonion E-206, E-210, E-230, P-208, P-210, P-213, S-207, S-215, S-220, K-204, K-215, K-220, K-230 and T-2085, Persoft NK-60 and NK-100, Nonion NS series and HS series, Uniox M-400, M-550, M-200 and C-2300 made by NOF Corporation, Nonipole 20, 30, 40, 55, 60, 70, 85, 90, 95, 100, 110, 120, 130, 140, 160, 200, 290, 300, 400, 450, 500, 700, 800 and D160, Octapole 45, 50, 60, 80, 100, 200, 300 and 400, and Dodecapole 61, 90, 120 and 200 made by Sanyo Chemical Industries, Ltd.

Specific examples of the compounds represented by the general formula (II) include but are not limited to Newpole. LB-65, Newpole L285, Newpole LB385, Newpole LB625, Newpole L1145, Newpole LB1715, Newpole LB3000, Newpole LB300X, Newpole LB400XY, Newpole LB650X, and Newpole L11800X made by Sanyo Chemical Industries, Ltd.

The polyethyleneglycol monocarboxylic acid ester usable in the undercoat layer may be a commercially available product such as Ionet MS-400, MS-1000, MO-200, MO-400 and MO-600, and Santopal TE-106 made by Sanyo Chemical Industries, Ltd., Noigen ES series made by Daiichi Kogyo Seiyaku Co., Ltd., Nonion L series, Nonion O series, and Nonion T series made by NOF Corporation.

The polyethyleneglycol dicarboxylic acid ester usable in the undercoat layer may be a commercially available product such as Ionet DL-200, DS-300, DS-400, DO-200, DO-400, DO-600 and DO-1000, and Santopearl GE-70 made by Sanyo Chemical Industries, Ltd., Nonion DS-60HN (distearate) made by NOF Corporation.

The hydroxy-terminated copolymer containing oxypropylene and oxyethylene groups, which is usable in the undercoat layer, may be a random or block copolymer having a molecular weight of 500 to 100,000, preferably 2,000 to 50,000, an average oxyethylene group addition mole number of 1 to 1,000, preferably 1 to 600, and an average oxypropylene group addition mole number of 1 to 2,000, preferably 1 to 1,000. Specific examples of the random or block copolymer product include but are not limited to Newpole PE-61, PE-62, PE-64, PE-68, PE-71, PE-74, PE-75, PE-78, PE-85, PE-88, PE-108 and PE-2700, and Newpole 75H-90000 made by Sanyo Chemical Industries, Ltd., Pulronic L series, P series and F series made by Asahi Denka Co., Ltd., Epan series made by Daiichi Kogyo Seiyaku Co., Ltd., and Pronon 102, 104, 105, 201, 204, and 208 made by NOF Corporation.

The binder resin of the undercoat layer may be any suitable resin customarily used in this field. Specific examples of the binder resin include water-soluble resins such as polyvinyl alcohol, casein and sodium polyacrylate; alcohol-soluble resins such as nylon copolymers, and methoxymethylated nylons; and curable resins having a three-dimensional network structure such as polyurethane resins, melamine resins, and epoxy resins.

A coating liquid for forming the undercoat layer may be obtained by dispersing the binder resin dissolved in a solvent together with an inorganic filler using a ball mill, sand mill, attritor or the like. The swelling preventing compound may be dissolved in the thus obtained dispersion or may be dispersed together with the inorganic filler. The undercoat layer is formed by applying the thus obtained dispersion on a conductive support by a coating method such as blade coating, knife coating, spray coating, and dip coating, and drying the dispersion. The weight ratio of the binder resin to the inorganic filler is preferably in the range of 1/15 to 2/1.

The thickness of the undercoat layer is preferably in the range of 0.5 to 20.0 μm. The thicker the undercoat layer, the better to produce a highly durable photoconductor which is not likely to cause a background stain even when repeatedly used. Thus, the undercoat layer preferably has a thickness of at least 5.0 μm. When a contact charging device is used as charging means, the undercoat layer also preferably has a thickness of at least 5.0 μm for reasons of prevention of discharge breakdown.

Photoconductive Layer (C):

The photoconductive layer provided on the above undercoat layer may be a single layer or a laminate of two or more layers. In either case, it is important that the layer or layers constituting the photoconductive layer should be a dried coating of a composition containing at least one solvent selected from cyclic ethers, ketones and aromatic hydrocarbons.

The photoconductive layer preferably has a thickness of at least 28 μm for reasons of prevention of image defects due to repetitive use. With repetitive use, an electrophotographic photoconductor is subjected to abrasion by contacting members and the thickness of the photoconductive layer thereof is decreased. As a result, the intensity of electric field applied to the photoconductor increases and image defects such as background stains occur due to charge injection from the conductive support. Thus, a photoconductor having a thick photoconductive layer can continue to produce high-quality images even when repeatedly used. The term "thickness of the photoconductive layer" as used herein is intended to mean a total thickness of the layer or layers constituting the photoconductive layer. Thus, when the photoconductive layer is composed of a single layer, then the thickness of the single layer represents the thickness of the photoconductive layer. When the photoconductive layer is composed of, for example, two layers including a charge generating layer and a charge transporting layer, then a total thickness of the charge generating and transporting layers represents the thickness of the photoconductive layer.

Even when the above-described swelling preventing compound is incorporated into the undercoat layer, local swelling of the undercoat layer occurs when the photoconductive layer is formed thereon by applying a coating liquid containing a halogen-containing solvent such as dichloromethane. Therefore, it is unable to increase the thickness of the photoconductive layer and, hence, the resulting photoconductor is apt to cause background stains upon repeated use. When the solvent selected from cyclic ethers, ketones and aromatic hydrocarbons is used for the formation of the photoconductive layer, on the other hand, no such local swelling of the undercoat layer is caused so that the photoconductor obtained can form high quality images without non-uniformity in image density in solid or half tone images. Further, since the photoconductive layer can be as thick as 28 μm or more, the photoconductor can show excellent durability or service life while preventing the formation of image defects such as background stains.

Examples of the cyclic ether solvent include tetrahydrofuran, 1,3-dioxorane and 1,4-dioxane. Examples of the ketone solvent include methyl ethyl ketone, acetone and cyclohexanone. Examples of the aromatic hydrocarbon solvent include toluene, xylene and benzene.

It is preferred that the photoconductive layer contain at least one phenol compound and at least one organic sulfur compound for reasons of prevention of occurrence of image defects. When the solvent selected from cyclic ethers, ketones and aromatic hydrocarbons remains unremoved in the photoconductive layer of the photoconductor product, an increase of the residual potential in the photoconductor may be caused upon repeated use. In particular, when the thickness of the photoconductive layer is as large as 28 μm or more and when the image formation is carried out by using a reverse-development system, a reduction of the image density is apt to be caused. By incorporating the phenol compound and organic sulfur compound in combination into the photoconductive layer, the photoconductor can exhibit stable electrostatic characteristics without an increase of residual potential, even when repeatedly used for a long period of service under various conditions.

Any phenol compound including sterically hindered phenol compound may be suitably used for the purpose of the present invention. Specific examples of the phenol compound include 2,6-di-tert-butylphenol, 2,6-di-tert-butyl-4-methoxyphenol, 2,6-di-tert-butyl-4-methylphenol, 2-tert-butyl-4-methoxyphenol, 2,4-dimethyl-6-tert-butylphenol, 2-tert-butylphenol, 3,6-di-tert-butylphenol, 2,4-di-tert-butylphenol, 2,6-di-tert-butyl-4-ethylphenol, 2-tert-butyl-4,6-dimethylphenol, 2,4,6-tri-tert-butylphenol, 2,6-di-tert-butyl-4-stearylpropionatophenol, α-tocophenol, β-tocophenol, γ-tocophenol, δ-tocophenol, naphthol AS, naphthol AS-D, naphthol AS-BO, 4,4'-methylenebis(2,6-di-tert-butylphenol), 2,2'-methylenebis(4-methyl-6-tert-butylphenol), 2,2'-methylenebis(4-ethyl-6-tert-butylphenol), 2,2'-ethylenebis(4,6-di-tert-butylphenol), 2,2'-propylenebis(4,6-di-tert-butylphenol), 2,2'-butenebis(4,6-di-tert-butylphenol), 2,2'-ethylenebis(6-tert-butyl-m-cresol), 4,4'-butenebis(6-tert-butyl-m-cresol), 2,2'-butenebis(6-tert-butyl-p-cresol), 2,2'-thiobis(6-tert-butylphenol), 4,4'-thiobis(6-tert-butyl-m-cresol), 4,4'-thiobis(6-tert-butyl-o-cresol), 2,2'-thiobis(4-methyl-6-tert-butylphenol), 1,3,5-trimethyl-2,4,6-tris(3,5-di-tert-butyl-4-hydroxybenzyl)benzene, 1,3,5-trimethyl-2,4,6-tris(3,5-di-tert-amyl-4-hydroxybenzyl)benzene, 1,3,5-trimethyl-2,4,6-tris(3-tert-butyl-5-methyl-4-hydroxybenzyl)benzene, 2-tert-butyl-5-methyl-phenylaminophenol and 4,4'-bisamino(2-tert-butyl-5-methylphenol).

Any organic sulfur compound may be suitably used together with the above phenol compound. Specific examples of the organic sulfur compounds include dilauryl thiodipropionate, dimyristyl thiodipropionate, lauryl-stearyl thiodipropionate, distearyl thiodipropionate, dimethyl thiodipropionate, 2-mercaptobenzimidazole, phenothiazine, octadecyl thioglycolate, butyl thioglycolate and octyl thioglycoloate and thiocresol.

It is important that the phenol compound should be used in conjunction with the organic sulfur compound, since otherwise the effect of prevention of an increase of the residual potential in the photoconductor upon repeated use is not sufficient. The organic sulfur compound is generally used in an amount of 0.01 to 100 parts by weight, preferably 0.1 to 10 parts by weight, per part by weight of the phenol compound. The phenol compound and the organic sulfur compound may be dissolved in the solvent of the coating liquid for the formation of the photoconductive layer.

Next, description will be made of the photoconductive layer composed of a charge generating layer and a charge transporting layer.

The charge generating layer includes a charge generating material and a binder resin. As the charge generating material, an inorganic or organic material such as a monoazo pigment, disazo pigment, trisazo pigment, perylene pigment, perinone pigment, quinacridone pigment, quinone condensation polycyclic compound, squaraines, phthalocyanine pigment, naphthalocyanine pigment, azulenium salt dye, selenium, selenium-tellurium, selenium-arsenic compound, or amorphous silicon is used. The charge generating materials are used alone or in combination.

As the binder resin for use in the charge generating layer, any binder resin used in this field can be used. Specific examples of the binder resin include resins soluble in the above solvent such as polyurethane, polyester, epoxy resins, polycarbonate, acrylic resins, polyvinyl butyral, polyvinyl formal, polystyrene and polyacrylamide.

A coating liquid for forming the charge generating layer can be prepared by first dissolving the binder resin in the above solvent and by dispersing a charge generating material in the solution using a ball mill, roll mill sand mill, attritor or the like mixer. Alternatively, the binder resin may be added together with the charge generating material to the solvent. The mixture is then dispersed using a mill.

The charge generating layer coating liquid can be applied to the undercoat layer previously formed on the conductive substrate by dip coating, spray coating, bead coating or the like. The thickness of the charge generating layer is generally 0.01 to 5 μm, preferably 0.1 to 2 μm.

The charge transporting layer includes a binder resin and a charge transporting material and may be formed by dissolving or dispersing the charge transporting material and the binder resin in the above solvent, and by applying the solution or dispersion on the charge generating layer, followed by drying.

Charge transporting materials include positive hole transporting materials and electron transporting materials. Specific examples of the electron transporting materials include electron accepting materials such as chloranyl, bromanyl, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophen-4-one, and 1,3,7-trinitrodibenzothiophene-5,5-dioxide and benzoquinone derivatives.

Specific examples of the positive hole transporting materials include poly-N-vinylcarbazole and its derivatives, poly-y-carbazolylethylglutamate and its derivatives, condensation products of pyrene and formaldehyde and their derivatives, polyvinyl pyrene, polyvinyl phenanthrene, polysilane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triaryl methane derivatives, 9-styrylanthracene derivatives, pyrazoline derivatives, divinyl benzene derivatives, hydrazine derivatives, indene derivatives, butadiene derivatives, pyrene derivatives, bisstilbene derivatives, enamine derivatives and polymerized positive hole transporting materials.

As the binder resin for use in the charge transporting layer, thermoplastic resins such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate, phenoxy resins, polycarbonate, cellulose acetate resins, ethyl cellulose resins, polyvinyl butyral, polyvinyl formal, polyvinyl toluene, poly-N-vinylcarbazole, acrylic resins, silicone resins, epoxy resins, melamine resins, urethane resins, phenolic resins, alkyd resins and polycarbonate copolymers disclosed in Japanese Laid-Open Patent Publication No. H05-158250 and Japanese Laid-Open Patent Publication No. H06-051544 and thermosetting resins.

The amount of the charge transporting material is 20 to 300 parts by weight, preferably 40 to 150 parts by weight, per 100 parts by weight of the binder resin.

The phenol compound and the organic sulfur compound may be incorporated into one or both of the charge generating and transporting layers and may be dissolved, before, during or after the formation of the coating liquid therefor, in the solvent of the coating liquid.

The photoconductive layer of a single layer structure may be formed by applying a coating liquid containing the charge generating layer, charge controlling layer, binder resin and, if desired, the phenol compound and the organic sulfur compound, which are dissolved and/or dispersed in the above solvent.

A total amount of the phenol compound and the organic sulfur compound is generally 0.05 to 20% by weight based on the weight of the charge generating material and/or charge transporting material.

In the present invention, the photoconductive layer may contain one or more various additives such as a leveling agent, an antioxidant and a plasticizer. Specific examples of the leveling agent include silicone oils such as dimethyl silicone oil and methyl phenyl silicone oil, and polymers or oligomers having a perfluoroalkyl group in their side chains. The amount of the leveling agent is preferably 0 to 1 part by weight per 100 parts by weight of the binder resin.

The second aspect of the present invention provides an electrophotographic photoconductor, which comprises (A') an electrically conductive substrate, (B') an undercoat layer provided on the substrate, (C1) a charge generating layer provided on the undercoat layer, and (C2) a charge transporting layer provided on said charge generating layer. These constituents (A'), (B'), (C1) and (C2) will be described in detail below.

Substrate (A'):

The substrate (A') may be the same as the substrate (A) described above.

Undercoat Layer (B'):

The undercoat layer comprises a binder resin and an inorganic filler.

The inorganic filler and the binder resin for use in the undercoat layer (B') may be the same as those used in the above-described undercoat layer (B). A coating liquid for forming the undercoat layer may be obtained by dispersing a binder resin dissolved in a solvent together with an inorganic filler using a ball mill, sand mill, attritor or the like. The undercoat layer is formed by applying the thus obtained dispersion on a conductive support by a coating method such as blade coating, knife coating, spray coating, and dip coating, and drying the dispersion. The ratio of the binder resin to the inorganic filler is preferably in the range of 1/15 to 2/1.

The thickness of the undercoat layer is preferably in the range of 0.5 to 20.0 μm. The thicker the undercoat layer, the better to produce a highly durable photoconductor which is not likely to cause a background stain even when repeatedly used. Thus, the undercoat layer preferably has a thickness of at least 5.0 μm. When a contact charging device is used as charging means, the undercoat layer also preferably has a thickness of at least 5.0 μm for reasons of prevention of discharge breakdown.

Charge Generating Layer (C1):

The charge generating layer is formed on the inorganic filler-dispersed undercoat layer and a charge transporting layer is formed on the charge generating layer.

A charge generating layer comprises a charge generating material, a binder resin, and at least one compound selected from crown ethers, polyalkyleneglycol ethers, polyethyleneglycol monocarboxylic acid esters, polyethyleneglycol dicarboxylic acid esters, and hydroxy-terminated random or block copolymers containing oxypropylene and oxyethylene groups. The charge generating materials described above in connection with the photoconductive layer (C) of the first aspect of the invention may be suitably used.

As the binder resin for use in the charge generating layer (C1), those resins described above in connection with the photoconductive layer (C) of the first aspect of the invention may be suitably used.

As the crown ether, polyalkyleneglycol ethers, polyethyleneglycol monocarboxylic acid esters, polyethyleneglycol dicarboxylic acid esters, and hydroxy-terminated random or block copolymers containing oxypropylene and oxyethylene groups used in the charge generating layer (C1), those compounds described above in connection with the undercoat layer (B) of the first aspect of the invention may be suitably used.

The amount of the compound or compounds selected from crown ethers, polyalkyleneglycol ethers, polyethyleneglycol monocarboxylic acid esters, polyethyleneglycol dicarboxylic acid esters, and hydroxy-terminated random or block copolymers containing oxypropylene and oxyethylene groups and incorporated into the charge generating layer (C1) is at least 0.1 part by weight per 100 part by weight of the binder resin used in the charge generating layer. When the amount is less than 0.1 parts by weight, the effect of preventing sensitivity deterioration of the resulting photoconductor or an increase of residual voltage on the resulting photoconductor due to repetitive use cannot be obtained. Especially, when the photoconductor is used in a reverse development system, image density largely fluctuates during repetitive use.

The application of the charge generating layer coating liquid can be by dip coating, spray coating, bead coating or the like. The thickness of the charge generating layer is generally 0.01 to 5 μm, preferably 0.1 to 2 μm.

Charge Transporting Layer (C2):

The charge transporting layer comprises a charge transporting material and a binder resin and preferably has a thickness of at least 28 μm to prevent image defects such as surface stains due to repetitive use.

With repetitive use, an electrophotographic photoconductor is subjected to abrasion by contacting members and the thickness of the photoconductive layer thereof is decreased. As a result, the intensity of electric field applied to the photoconductor increases and image defects such as surface stains occur due to charge injection from the conductive support. Thus, a photoconductor having a thick photoconductive layer can continue to produce high-quality images even when repeatedly used.

The charge transporting layer is formed by dissolving or dispersing a charge transporting material and a binder resin in a solvent such as a cyclic ether organic solvent, ketone organic solvent or aromatic organic solvent, applying the solution or dispersion on the charge generating layer and drying the solution or dispersion.

Specific examples of the charge generating and transporting materials are the same as those described above with reference to the photoconductive layer (C) of the first aspect of the present invention.

As a binder resin for use in the charge transporting layer (C2), those resins described above with reference to the photoconductive layer (C) of the first aspect of the present invention may be mentioned.

The amount of the charge transporting material is 20 to 300 parts by weight, preferably 40 to 150 parts by weight, per 100 parts by weight of the binder resin.

In the present invention, the charge transporting layer may contain a leveling agent and an antioxidant. Specific examples of the leveling agent include silicone oils such as dimethyl silicone oil and methyl phenyl silicone oil, and polymers or oligomers having a perfluoroalkyl group in their side chain. The amount of the leveling agent is preferably 0 to 1 part by weight per 100 parts by weight of the binder resin. Specific examples of the antioxidant include hindered phenol compounds, sulfur compounds, phosphorus compounds, hindered amine compounds, pyridine derivatives, piperidine derivatives, and morpholine derivatives. The amount of the antioxidant is preferably 0 to 5 parts by weight per 100 parts of the binder resin.

Description will be next made of an image forming apparatus and an image forming method according to the present invention.

The image forming apparatus of the present invention comprises at least charging means, image exposure means, reverse developing means, transfer means and an electrophotographic photoconductor. The charging means charges the peripheral surface of the rotary drum-shaped electrophotographic photoconductor to a predetermined positive or negative potential. A positive or negative DC voltage is applied to the charging means. The DC voltage applied to the charging means is preferably in the range of −2000 V to 2000 V.

Recently, apparatuses employing contact charging in place of conventional corona charging have been put into practical use. This method has advantages of being able to simplify an apparatus and generating less ozone than corona charging does.

Contact charging means is disposed in contact with the surface of a photoconductor, and applies a voltage from outside to the photoconductor directly and uniformly to charge it to a predetermined potential. The contact charging means made of a metal such as aluminum, iron or copper; a conductive polymer material such as polyacetylene, polypyrrole or polythiophene; a rubber or synthetic fabric conductively treated with a dispersion of conductive particles such as particles of carbon black or a metal in an insulating resin such as polycarbonate or polyethylene; or an insulating resin coated with a conductive material can be used. The contact charging means may be in the form of a roller, brush, blade or belt.

The voltage applied to the contact charging means may be either AC, DC, or AC+DC. The voltage may be applied in an instant or increased stepwise.

The charged photoconductor is subjected to light image exposure (slit exposure or laser beam scanning exposure) by the image exposure means. At the time of the exposure scanning, parts on the photoconductor corresponding to non-image parts on the original surface are not subjected to exposure, and a developing bias with a potential which is slightly lower than the surface potential is applied to parts corresponding to image parts, a potential on which has been reduced by the exposure, to conduct reverse development. Thereby, a latent image corresponding to the original including the non-image parts is sequentially formed.

The latent image is developed with toner by the reverse developing means, and the toner image is sequentially transferred onto a recording material supplied between the photoconductor and the transfer means in synchronization with the rotation of the photoconductor by transfer charging means. The recording material onto which the toner image has been transferred is separated from the surface of the photoconductor and introduced into image fixing means, where the image is fixed to the recording material. Then the recording material is discharged to the outside of the apparatus as a duplication (copy).

The density of an image produced by an image forming apparatus (electrophotographic apparatus) with a reverse developing means is largely dependent upon the sensitivity and the residual potential of the photoconductor mounted therein. Thus, with an image forming apparatus mounting a photoconductor whose sensitivity and residual potential largely fluctuate due to repetitive use, the image density is varied during use.

In the image forming apparatus of the present invention, however, the sensitivity and residual potential of the photoconductor mounted therein is not varied even during repetitive use. As a result, the potential of the light-exposed part do not vary with time, and high quality images with uniform density can be provided.

In a contact charging system, discharge breakdown is likely to occur in the photoconductor, resulting in image defects of large black spots in images.

In the photoconductor of the present invention, however, even when the thickness of the inorganic filler-dispersed undercoat layer and/or the charge transporting layer is increased, the sensitivity and residual potential are not varied during repetitive use. As a result, even when the photoconductor is mounted in an image forming apparatus with contact charging means, discharge breakdown does not occur and the image density does not varied with time during repetitive use. Thus, the image forming apparatus can continue to produce uniform and high-quality images.

Description will be next made of the image forming method of the present invention. The image forming method of the present invention is one in which an electrophotographic photoconductor is repeatedly subjected to at least charging, image exposure, development and transfer charging, image exposure, development and transfer. As the development means, reverse development means is employed.

The density of an image produced by a reverse developing process is largely dependent upon the exposure potential, which is largely dependent on the sensitivity and the residual potential of the photoconductor mounted in the apparatus. Thus, in a reverse development process using a photoconductor whose sensitivity and residual potential largely fluctuate due to repetitive use, the image density is varied since the exposure potential varies with time. In the image forming method of the present invention, however, the sensitivity and residual potential of the photoconductor do not vary even during repetitive use, so that the exposure potential does not vary with time. Thus, high quality images with uniform density can be constantly provided.

Moreover, in a reverse development process, when the difference between the dark part potential and the light part potential is large, a sufficient margin for potential fluctuation due to environmental fluctuation or the like can be secured and a good image can be produced. One of the methods for this is to increase the charge potential of the photoconductor. However, the higher the charge potential on the photoconductor surface is, the higher the incidence of discharge breakdown is. With the method of the present invention, however, even when the thicknesses of the inorganic filler-dispersed undercoat layer and the charge transporting layer are increased, the sensitivity and residual potential of the electrophotographic photoconductor are not varied. Thus, even when a charge potential of 600 V or higher in an absolute value is charged, the photoconductor can constantly produce high-quality images without any problem even when repeatedly used.

Namely, in an image forming method in which an electrostatic latent image having a dark part potential of 600 V or higher in an absolute value is formed on the photoconductor surface and the formed electrostatic latent image is developed by reverse development, high-quality images can be constantly produced.

Description will be next made of a color image forming apparatus of the present invention.

Figure 2:
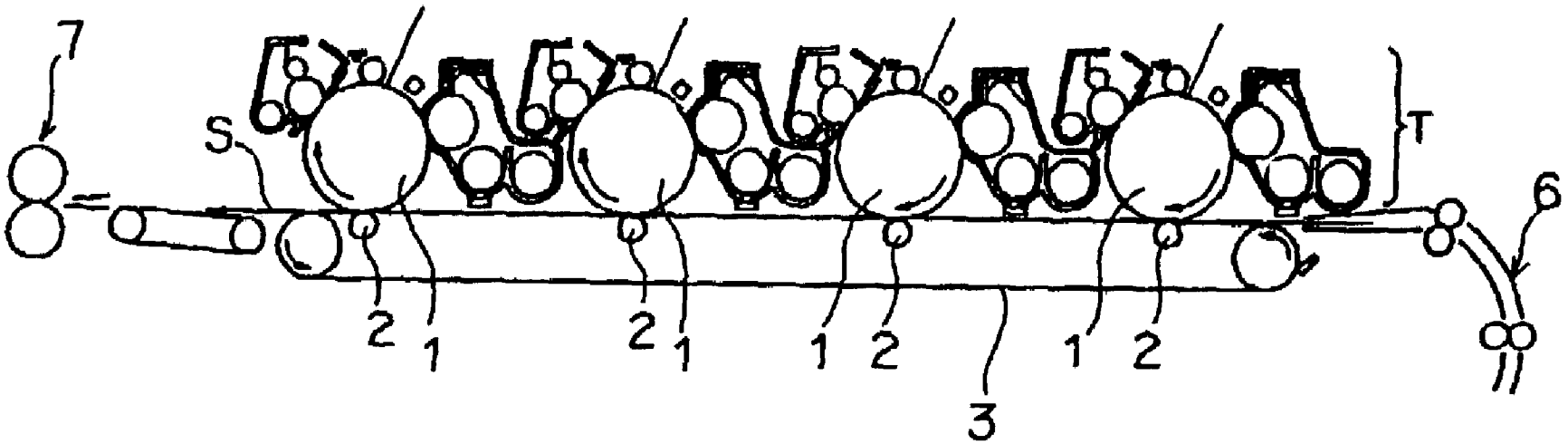
FIG. 2 is a view for explaining a tandem color image forming apparatus.

FIG. 1 and FIG. 2 illustrate a tandem color image forming apparatus.

Color electrophotographic apparatuses are divided into a single drum type apparatuses and tandem type apparatuses. A single drum type apparatus has a plurality of developing units for different colors around a photoconductor. The developing units supply toners on the photoconductor to form a synthetic toner image thereon, and the toner image is transferred onto a sheet to record a color image thereon. A tandem type apparatus has a plurality of photoconductors which are arranged in a row and each of which is provided with a developing unit. A single color toner image in formed on each photoconductor, and the single color images are sequentially transferred onto a sheet to record a color image thereon.

Single drum type apparatuses have only one photoconductor and thus can be relatively reduced in size and cost. However, since a full color image is formed by repeating a plurality of times (generally four times) of image formation with one photoconductor, it is difficult to increase the image formation speed. Tandem types apparatuses have disadvantage of being large in size and cost, but the image formation speed can be easily increased.

In recent years, a speed comparable to monochrome copying machines is required for full color copying machines, and tandem type apparatuses draw attention. However, in a tandem type apparatus, due to its constitution in which a full color image is formed with a plurality of photoconductors, when the sensitivities and residual potentials of the photoconductors are varied due to repetitive use, the produced images have density non-uniformity, resulting in change in the color tone with time. Therefore, the photoconductor of the present invention, which has no deterioration of sensitivity and increase in residual potential and on which the potential of the light-exposed part is not varied with time, can be preferably used in a tandem type image forming apparatus.

Tandem type image forming apparatuses are divided into direct transfer type apparatuses and indirect transfer type apparatuses. In a direct transfer type apparatus, images on photoconductors 1 are sequentially transferred onto a sheet s transported by a sheet carrying belt 3 by transfer units 2 as shown in FIG. 2. In an indirect transfer type apparatus, images on photoconductors 1 are once transferred onto an intermediate transfer member 4 sequentially by primary transfer units 2 and the images superimposed on the intermediate transfer member 4 is transferred by one operation onto a sheet s by a secondary transfer unit 5 as shown in FIG. 1. The transfer unit 5 herein is a transfer carrying belt, but may be a roller.

Direct transfer type apparatuses, in which a paper supply unit 6 and a fixing unit 7 must be disposed upstream and downstream, respectively, of a tandem image forming unit T comprising the photoconductors arranged in a row, are unavoidably large in the sheet transporting direction.

In indirect transfer type apparatuses, there is no strict limitation on the position of the secondary transfer unit. For example, a paper supply unit 6 and a fixing unit 7 may be disposed on a tandem image forming unit T. Thus, the apparatuses can be downsized.

In order to prevent a direct transfer type apparatus from becoming large in the sheet transporting direction, the fixing unit 7 is disposed in the vicinity of the tandem image forming unit T. In this case, the fixing unit 7 cannot be disposed with a sufficient space in which a sheet s can be flexed, so that the image formation performed upstream of the fixing unit 7 may adversely affected by an impact generated when a tip of the sheet s enters the fixing unit 7 (which is large in particular when the sheet is thick) or the difference between the speed of a sheet s through the fixing unit 7 and the speed at which the transfer carrying belt carries the sheet.

On the contrary, in an indirect transfer type apparatus, the fixing unit 7 can be disposed with a sufficient space in which a sheet s can be flexed, so that the effects of the fixing unit 7 on image formation can be prevented.

For the reasons as above, indirect type apparatuses among tandem electrophotographic apparatuses draw attention in recent years.

In this type of electrophotographic apparatus, toner left on the photoconductors 1 after the primary transfer is removed by photoconductor cleaning units 8 for cleaning the surfaces of the photoconductors 1 for the next image formation. Toner left on the intermediate transfer member 4 after the secondary transfer is removed by an intermediate transfer member cleaning unit 9 for cleaning the surface of the intermediate transfer member 4 for the next image forming.

Figure 3:
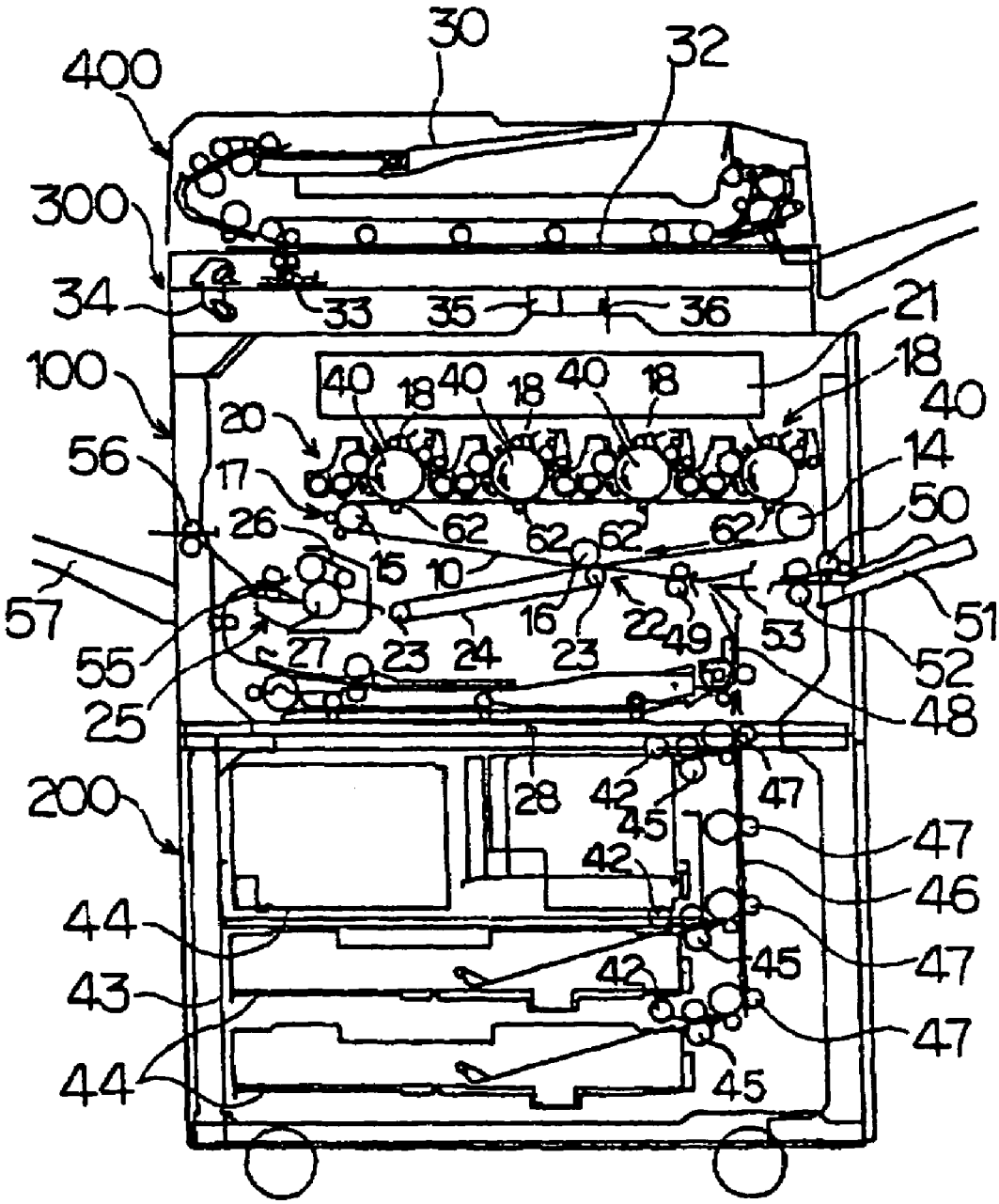
FIG. 3 is a view for explaining a tandem indirect transfer type color image forming apparatus.

FIG. 3 illustrates a tandem indirect transfer type color image forming apparatus. In FIG. 3, designated as 100 is a copying machine main body, as 200 is a sheet supply table on which the copying machine main body 100 is mounted, as 300 is a scanner mounted on the copying machine main body 100, as 400 is an automatic draft feeder (ADF) mounted on the scanner 300.

The copying machine main body 100 has an endless belt type intermediate transfer member 10 in a center part thereof. As shown in FIG. 3, the intermediate transfer member 10 is trained over first, second and third support rollers 14, 15 and 16 so as to be able to rotationally transport a sheet in a clockwise direction as seen in FIG. 3. In the illustrated example, an intermediate transfer member cleaning unit 17 is provided on the left side of the second support roller 15 for removing residual toner left on the intermediate transfer member 10 after transfer of an image.

Above a part of the intermediate transfer member 10 extending between the support rollers 14 and 15, four image forming means 18 for forming black, yellow, magenta and cyan images, respectively, are disposed in a row along the transporting direction of the intermediate transfer member 10, thereby constituting a tandem image forming unit 20. Above the tandem image forming unit 20 is provided an exposure unit 21 as shown in FIG. 3.

On the other side of the tandem image forming unit 20 with respect to the intermediate transfer member 10 is disposed a secondary transfer unit 22 for transferring an image on the intermediate transfer member 10 onto a sheet. The secondary transfer unit 22 comprises two rollers 23 and an endless secondary transfer belt 24 trained between the rollers 23 and disposed in pressure contact with the third support roller 16 with the intermediate transfer member 10 interposed therebetween.

A fixing unit 25 for fixing an image transferred onto a sheet is disposed on one side of the secondary transfer unit 22. The fixing unit 25 comprises an endless fixing belt 26 and a pressure roller 27 disposed in pressure contact with the fixing belt 26.

The secondary transfer unit 22 also has a function of transporting a sheet on which an image has been transferred to the fixing unit 25. As the secondary transfer unit 22, a transfer roller or non-contact charger may be provided. In such a case, it is difficult for the secondary transfer unit 22 to have the sheet transporting function.

In the illustrated example, a sheet reversing unit 28 for reversing a sheet for double-sided copying is disposed below the secondary transfer unit 22 and the fixing unit 25 and in parallel to the tandem image forming unit 20.

When a copy is produced with the color image forming apparatus, a draft is placed on a draft table 30 of the automatic draft feeder 400, or the automatic draft feeder 400 is opened and a draft is placed on a contact glass 32 of the scanner 300 and the automatic draft feeder 400 is closed to hold the draft therewith.

When a start switch (not shown) is pressed, the scanner 300 is actuated to drive a first running body 33 and a second running body 34 after the draft has been transferred onto the contact glass 32 in the case where the draft was placed on the automatic draft feeder 400, or immediately in the case where the draft is placed on a contact glass 32. The first running body 33 emits light from a light source thereof to the draft surface. Light reflected on the draft surface is reflected by the first running body 33 to the second running body 34, reflected on a mirror thereof and inputted into a read sensor 36 through an image forming lens 35, whereby the draft is read.

When the start switch (not shown) is pressed, one of the rollers 14, 15 and 16 is rotated by a driving motor (not shown). Thereby, the other two rollers are driven to rotate the intermediate transfer member 10. At the same time, photoconductors 40 of the image forming means 18 are rotated and single color images, namely, black, yellow, magenta and cyan images are formed on each of the photoconductors 40. Along with the rotation of the intermediate transfer member 10, the single color images are sequentially transferred thereonto and superimposed thereon to form a color image.

At the same time, one of sheet supply rollers 42 in the sheet supply table 200 is selected and driven to feed out sheets from one of sheet supply cassettes arranged in a multistage form in a paper bank 43. The sheets are separated one by one by a separation roller 45. The separated sheet is fed into a sheet supply passage 46, transferred by a transport roller 47 through a sheet supply passage 48 in the copying machine main body 100 until coming into contact with a resist roller 49. Or, a sheet supply roller 50 is rotated to feed sheets on a manual feeding tray 51 into the copying machine main body 100. The sheets are separated one by one by a separation roller 52. The separated sheet is fed through a manual feeding passage 53 until coming into contact with a resist roller 49.

Then, the resist roller 49 is rotated in synchronization with the superimposed color image on the intermediate transfer member 10, and the sheet is fed between the intermediate transfer member 10 and the secondary transfer unit 22, whereby the superimposed color image is transferred onto the sheet by the secondary transfer unit 22.

The sheet on which the image has been transferred is transported by the secondary transfer unit 22 to the fixing unit 25, where the transferred image is fixed by applying heat and pressure thereon. Then, the sheet is discharged by a discharge roller 56 and stacked on a discharge tray 57 or fed into the sheet reversing unit 28. The transporting directions are switched by a switching claw 55. The sheet fed into the sheet reversing unit 28 is reversed therein, introduced to the transfer position again, where an image is also formed on the reverse side of the sheet. Then, the sheet is discharged onto the discharge tray 57 by the discharge roller 56

After transfer of the image, residual toner left on the intermediate transfer member 10 is removed by the intermediate transfer member cleaning unit 17 for the next image formation by the tandem image forming unit 20.

The resist roller 49 is usually earthed but may be applied with a bias to remove paper powder on sheets. In an intermediate transfer system, paper powder is not likely to be transported to photoconductors and thus does not have to be taken into consideration. Thus, the resist roller 49 may not be earthed. As the applied voltage, a DC bias is applied, but it may be an AC voltage having a DC offset component to electrify the sheet more uniformly.

The surfaces of the sheet having been passed on the resist roller 49 applied with bias is slightly negatively charged. Thus, the conditions in transferring of an image from the intermediate transfer member 10 to a sheet must be changed from those in the case where no voltage is applied to the resist roller 49.

Figure 4:
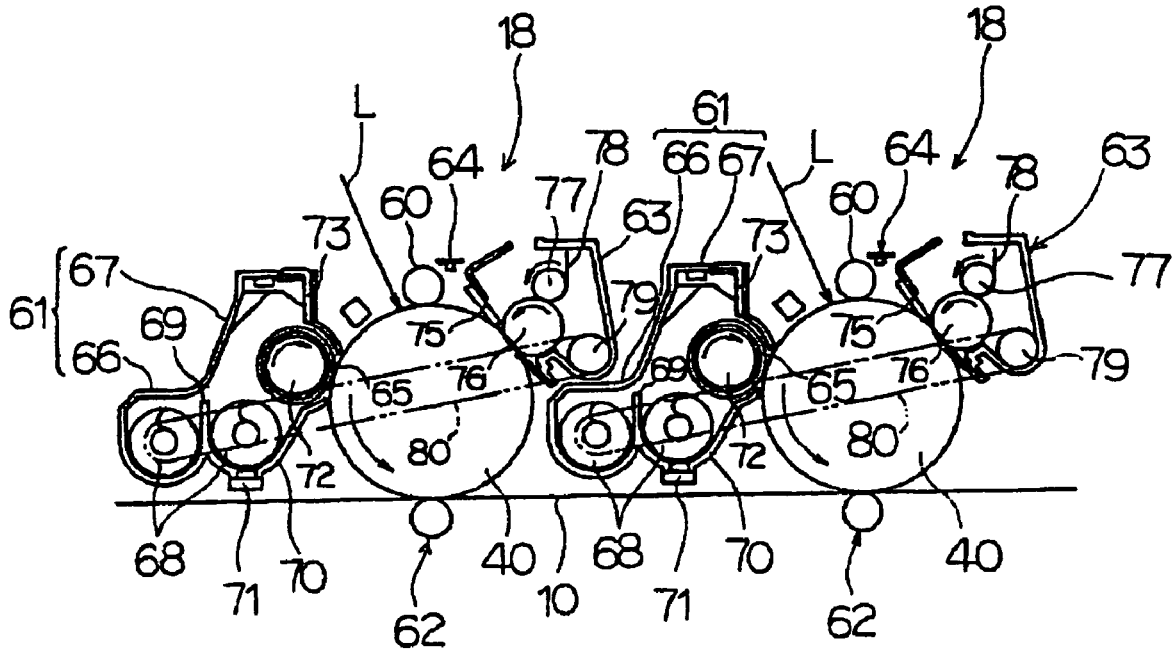
FIG. 4 is a view for explaining image forming means.

In the above tandem image forming apparatus 20, each of the image forming means 18 comprises, as shown in FIG. 4, the drum shaped photoconductor 40, and a charging unit 60, a fixing unit 61, a primary transfer unit 62, a photoconductor cleaning unit 63, a discharge unit 64 and so on, which are provided around the photoconductor 40.

Although not shown, a process cartridge which comprises a part or all of the members constituting the image forming means 18 including the photoconductor 40 and which is detachable from the copying machine main body 100 as a unit assembly may be formed to facilitate the maintenance.

The charging unit 60 of the image forming means 18, which is in the form of a roller in contact with the photoconductor 4 in the illustrated example, applies a voltage to the photoconductor 40 to charge it. The charging may be conducted by a non-contact scorotron charger.

The developing unit 61 may use a one-component developer, but uses a two-component developer comprising a magnetic carrier and a non-magnetic toner in the illustrated example. The developing unit 61 comprises a stirring section 66 for-transporting the two-component developer with stirring to a developing sleeve 65, and a developing section 67 for transferring toner in the two-component developer on the developing sleeve 65 to the photoconductor 40. The stirring section 66 is located in a lower position than the developing section 67. The stirring section 66 is provided with two parallel screws 68. The space between the two screws 68 are partitioned by a partition 69 except the both end parts (see FIG. 7). A toner density sensor 71 is attached to a developing case 70. In the developing section 67, the developing sleeve 65 is opposed to the photoconductor 40 through an opening of the developing case 70, and magnets 72 is fixed in the developing sleeve 65. A doctor blade 73 is provided on the developing sleeve 65 with its end close to the photoconductor 40. The two screws 68 stir and circulate the two-component developer and supplies it to the developing sleeve 65. The developer supplied to the developing sleeve 65 is attracted and held by the magnets 72 and forms a magnetic brush on the developing sleeve 65. With rotation of the developing sleeve 65, the magnetic brush is cut to a suitable size by the doctor blade 73. The developer cut off the magnetic brush is returned to the stirring section 66.

Toner in the developer on the developing sleeve 65 is transferred onto the photoconductor 40 by a developing bias voltage applied to the developing sleeve 65 to develop an electrostatic latent image on the photoconductor 40 into a visible image. After that, the developer left on the developing sleeve 65 is separated therefrom in a place where the magnetic force of the magnets 72 does not exist, and returned to the stirring section 66. When the toner content in the developer in the stirring section 66 is decreased with repetition of this process, the toner sensor 71 detects that and toner is supplied to the stirring section 66.

The primary transfer unit 62 is in the form of a roller and disposed in pressure contact with the photoconductor 40 with the intermediate transfer member 10 interposed therebetween. The primary transfer unit 62 may be in the form of a conductive brush, a non-contact corona charger, or the like.

The photoconductor cleaning unit 63 has a cleaning blade 75 of, for example, urethane rubber provided with its tip in pressure contact with the photoconductor 40. The photoconductor cleaning unit 63 also has a contact brush in contact with the outer periphery of the photoconductor 40 to enhance the cleaning properties. In FIG. 4, a conductive fur brush 76 is provided in contact with the photoconductor 40 for rotation in the direction of the arrow. A metal electric field roller 77 for applying a bias to the fur brush 76 is provided for rotation in the direction of the arrow, and a tip of a scraper 78 is in pressure contact with the electric field roller 77. Also, a recovering screw 79 for recovering removed toner is provided.

The fur brush 76, which is rotated in a counter direction of rotation of the photoconductor 40, removes residual toner on the photoconductor 40. The toner having adhered to the fur brush 76 is removed by the biased electric field roller 77, which is rotated in contact with the fur brush 76 in a counter direction of rotation of the fur brush 76. The toner having adhered to the electric field roller 77 is cleaned off by the scraper 78. Toner recovered by the photoconductor cleaning unit 63 is put to one side in the cleaning unit 63 by the recovering screw 79 and returned to the developing unit 61 by a toner recycling unit 80, which will be described later in detail, and reused.

A quenching unit 64 comprises a lamp, for example, which emits light to initialize the surface potential of the photoconductor 40. With the rotation of the photoconductor 40, the surface of the photoconductor 40 is uniformly charged by the charging unit 60. Then, the exposure unit 21 irradiates writing light L emitted from a laser or an LED according to the information read by the scanner 300 to form an electrostatic latent image on the photoconductor 40.

After that, toner is stuck to develop the electrostatic latent image into a visible image by the developing unit 61, and the visible image is transferred onto the intermediate transfer member 10 by the primary transfer unit 62. After the transfer of the image, the cleaning unit 40 removes toner left on the surface of the photoconductor 40 and the quenching unit 64 discharge the photoconductor 40 for the next image formation.

Figure 5:
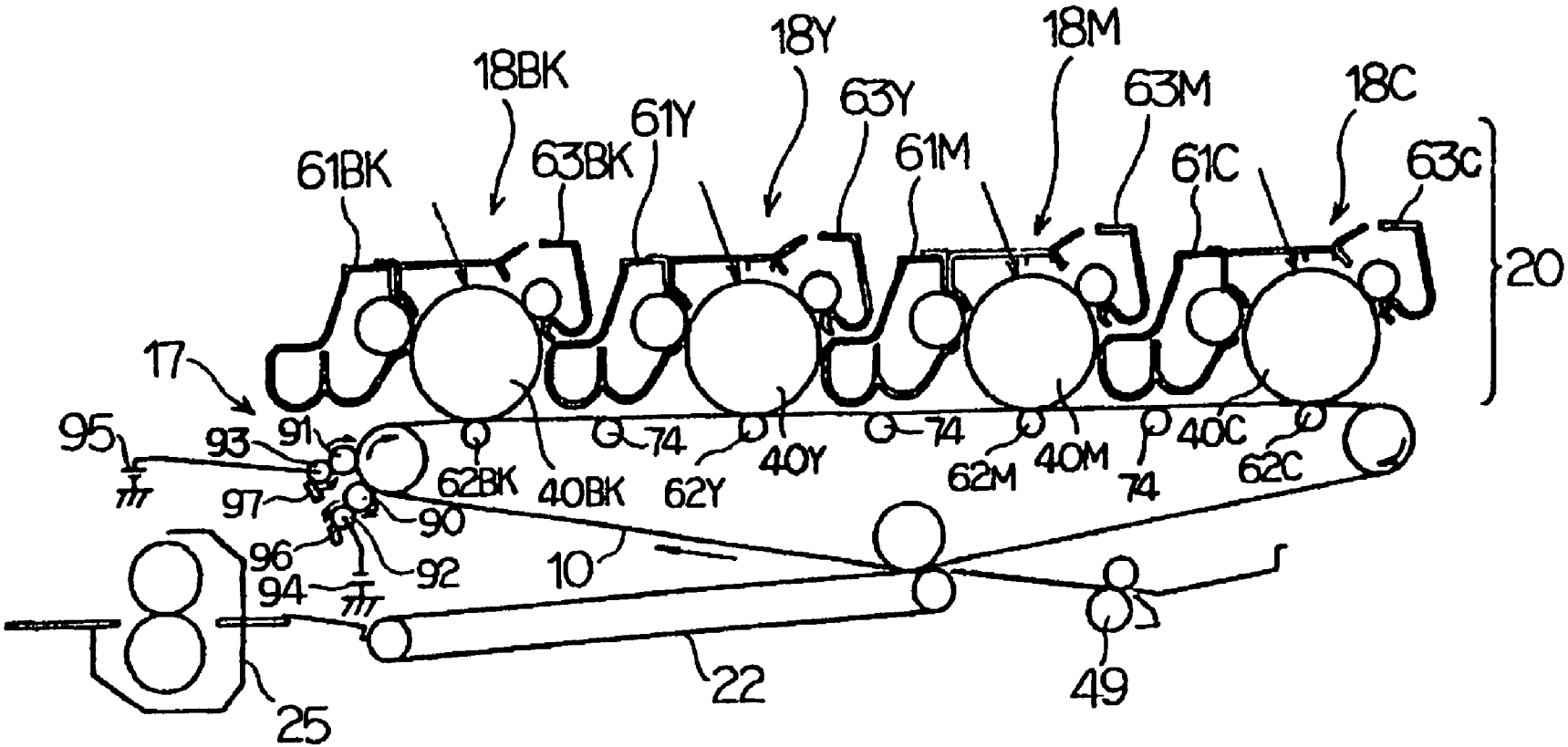
FIG. 5 is an enlarged view of an essential part of the image forming apparatus shown in FIG. 3.

FIG. 5 is an enlarged view of an essential part of the color image-forming apparatus shown in FIG. 3. The "BK", "Y", "M" and "C" suffixes on each of the image forming means 18 of the tandem image forming unit 20, the photoconductor 40, the developing unit 61, and the photoconductor cleaning unit 63 of each of the image forming units 18, and the primary transfer units 62 provided opposed to the photoconductors 40 of the image forming units 18 represents black, yellow, magenta and cyan, respectively.

In FIG. 5, designated as 74 is a conductive roller provided between adjacent primary transfer units 62 and in contact with a base layer side 11 of the intermediate transfer member 10, which is not shown in FIG. 3 and FIG. 4. The conductive rollers 74 prevent the biases applied by the primary transfer units 62 at the time of transfer from flowing into an adjacent image forming means 18 through the base layer 11 having a medium resistance.

Figure 6:
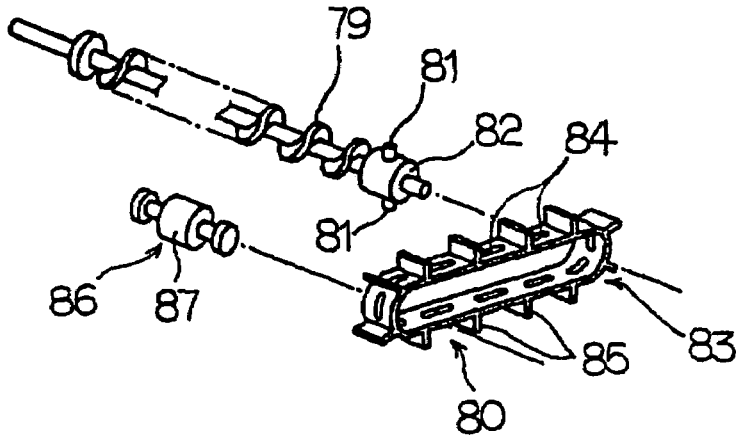
FIG. 6 is a view of a toner recycling unit.
Figure 7:
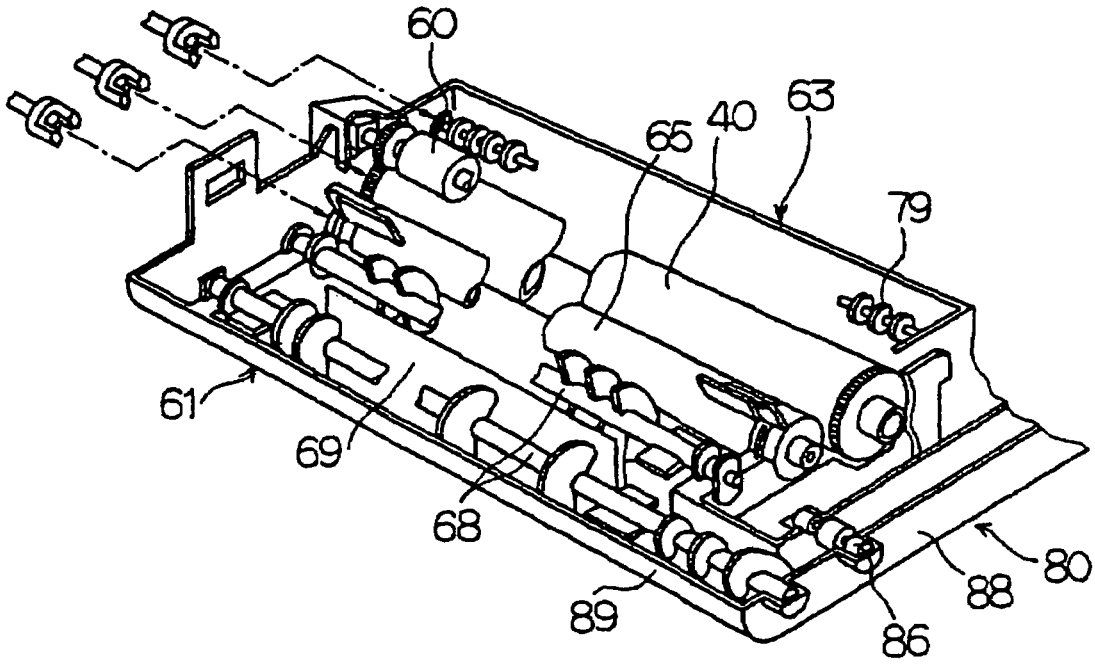
FIG. 7 is a view of a toner recycling unit.

FIG. 6 and FIG. 7 show a toner recycling unit 80. As shown in FIG. 4, the recovery screw 79 of the photoconductor cleaning unit 63 has a roller part 82 having a pin 81 at one end. One side of a belt-like recovered toner carrying member 83 of the toner recycling unit 80 is trained around the roller part 82, and the pin 81 is received in a long hole 84 of the recovered toner carrying member 83. The recovered toner carrying member 83 has an outer periphery on which blades 85 are provided at spaced intervals. The other side of the recovered toner carrying member 83 is trained around a roller part 87 of a rotary shaft 86.

The recovered toner carrying member 83 is housed in a carrying path case 88 together with the rotary shaft 86 as shown in FIG. 7. The carrying path case 88 is formed integrally with a cartridge case 89 and has a developing unit 61 side end part in which one of the two screws 68 of the developing unit 61 is located.

The recovery screw 79 is rotated by a driving force transmitted from outside and the recovered toner carrying member 83 is rotated to carry toner recovered by the photoconductor cleaning unit 63 through the carrying path case 88 to the developing unit 61. The toner is put into the developing unit by rotation of the screw 68. Then, as mentioned before, the toner is stirred and circulated together with the carrier in the developing unit 61, supplied to the developing sleeve 65, cut by the doctor blade 73, and transferred onto the photoconductor 40 to develop a latent image thereon.

The developing sleeve 65 is a non-magnetic, rotatable sleeve-shaped member and has a plurality of magnets 72 therein. The magnets 72 are fixed so as to be able to apply magnetic forces to developer when it is passing a specific point. In the illustrated example, the developing sleeve 65 has a diameter of 18 mm, and has a surface sandblasted or in which a plurality of grooves having a depth of 1 to several millimeters are formed so as to have an RZ in the range of 10 to 30 μm.

The magnets 72 have polarities of $N_1$, $S_1$, $N_2$, $S_2$ and $S_3$, for example, from the point of the doctor blade 73 in the rotating direction of the developing sleeve 65.

The developer is formed into a magnetic brush by the magnets 72 and held on the developing sleeve 65. The developing sleeve 65 is opposed to the photoconductor 40 in a region on the S1 side of the magnets 72.

In the illustrated example, the intermediate transfer member cleaning unit 17 has two fur brushes 90 and 91 as cleaning members as shown in FIG. 5. To the fur brushes 90 and 91, biases having different polarities are respectively applied from power sources (not shown).

Metal rollers 92 and 93 are provided in contact with the fur brush 90 and 91, respectively, for rotation in the same or opposite direction as the fur brush 91 and 92. In this example, a negative voltage is applied to the metal roller 92, which is located on the upstream side in the rotating direction of the intermediate transfer member 10, from a power source 94, and a positive voltage is applied to the downstream metal roller 93 from a power source 95. Tips of the blades 96 and 97 are in pressure contact with the metal rollers 92 and 93, respectively.

With rotation of the intermediate transfer member 10 in the direction of the arrow, a negative bias is applied to the intermediate transfer member 10 from the upstream fur brush 90 to perform cleaning of the surface of the intermediate transfer member 10. When a voltage of −700 V, for example, is applied to the metal roller 92, the fur brush 90 has a voltage of −400 V and positive toner on the intermediate transfer member 10 is moved onto the fur brush 90. The thus removed toner is moved from the fur brush 92 to the metal roller 92 by the potential difference, and then scraped off the metal roller 92 by the blade 96.

After the removal of the toner on the intermediate transfer member 10 with the fur brush 90, there still remains a large amount of toner on the intermediate transfer member 10. The toner has been negatively charged by the negative bias applied to the fur brush 90. This is thought to be by a charge injection or a discharge.

Then, a positive bias is applied to the intermediate transfer body 10 from the downstream fur brush 91 to remove the residual toner therewith. The removed toner is moved from the fur brush 91 to the metal roller 93 by a potential difference and scraped off the metal roller 93 by the blade 97.

The toner scraped off by the blades 96 and 97 is recovered into a tank (not shown).

Although almost of all toner is removed by the above cleaning processes, there still remains a small amount of toner on the intermediate transfer member 10. The residual toner has been positively charged by the bias applied to the fur brush 91. The positively charged toner is moved to the photoconductor 40 by a transfer bias applied thereto at the primary transfer position and recovered by the photoconductor cleaning unit 63.

The order in which the images of each color are formed is not specifically limited. It depends on the purpose and the properties of the image forming apparatus.

As the belt (intermediate transfer belt) for use as the intermediate transfer member 10, a belt made of a fluororesin, polycarbonate resin or polyimide resin has been conventionally used. In recent years, an elastic belt having layers all or part of which are composed of an elastic material is spreading.

Transfer of a color image using a resin belt has the following problem.

A color image is generally formed of four color toners. In one color image, first to fourth toner layers are formed. Since the toner layers receive pressure through a primary transfer (transfer from a photoconductor to the intermediate transfer belt) and a secondary transfer (transfer from the intermediate transfer belt to a sheet), the aggregation force among toner particles is increased. When the aggregation force among toner particles is high, white voids are likely to occur in letters and an edge of a solid area. A resin belt, which has high hardness and is not deformed according to toner layers, tends to compress toner layers and thus is likely to cause white voids. In recent years, a demand for printing on various types of paper such as a Japanese paper and a paper embossed on purpose is increasing. However, a paper of low smoothness is apt to have a gap between itself and the toner layers, so that an image printed thereon is likely to have a transfer void. When a transfer pressure in the secondary transfer process is increased to enhance the adhesion of toner to the paper, the aggregation force among toner particles is increased, causing voids in letters as above.

Thus, an elastic belt is suitable for the intermediate transfer belt.

An elastic belt has lower hardness than a resin belt and thus is deformed according to toner layers and a paper of low smoothness in a transfer unit. Namely, the elastic belt is deformed following regional irregularity and enhances the adhesion of toners even when the transfer pressure onto the toner layers is not unnecessarily increased. Thus, an image with high uniformity and free from white voids can be produced even on a paper of low smoothness. Thus, in the present invention, the intermediate transfer member is preferably a seamless elastic belt having layers all or part of which are composed of an elastic material. More preferably, the elastic belt comprises a resin layer, an elastic layer and a surface layer laminated in sequence.

Specific examples of the resin for use in the resin layer include but are not limited to polycarbonate; fluororesins (ETFE, PVDF); styrene resins (homopolymers and copolymers containing styrene or a styrene homologue) such as polystyrene, chloropolystyrene, poly-α-methylstyrene, styrene-butadiene copolymers, styrene-vinyl chloride copolymers, styrene-vinyl acetate copolymers, styrene-maleic acid copolymers, styrene-acrylic ester copolymers (such as styrene-methyl acrylate copolymers, styrene-ethyl acrylate copolymers, styrene-butyl acrylate copolymers, styrene-octyl acrylate copolymers, aand styrene-phenyl acrylate copolymers), styrene-methacrylic ester copolymers (such as styrene-methyl methacrylate copolymers, styrene-ethyl methacrylate copolymers, styrene-phenyl methacrylate copolymers), styrene-α-methyl chloroacrylate copolymers, and styrene-acrylonitrile-acrylic ester copolymers; methyl methacrylate resins; butyl methacrylate resins; ethyl acrylate resins; butyl acrylate resins; modified acrylic resins (such as silicone-modified acrylic resins, vinyl chloride resins modified acrylic resins, acrylic-urethane resins); vinyl chloride resins, styrene-vinyl acetate copolymers, vinyl chloride-vinyl acetate copolymers, rosin-modified maleic acid resins, phenol resins, epoxy resins, polyester resins, polyester polyurethane resins, polyethylene, polypropylene, polybutadiene, polyvinylidene chloride, ionomer resins, polyurethane resins, silicone resins, ketone resins, ethylene-ethyl acrylate copolymers, xylene resins, polyvinyl butyral resins, polyamide resins, and modified polyphenylene oxide resins. The resins may be used alone or in combination.

Specific examples of the rubber and elastomer as the elastic material for use in the elastic layer include but are not limited to butyl rubber, fluoro rubbers, acrylic rubbers, EPDM, NBR, acrylonitrile-butadiene-styrene rubber natural rubber, isoprene rubber, styrene-butadiene rubber, butadiene rubber, ethylene-propylene rubber, ethylene-propylene terpolymers, chloroprene rubber, chlorosulfonated polyethylene, chlorinated polyethylene, urethane rubbers, syndiotactic 1,2-polybutadiene, epichlorohydrin rubbers, silicone rubbers, fluororubbers, polysulfide rubbers, polynorbornene rubber, hydrogenated nitrile rubber, and thermoplastic elastomers (such as polystyrene elastomers, polyolefin elastomers, polyvinyl chloride elastomers, polyurethane elastomers, polyamide elastomers, polyurea, polyester elastomers and fluororesin elastomers). The rubbers and the elastomers may be used alone or in combination.

A resistance adjusting conductive material, which may be added to the elastic belt as necessary, is not specifically limited. Specific examples of the resistance adjusting conductive material include but are not limited to carbon black, graphite, a powder of a metal such as aluminum or nickel, and conductive metal oxides such as tin oxide, titanium oxide, antimony oxide, indium oxide, potassium titanate, antimony-tin double oxide (ATO) and indium-tin double oxide (ITO). The conductive metal oxide may be coated with non-conductive fine particles such as barium sulfate fine particles, magnesium silicate fine particles and calcium carbonate fine particles.

The material for forming the surface layer of the elastic belt is not specifically limited as long as it reduces adhesion of the toner to the surface of the intermediate transfer belt to enhance secondary transferability thereof. For example, the surface layer may be composed of a resin such as a polyurethane resin, polyester resin or epoxy resin or a mixture thereof in which a powder or particles, or a mixture of powders or particles with different diameter, of a material which reduces surface energy and enhances lubricity such as fluororesins, fluorine compounds, carbon fluoride, titanium dioxide and silicon carbide or a mixture thereof are dispersed.

A fluoro rubber on which a fluorine-rich layer is formed by heat treatment to reduce surface energy may be also used.

The method of producing the elastic belt is not specifically limited.

Specific examples of the belt producing method include and are not limited to a centrifugal molding method in which the material is poured into a rotating cylindrical mold, a spray coating method in which a thin film is formed on a surface of a mold, a dipping method in which a cylindrical mold is immersed in a material solution and drawn up, an injection molding method in which the material is pored between inner and outer molds, and a method in which a surface of a compound wound on a cylindrical mold is vulcanized and polished. The methods may be combined.

One method of preventing elongation of the elastic belt is to provide a core layer with low elongation containing a material for preventing elongation of the elastic belt. Specific examples of the material for use in the core layer include but are not limited to natural fibers such as cotton, silk; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, phenol fibers; inorganic fibers such as carbon fibers, glass fibers, boron fibers; and metal fibers such as iron fibers and copper fibers. The materials may be used in the form of a woven fabric or threads and used in alone or in combination.

The thread may be of one filament or a strand of filaments, or may be a single twisted yarn, plied yarn or two-ply yarn. A plurality of types of the above fibers may be mixed. The strand threads may be subjected to suitable conductive treatment.

The woven fabric may be woven by any method such as by knitting, and a union fabric can be also used. The woven fabric may be subjected to conductive treatment. The method for providing a core layer is not specifically limited. Specific examples of the method for providing the core layer include a method in which a cover layer is formed on a fabric woven into a cylindrical shape and laid on a mold or the like, a method in which a woven fabric woven into a cylindrical shape is immersed in a liquid rubber or the like to form a cover layer on one or both sides thereof, and a method in which a coating layer is formed on a thread helically wound on a mold or the like at a given pitch.

When the thickness of the elastic layer is excessively large (about 1 mm or larger), the surface thereof expands or contracts largely and generates cracks or causes deformation of a printed image, although it depends on the hardness thereof.

The elastic layer preferably has a hardness in a range of 10 to 65° (JIS-A), although the hardness must be adjusted according to the thickness of the belt. A belt having a JIS-A hardness of less than 10° is very difficult to form with dimensional accuracy. This is because the belt is likely to be subjected to contract or expansion at the time of formation. In order to soften a belt, an oil component is frequently added in the support thereof. However, when the belt is continuously used under pressure, the oil component bleeds out and contaminates the photoconductor in contact with the surface of the intermediate transfer member, causing streaks in a lateral direction in a printed image. In general, an intermediate transfer belt is provided with a surface layer to improve releasing property thereof. In order to prevent the oil component from bleeding out completely, the surface layer is required to be excellent in quality, in durability, for example, so that it is difficult to obtain a material having required properties. On the other hand, an elastic layer having a JIS-A hardness of at least 65° has sufficient hardness and thus can be formed with accuracy. Also, the elastic layer can be formed with a small amount of oil component or without an oil component, so that the contamination of the photoconductor by the oil can be reduced. However, the elastic layer cannot provide an effect of improving toner transferability and makes it difficult to train the resulting intermediate transfer belt over rollers.

Figure 8:
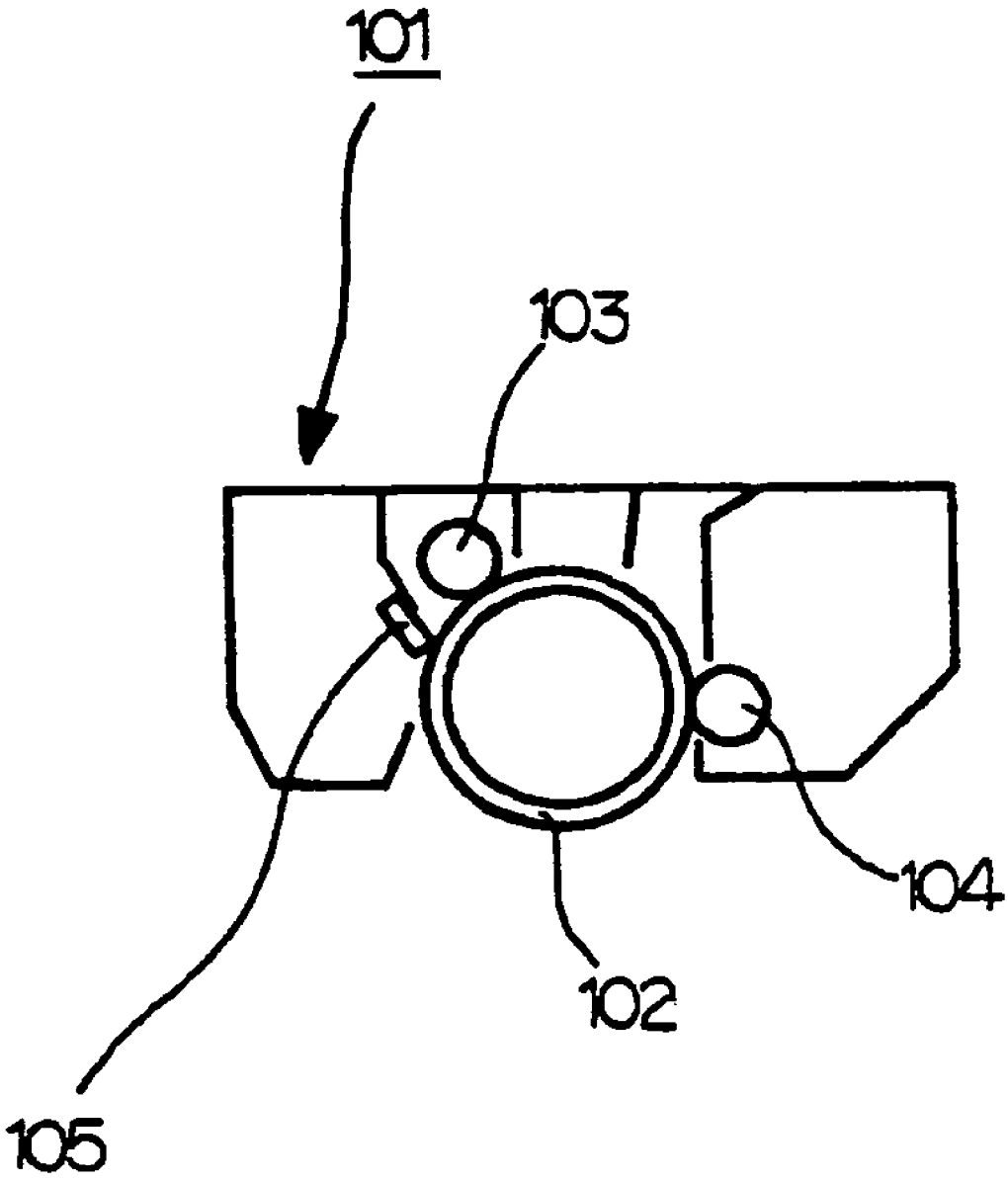
FIG. 8 is a cross-sectional view schematically illustrating a process cartridge of the present invention.

A process cartridge is a single part or device which has the photoconductor and at least one unit selected from a charger, an image exposing device, a developing device, an image transferring device and a cleaning device and which is detachably mounted on an image forming apparatus. One example of such a process cartridge is illustrated in FIG. 8 and is generally indicated as 101. The process cartridge 101 in this embodiment includes a photoconductor 102 according to the present invention in the form of a drum having an electroconductive support, an undercoat layer and a photoconductive layer. Disposed around the photoconductor 102 are a charger 103, a development device 104 and a cleaning blade 105. The operation of these units for the formation of an image is the same as already described above.

The following examples and comparative examples will further illustrate the present invention. Parts are by weight.

EXAMPLE 1

150 Parts of an alkyd resin (Beckozol 1307-60EL, made by Dainippon Ink & Chemicals, Inc.) and 100 parts of a melamine resin (Super Beckamine G-821-60, made by Dainippon Ink & Chemicals, Inc., solid content: 60% by weight) were dissolved in 500 parts of methyl ethyl ketone, in which 3.0 parts of dibenzo-18-crown-6 ether were further dissolved. To the solution were added 600 parts of a titanium oxide powder (TA-300 made by Fuji Titanium Industry Co., Ltd., non-surface treated product). The mixture was dispersed in a ball mill containing alumina balls for 24 hours to prepare a coating liquid for an undercoat layer. The coating liquid was then applied to an aluminum drum having-a diameter of 30 mm and a length of 340 mm and the coating was dried at 130° C. for 20 minutes to form an undercoat layer having a thickness of 5.0 μm thereon.

5 Parts of a butyral resin (S-LEC BMS, made by Sekisui Chemical Co., Ltd.) were dissolved in 150 parts of cyclohexanone, to which 15 parts of a charge generating material having a structure represented by the formula (CG-1) shown below were milled in a ball mill containing alumina balls for 72 hours. The ball milling was further continued for 5 hours after addition of 210 parts of cyclohexanone. The milled mixture was diluted with cyclohexanone with stirring until a solid content of 1.0% by weight was reached to obtain a coating liquid for forming a charge generating layer. The thus obtained coating liquid was applied to the aluminum drum on which the undercoat layer had been formed. The coating was dried at 120° C. for 10 minutes to form a charge generating layer having a thickness of about 0.2 μm.

(CG-1)

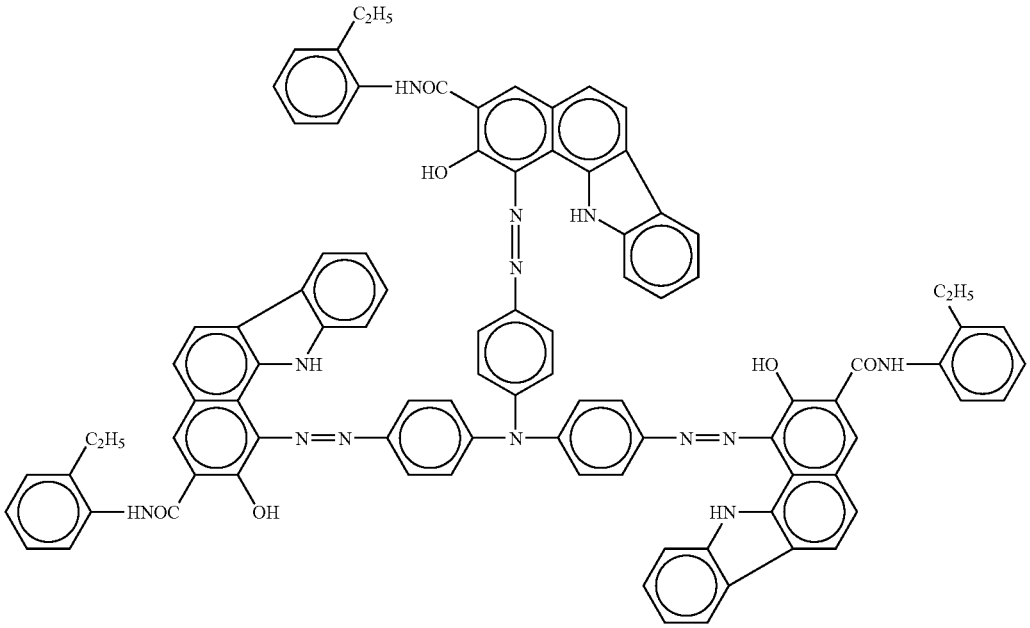

80 Parts of a charge transporting material having a structure represented by the structural formula (CT-2) shown below, 100 parts of a polycarbonate resin (Panlite TS2050, made by Teijin Chemicals, Ltd.) and 0.02 part of a silicone oil (KF-50, made by Shin-Etsu Chemical Co., Ltd.) were dissolved in 770 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 28 μm, thereby obtaining an electrophotographic photoconductor.

(CT-2)

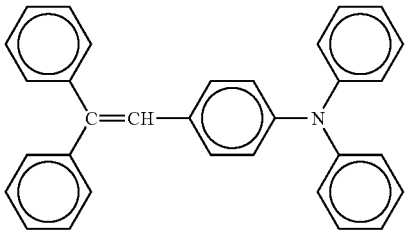

EXAMPLE 2

Example 1 was repeated in the same manner as described except that zinc sulfide powder (manufactured by Shimakyu Pharmaceutical Inc.) was substituted for the titanium oxide, thereby obtaining an electrophotographic photoconductor.

EXAMPLE 3

Example 1 was repeated in the same manner as described except that alumina-treated titanium oxide (CR-60 manufactured by Ishihara Sangyo Co., Ltd.) was substituted for the titanium oxide, thereby obtaining an electrophotographic photoconductor.

EXAMPLE 4

Example 1 was repeated in the same manner as described except that 1,3-dioxorane was substituted for the tetrahydrofuran for the formation of the coating liquid for a charge transporting layer, thereby obtaining an electrophotographic photoconductor.

EXAMPLE 5

Example 1 was repeated in the same manner as described except that xylene was substituted for the tetrahydrofuran for the formation of the coating liquid for a charge transporting layer, thereby obtaining an electrophotographic photoconductor.

EXAMPLE 6

Example 1 was repeated in the same manner as described except that toluene was substituted for the tetrahydrofuran for the formation of a coating liquid for a charge transporting layer, thereby obtaining an electrophotographic photoconductor.

EXAMPLE 7

Example 1 was repeated in the same manner as described except that the thickness of the undercoat layer was reduced to 1.5 μm, thereby obtaining an electrophotographic photoconductor.

EXAMPLE 8

Example 1 was repeated in the same manner as described except that the thickness of the charge transporting layer was reduced to 20 μm, thereby obtaining an electrophotographic photoconductor.

COMPARATIVE EXAMPLE 1

Example 1 was repeated in the same manner as described except that dibenzo-18-crown-6 ether was not used at all, thereby obtaining an electrophotographic photoconductor.

COMPARATIVE EXAMPLE 2

Example 1 was repeated in the same manner as described except that dichloromethane was substituted for the tetrahydrofuran for the formation of a coating liquid for a charge transporting layer, thereby obtaining an electrophotographic photoconductor.

COMPARATIVE EXAMPLE 3

Example 1 was repeated in the same manner as described except that dichloromethane was substituted for the cyclohexanone as a diluting solvent for the formation of a coating liquid for a charge generating layer, thereby obtaining an electrophotographic photoconductor.

Each of the photoconductors obtained in Examples 1-8 and Comparative Examples 1-3 was incorporated in a laser printer (SP-90 made by Ricoh Company, Ltd.) equipped with a non-contact type corona charging device, a laser image exposing device, a reverse development device and a transfer device. Solid and halftone images were repeatedly produced at a dark area potential of −800 V and a reverse development bias of −600V to obtain 100,000 prints in three different conditions of (a) ordinary environment (20° C., 50% relative humidity), low temperature and low humidity environment (12° C., 15% relative humidity) and high temperature and high humidity environment (32° C., 85 relative humidity). The results of the valuation of the initial image and the image of the 100,000th print are summarized in Table 1. In the Tables shown below, hyphen (-) means that evaluation was no longer carried out.

Evaluation of image in the present and following Examples and Comparative Examples was rated as follows:

A: Excellent

B1: Good. Slight non-uniformity in halftone image density was observed. No problem in actual use.

B2: Good. Slight background stain was observed. No problem in actual use.

B3: Good. Slight reduction in image density was observed. No problem in actual use.

C1: Good. Slight non-uniformity in halftone image density and slight reduction in image density were observed. No problem in actual use.

D: No good. Significant non-uniformity in halftone image.

TABLE 1

| | Initial Image | | | Image of 100,000th print | | |
|---|---|---|---|---|---|---|
| Example | 20° C./ 50% RH | 12° C./ 15% RH | 32° C./ 85% RH | 20° C./ 50% RH | 12° C./ 15% RH | 32° C./ 85% RH |
| 1 | B1 | B1 | B1 | A | A | A |
| 2 | A | A | A | B1 | C1 | C1 |
| 3 | A | A | A | A | B3 | B3 |
| 4 | A | A | A | A | A | A |
| 5 | A | A | A | A | A | A |

TABLE 1-continued

| | Initial Image | | | Image of 100,000th print | | |
|---|---|---|---|---|---|---|
| Example | 20° C./ 50% RH | 12° C./ 15% RH | 32° C./ 85% RH | 20° C./ 50% RH | 12° C./ 15% RH | 32° C./ 85% RH |
| 6 | A | A | A | A | A | A |
| 7 | A | A | A | B2 | B2 | B2 |
| 8 | A | A | A | B2 | B2 | B2 |
| Comp. 1 | D | D | D | — | — | — |
| Comp. 2 | D | D | D | — | — | — |
| Comp. 3 | D | D | D | — | — | — |

As will be appreciated from the results shown in Table 1, the electrophotographic photoconductors according to the present invention gives under good images for a long period of service without depending upon environments under which the images are formed.

EXAMPLE 9

125 Parts of an alkyd resin (Beckozol 1307-60EL, made by Dainippon Ink & Chemicals, Inc.) and 125 parts of a melamine resin (Super Beckamine G-821-60, made by Dainippon Ink & Chemicals, Inc., solid content: 60% by weight) were dissolved in 500 parts of methyl ethyl ketone, in which 10.0 parts of dibenzo-24-crown-8 ether were further dissolved. To the solution were added 570 parts of a titanium oxide powder (CR-EL made by Ishihara Sangyo Co., Ltd., non-surface treated product). The mixture was dispersed in a ball mill containing alumina balls for 30 hours to prepare a coating liquid for an undercoat layer. The coating liquid was then applied to an aluminum drum having a diameter of 30 mm and a length of 340 mm and the coating was dried at 135° C. for 20 minutes to form an undercoat layer having a thickness of 6.0 μm thereon.

18 Parts of A-type titanylphthalocyanin pigment were placed in a glass pot together with zirconia beads having a diameter of 2 mm, to which a solution obtained by dissolving 10 parts of a butyral resin (S-LEC BX, made by Sekisui Chemical Co., Ltd.) in 350 parts of methyl ethyl ketone. The mixture was then milled for 15 hours. The milled mixture was diluted with 600 parts of methyl ethyl ketone to obtain a coating liquid for forming a charge generating layer. The thus obtained coating liquid was applied to the aluminum drum on which the undercoat layer had been formed. The coating was dried at 70° C. for 20 minutes to form a charge generating layer having a thickness of about 0.3 μm.

90 Parts of a charge transporting material having a structure represented by the structural formula (CT-3) shown below, 100 parts of a polycarbonate resin (Panlite L-1250, made by Teijin Chemicals, Ltd.) and 0.02 part of a silicone oil (KF-50, made by Shin-Etsu Chemical Co., Ltd.) were dissolved in 400 parts of 1,3-dioxorane and 350 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 31 μm, thereby obtaining an electrophotographic photoconductor.

(CT-3)

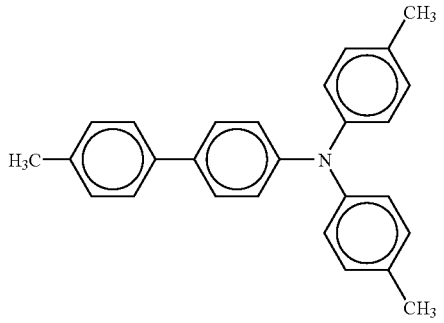

EXAMPLE 10

Example 9 was repeated in the same manner as described except that the thickness of the undercoat layer was reduced to 3 μm, thereby obtaining an electrophotographic photoconductor.

EXAMPLE 11

Example 9 was repeated in the same manner as described except that the thickness of the charge transporting layer was reduced to 25 μm, thereby obtaining an electrophotographic photoconductor.

COMPARATIVE EXAMPLE 4

Example 9 was repeated in the same manner as described except that dibenzo-24-crown-8 ether was not used at all, thereby obtaining an electrophotographic photoconductor.

COMPARATIVE EXAMPLE 5

Example 9 was repeated in the same manner as described except that dichloromethane was substituted for the mixed solvent of 1,3-dioxorane and tetrahydrofuran for the formation of a coating liquid for a charge transporting layer, thereby obtaining an electrophotographic photoconductor.

COMPARATIVE EXAMPLE 6

Example 9 was repeated in the same manner as described except that dichloromethane was substituted for the cyclohexanone as a diluting solvent for the formation of a coating liquid for a charge generating layer, thereby obtaining an electrophotographic photoconductor.

Each of the photoconductors obtained in Examples 9-11 and Comparative Examples 4-6 was incorporated in a digital copying machine (IMAGIO MF2200 made by Ricoh Company, Ltd.) equipped with a contact type roll charging device, an exposing device, a reverse-development device and a transfer device. Solid and halftone images were repeatedly produced at a dark area potential of −600 V and a reverse development bias of −400V in an ordinary environment (20° C., 50% relative humidity) to obtain 150,000 copies. The results of the valuation of the initial image and the image of the 150,000th copy are summarized in Table 2.

TABLE 2

| Example | Initial Image 20° C./50% RH | Image of 150,000th copy 20° C./50% RH |
|---|---|---|
| 9 | A | A |
| 10 | A | B2 |
| 11 | A | B2 |
| Comp. 4 | D | — |
| Comp. 5 | D | — |
| Comp. 6 | D | — |

As will be appreciated from the results shown in Table 2, the electrophotographic photoconductors according to the present invention gives under good images for a long period of service.

EXAMPLE 12

125 Parts of an alkyd resin (Beckozol 1307-60EL, made by Dainippon Ink & Chemicals, Inc.) and 125 parts of a melamine resin (Super Beckamine G-821-60, made by Dainippon Ink & Chemicals, Inc., solid content: 60% by weight) were dissolved in 500 parts of methyl ethyl ketone, in which 10.0 parts of dibenzo-15-crown-5 ether were further dissolved. To the solution were added 570 parts of a titanium oxide powder (CR-EL made by Ishihara Sangyo Co., Ltd., non-surface treated product). The mixture was dispersed in a ball mill containing alumina balls for 30 hours to prepare a coating liquid for an undercoat layer. The coating liquid was then applied to an aluminum drum having a diameter of 30 mm and a length of 340 mm and the coating was dried at 135° C. for 20 minutes to form an undercoat layer having a thickness of 6.0 μm thereon.

60 Parts of a charge generating material represented by the formula CG-4 shown below and 330 parts of methyl ethyl ketone were milled for 200 hours, to which a solution obtained by dissolving 10 parts of a polyvinylbutyral resin (S-LEC BL-1, made by Sekisui Chemical Co., Ltd.) in 400 parts of methyl ethyl ketone and 1,850 parts of cyclohexanone was added. The mixture was then milled for 5 hours to obtain a coating liquid for forming a charge generating layer. The thus obtained coating liquid was applied to the aluminum drum on which the undercoat layer had been formed. The coating was dried at 130° C. for 20 minutes to form a charge generating layer having a thickness of about 0.5 μm.

(CG-4)

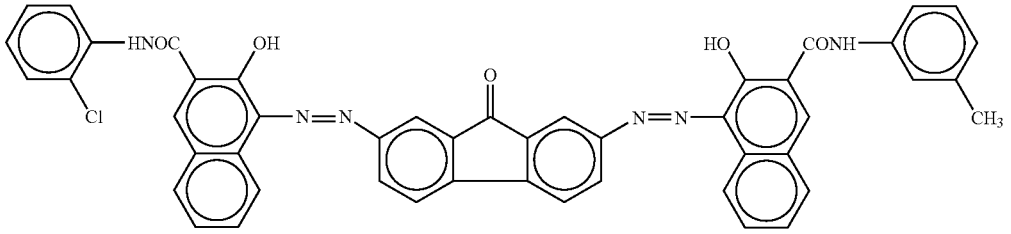

85 Parts of a charge transporting material having a structure represented by the above formula (CT-2), 100 parts of a polycarbonate resin (Panlite L-2050, made by Teijin Chemicals, Ltd.) and 0.02 part of a silicone oil (KF-50, made by Shin-Etsu Chemical Co., Ltd.) were dissolved in 200 parts of 1,3-dioxorane and 550 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 30 μm, thereby obtaining an electrophotographic photoconductor.

EXAMPLE 13

Example 12 was repeated in the same manner as described except that the thickness of the undercoat layer was reduced to 2 μm, thereby obtaining an electrophotographic photoconductor.

EXAMPLE 14

Example 12 was repeated in the same manner as described except that the thickness of the charge transporting layer was reduced to 25 μm, thereby obtaining an electrophotographic photoconductor.

COMPARATIVE EXAMPLE 7

Example 13 was repeated in the same manner as described except that dibenzo-15-crown-5 ether was not used at all and that the thickness of the charge transporting layer was reduced to 25 μm, thereby obtaining an electrophotographic photoconductor.

COMPARATIVE EXAMPLE 8

Example 14 was repeated in the same manner as described except that dibenzo-15-crown-5 ether was not used at all, thereby obtaining an electrophotographic photoconductor.

Each of the photoconductors obtained in Examples 12-14 and Comparative Examples 7 and 8 was incorporated in an image forming machine (IPSiO NX720N made by Ricoh Company, Ltd.) equipped with a contact type roll charging device, an exposing device modified by changing the wavelength of the writing laser beam, a reverse development device and a transfer device. Images were produced at a dark area potential of −950 V and a reverse development bias of −600 V in an ordinary environment (20° C., 50% RH) until the formation of black spots by charge breakdown was observed. The image quality in the initial stage was evaluated and the occurrence of discharge breakdown was checked to give the results shown in Table 3.

TABLE 3

| Example | Initial Image | Charging breakdown |
|---|---|---|
| 12 | A | Not occurred in the 180,000th print |
| 13 | A | Occurred in the 160,000th print |
| 14 | A | Occurred in the 170,000th print |
| Comp. 7 | A | Occurred in the 80,000th print |
| Comp. 8 | D | Occurred in the 100,000th print |

As will be appreciated from the results shown in Table 3, the electrophotographic photoconductors according to the present invention gives under good images for a long period of service and has good durability.

EXAMPLE 15

150 Parts of an alkyd resin (Beckozol 1307-60EL, made by Dainippon Ink & Chemicals, Inc.) and 100 parts of a melamine resin (Super Beckamine G-821-60, made by Dainippon Ink & Chemicals, Inc., solid content: 60% by weight) were dissolved in 500 parts of methyl ethyl ketone, in which 15.0 parts of polyethyleneglycol monoalkyl ether (Emalmine L-380 manufactured by Sanyo Chemical Industries, Ltd.) were further dissolved. To the solution were added 600 parts of a titanium oxide powder (TA-300 made by Fuji Titanium Industry Co., Ltd., non-surface treated product). The mixture was dispersed in a ball mill containing alumina balls for 24 hours to prepare a coating liquid for an undercoat layer. The coating liquid was then applied to an aluminum drum having a diameter of 30 mm and a length of 340 mm and the coating was dried at 130° C. for 20 minutes to form an undercoat layer having a thickness of 5.0 μm thereon.

5 Parts of a butyral resin (S-LEC BMS, made by Sekisui Chemical Co., Ltd.) were dissolved in 150 parts of cyclohexanone, to which 15 parts of a charge generating material represented by the above formula CG-1 were milled in a ball mill containing alumina balls for 72 hours. The ball milling was further continued for 5 hours after addition of 210 parts of cyclohexanone. The milled mixture was diluted with cyclohexanone with stirring until a solid content of 1.0% by weight was reached to obtain a coating liquid for forming a charge generating layer. The thus obtained coating liquid was applied to the aluminum drum on which the undercoat layer had been formed. The coating was dried at 120° C. for 10 minutes to form a charge generating layer having a thickness of about 0.2 μm.

80 Parts of a charge transporting material having a structure represented by the above formula CT-2, 100 parts of a polycarbonate resin (Panlite TS2050, made by Teijin Chemicals, Ltd.) and 0.02 part of a silicone oil (KF-50, made by Shin-Etsu Chemical Co., Ltd.) were dissolved in 770 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 28 μm, thereby obtaining an electrophotographic photoconductor.

EXAMPLE 16

Example 15 was repeated in the same manner as described except that zinc sulfide powder (manufactured by Shimakyu Pharmaceutical Inc.) was substituted for the titanium oxide, thereby obtaining an electrophotographic photoconductor.

EXAMPLE 17

Example 15 was repeated in the same manner as described except that alumina-treated titanium oxide (CR-60 manufactured by Ishihara Sangyo Co., Ltd.) was substituted for the titanium-oxide, thereby obtaining an electrophotographic photoconductor.

EXAMPLE 18

Example 15 was repeated in the same manner as described except that 1,3-dioxorane was substituted for the tetrahydrofuran for the formation of the coating liquid for a charge transporting layer, thereby obtaining an electrophotographic photoconductor.

EXAMPLE 19

Example 15 was repeated in the same manner as described except that xylene was substituted for the tetrahydrofuran for the formation of the coating liquid for a charge transporting layer, thereby obtaining an electrophotographic photoconductor.

EXAMPLE 20

Example 15 was repeated in the same manner as described except that toluene was substituted for the tetrahydrofuran for the formation of a coating liquid for a charge transporting layer, thereby obtaining an electrophotographic photoconductor.

EXAMPLE 21

Example 15 was repeated in the same manner as described except that the thickness of the undercoat layer was reduced to 1.5 μm, thereby obtaining an electrophotographic photoconductor.

EXAMPLE 22

Example 15 was repeated in the same manner as described except that the thickness of the charge transporting layer was reduced to 20 μm, thereby obtaining an electrophotographic photoconductor.

COMPARATIVE EXAMPLE 9

Example 15 was repeated in the same manner as described except that polyethyleneglycol monoalkyl ether was not used at all, thereby obtaining an electrophotographic photoconductor.

COMPARATIVE EXAMPLE 10

Example 15 was repeated in the same manner as described except that dichloromethane was substituted for the tetrahydrofuran for the formation of a coating liquid for a charge transporting layer, thereby obtaining an electrophotographic photoconductor.

COMPARATIVE EXAMPLE 11

Example 15 was repeated in the same manner as described except that dichloromethane was substituted for the cyclohexanone as a diluting solvent for the formation of a coating liquid for a charge generating layer, thereby obtaining an electrophotographic photoconductor.

Each of the photoconductors obtained in Examples 15-22 and Comparative Examples 9-11 was incorporated in a laser printer (SP-90 made by Ricoh Company, Ltd.) equipped with a non-contact type corona charging device, a laser image exposing device, a reverse development device and a transfer device. Solid and halftone images were repeatedly produced at a dark area potential of −800 V and a reverse development bias of −600V to obtain 100,000 prints in three different conditions of (a) ordinary environment (20° C., 50% relative humidity), low temperature and low humidity environment (12° C., 15% relative humidity) and high temperature and high humidity environment (32° C., 85 relative humidity). The results of the valuation of the initial image and the image of the 100,000th print are summarized in Table 4.

TABLE 4

| | Initial Image | | | After 100,000 prints | | |
|---|---|---|---|---|---|---|
| Example | 20° C./ 50% RH | 12° C./ 15% RH | 32° C./ 85% RH | 20° C./ 50% RH | 12° C./ 15% RH | 32° C./ 85% RH |
| 15 | B1 | B1 | B1 | A | A | A |
| 16 | A | A | A | B1 | C1 | C1 |
| 17 | A | A | A | A | B3 | B3 |
| 18 | A | A | A | A | A | A |
| 19 | A | A | A | A | A | A |
| 20 | A | A | A | A | A | A |
| 21 | A | A | A | B2 | B2 | B2 |
| 22 | A | A | A | B2 | B2 | B2 |
| Comp. 9 | D | D | D | — | — | — |
| Comp. 10 | D | D | D | — | — | — |
| Comp. 11 | D | D | D | — | — | — |

As will be appreciated from the results shown in Table 4, the electrophotographic photoconductors according to the present invention gives under good images for a long period of service without depending upon environments under which the images are formed.

EXAMPLE 23

125 Parts of an alkyd resin (Beckozol 1307-60EL, made by Dainippon Ink & Chemicals, Inc.) and 125 parts of a melamine resin (Super Beckamine G-821-60, made by Dainippon Ink & Chemicals, Inc., solid content: 60% by weight) were dissolved in 500 parts of methyl ethyl ketone, in which 5.0 parts of polypropyleneglycol monoalkyl ether (Newpole LB650X manufactured by Sanyo Chemical Industries, Ltd.) were further dissolved. To the solution were added 570 parts of a titanium oxide powder (CR-EL made by Ishihara Sangyo Co., Ltd., non-surface treated product). The mixture was dispersed in a ball mill containing alumina balls for 30 hours to prepare a coating liquid for an undercoat layer. The coating liquid was then applied to an aluminum drum having a diameter of 30 mm and a length of 340 mm and the coating was dried at 135° C. for 20 minutes to form an undercoat layer having a thickness of 6.0 μm thereon.

18 Parts of A-type titanylphthalocyanin pigment were placed in a glass pot together with zirconia beads having a diameter of 2 mm, to which a solution obtained by dissolving 10 parts of a butyral resin (S-LEC BX, made by Sekisui Chemical Co., Ltd.) in 350 parts of methyl ethyl ketone. The mixture was then milled for 15 hours. The milled mixture was diluted with 600 parts of methyl ethyl ketone to obtain a coating liquid for forming a charge generating layer. The thus obtained coating liquid was applied to the aluminum drum on which the undercoat layer had been formed. The coating was dried at 70° C. for 20 minutes to form a charge generating layer having a thickness of about 0.3 μm.

90 Parts of a charge transporting material having a structure represented by the above formula CT-3, 100 parts of a polycarbonate resin (Panlite L-1250, made by Teijin Chemicals, Ltd.) and 0.02 part of a silicone oil (KF-50, made by Shin-Etsu Chemical Co., Ltd.) were dissolved in 400 parts of 1,3-dioxorane and 350 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 31 μm, thereby obtaining an electrophotographic photoconductor.

EXAMPLE 24

Example 23 was repeated in the same manner as described except that the thickness of the undercoat layer was reduced to 3 μm, thereby obtaining an electrophotographic photoconductor.

EXAMPLE 25

Example 23 was repeated in the same manner as described except that the thickness of the charge transporting layer was reduced to 25 μm, thereby obtaining an electrophotographic photoconductor.

COMPARATIVE EXAMPLE 12

Example 23 was repeated in the same manner as described except that propyleneglycol monoalkyl ether was not used at all, thereby obtaining an electrophotographic photoconductor.

COMPARATIVE EXAMPLE 13

Example 23 was repeated in the same manner as described except that dichloromethane was substituted for the mixed solvent of 1,3-dioxorane and tetrahydrofuran for the formation of a coating liquid for a charge transporting layer, thereby obtaining an electrophotographic photoconductor.

COMPARATIVE EXAMPLE 14

Example 23 was repeated in the same manner as described except that dichloromethane was substituted for the cyclohexanone as a diluting solvent for the formation of a coating liquid for a charge generating layer, thereby obtaining an electrophotographic photoconductor.

Each of the photoconductors obtained in Examples 23-25 and Comparative Examples 12-14 was incorporated in a digital copying machine (IMAGIO MF2200 made by Ricoh Company, Ltd.) equipped with a contact type roll charging device, an exposing device, a reverse development device and a transfer device. Solid and halftone images were repeatedly produced at a dark area potential of −600 V and a reverse development bias of −400V in an ordinary environment (20° C., 50% relative humidity) to obtain 150,000 prints. The results of the valuation of the initial image and the image of the 150,000th copy are summarized in Table 5.

TABLE 5

| Example | Initial Image 20° C./50% RH | Image of 150,000th copy 20° C./50% RH |
|---|---|---|
| 23 | A | A |
| 24 | A | B2 |
| 25 | A | B2 |
| Comp. 12 | D | — |
| Comp. 13 | D | — |
| Comp. 14 | D | — |

As will be appreciated from the results shown in Table 5, the electrophotographic photoconductors according to the present invention gives under good images for a long period of service.

EXAMPLE 26

125 Parts of an alkyd resin (Beckozol 1307-60EL, made by Dainippon Ink & Chemicals, Inc.) and 125 parts of a melamine resin (Super Beckamine G-821-60, made by Dainippon Ink & Chemicals, Inc., solid content: 60% by weight) were dissolved in 500 parts of methyl ethyl ketone, in which 5.0 parts of polyethyleneglycol monoalkyl ether (Nonion E-210 manufactured by Nippon Yushi Co., Ltd.) were further dissolved. To the solution were added 570 parts of a titanium oxide powder (CR-EL made by Ishihara Sangyo Co., Ltd., non-surface treated product). The mixture was dispersed in a ball mill containing alumina balls for 30 hours to prepare a coating liquid for an undercoat layer. The coating liquid was then applied to an aluminum drum having a diameter of 30 mm and a length of 340 mm and the coating was dried at 135° C. for 20 minutes to form an undercoat layer having a thickness of 6.0 μm thereon.

60 Parts of a charge generating material represented by the above formula CG-4 and 330 parts of methyl ethyl ketone were milled for 200 hours, to which a solution obtained by dissolving 10 parts of a polyvinylbutyral resin (S-LEC BL-1, made by Sekisui Chemical Co., Ltd.) in 400 parts of methyl ethyl ketone and 1,850 parts of cyclohexanone was added. The mixture was then milled for 5 hours to obtain a coating liquid for forming a charge generating layer. The thus obtained coating liquid was applied to the aluminum drum on which the undercoat layer had been formed. The coating was dried at 130° C. for 20 minutes to form a charge generating layer having a thickness of about 0.5 μm.

85 Parts of a charge transporting material having a structure represented by the above formula (CT-2), 100 parts of a polycarbonate resin (Panlite L-2050, made by Teijin Chemicals, Ltd.) and 0.02 part of a silicone oil (KF-50, made by Shin-Etsu Chemical Co., Ltd.) were dissolved in 200 parts of 1,3-dioxorane and 550 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 30 μm, thereby obtaining an electrophotographic photoconductor.

EXAMPLE 27

Example 26 was repeated in the same manner as described except that the thickness of the undercoat layer was reduced to 2 μm, thereby obtaining an electrophotographic photoconductor.

EXAMPLE 28

Example 26 was repeated in the same manner as described except that the thickness of the charge transporting layer was reduced to 25 μm, thereby obtaining an electrophotographic photoconductor.

COMPARATIVE EXAMPLE 15

Example 27 was repeated in the same manner as described except that polyethyleneglycol monoalkyl ether was not used at all and that the thickness of the charge transporting layer was reduced to 25 μm, thereby obtaining an electrophotographic photoconductor.

COMPARATIVE EXAMPLE 16

Example 28 was repeated in the same manner as described except that polyethyleneglycol monoalkyl ether was not used at all, thereby obtaining an electrophotographic photoconductor.

Each of the photoconductors obtained in Examples 26-28 and Comparative Examples 15 and 16 was incorporated in an image forming machine (IPSiO NX720N made by Ricoh Company, Ltd.) equipped with a contact type roll charging device, an exposing device modified by changing the wavelength of the writing laser beam, a reverse development device and a transfer device. Images were produced at a dark area potential of −950 V and a reverse development bias of −600 V in an ordinary environment (20° C., 50% RH) until the formation of black spots by charge breakdown was observed. The image quality in the initial stage was evaluated and the occurrence of discharge breakdown was checked to give the results shown in Table 6.

TABLE 6

| Example | Initial Image | Charging breakdown |
|---|---|---|
| 26 | A | Not occurred in the 180,000th print |
| 27 | A | Occurred in the 160,000th print |
| 28 | A | Occurred in the 170,000th print |
| Comp. 15 | A | Occurred in the 80,000th print |
| Comp. 16 | D | Occurred in the 100,000th print |

As will be appreciated from the results shown in Table 6, the electrophotographic photoconductors according to the present invention gives under good images for a long period of service and has good durability.

EXAMPLE 29

150 Parts of an alkyd resin (Beckozol 1307-60EL, made by Dainippon Ink & Chemicals, Inc.) and 100 parts of a melamine resin (Super Beckamine G-821-60, made by Dainippon Ink & Chemicals, Inc., solid content: 60% by weight) were dissolved in 500 parts of methyl ethyl ketone, in which 5.5 parts of polyethyleneglycol monocarboxylic acid ester (Ionet MS-400 manufactured by Sanyo Chemical Industries, Ltd.) were further dissolved. To the solution were added 600 parts of a titanium oxide powder (TA-300 made by Fuji Titanium Industry Co., Ltd., non-surface treated product). The mixture was dispersed in a ball mill containing alumina balls for 24 hours to prepare a coating liquid for an undercoat layer. The coating liquid was then applied to an aluminum drum having a diameter of 30 mm and a length of 340 mm and the coating was dried at 130° C. for 20 minutes to form an undercoat layer having a thickness of 5.0 μm thereon.

5 Parts of a butyral resin (S-LEC BMS, made by Sekisui Chemical Co., Ltd.) were dissolved in 150 parts of cyclohexanone, to which 15 parts of a charge generating material represented by the above formula CG-1 were milled in a ball mill containing alumina balls for 72 hours. The ball milling was further continued for 5 hours after addition of 210 parts of cyclohexanone. The milled mixture was diluted with cyclohexanone with stirring until a solid content of 1.0% by weight was reached to obtain a coating liquid for forming a charge generating layer. The thus obtained coating liquid was applied to the aluminum drum on which the undercoat layer had been formed. The coating was dried at 120° C. for 10 minutes to form a charge generating layer having a thickness of about 0.2 μm.

80 Parts of a charge transporting material having a structure represented by the above formula CT-2, 100 parts of a polycarbonate resin (Panlite TS2050, made by Teijin Chemicals, Ltd.) and 0.02 part of a silicone oil (KF-50, made by Shin-Etsu Chemical Co., Ltd.) were dissolved in 770 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 28 μm, thereby obtaining an electrophotographic photoconductor.

EXAMPLE 30

Example 29 was repeated in the same manner as described except that zinc sulfide powder (manufactured by Shimakyu Pharmaceutical Inc.) was substituted-for the titanium oxide, thereby obtaining an electrophotographic photoconductor.

EXAMPLE 31

Example 29 was repeated in the same manner as described except that alumina-treated titanium oxide (CR-60 manufactured by Ishihara Sangyo Co., Ltd.) was substituted for the titanium oxide, thereby obtaining an electrophotographic photoconductor.

EXAMPLE 32

Example 29 was repeated in the same manner as described except that 1,3-dioxorane was substituted for the tetrahydrofuran for the formation of the coating liquid for a charge transporting layer, thereby obtaining an electrophotographic photoconductor.

EXAMPLE 33

Example 29 was repeated in the same manner as described except that xylene was substituted for the tetrahydrofuran for the formation of the coating liquid for a charge transporting layer, thereby obtaining an electrophotographic photoconductor.

EXAMPLE 34

Example 29 was repeated in the same manner as described except that toluene was substituted for the tetrahydrofuran for the formation of a coating liquid for a charge transporting layer, thereby obtaining an electrophotographic photoconductor.

EXAMPLE 35

Example 29 was repeated in the same manner as described except that the thickness of the undercoat layer was reduced to 1.5 μm, thereby obtaining an electrophotographic photoconductor.

EXAMPLE 36

Example 29 was repeated in the same manner as described except that the thickness of the charge transporting layer was reduced to 20 μm, thereby obtaining an electrophotographic photoconductor.

COMPARATIVE EXAMPLE 17

Example 29 was repeated in the same manner as described except that polyethyleneglycol monocarboxylic acid ester was not used at all, thereby obtaining an electrophotographic photoconductor.

COMPARATIVE EXAMPLE 18

Example 29 was repeated in the same manner as described except that dichloromethane was substituted for the tetrahydrofuran for the formation of a coating liquid for a charge transporting layer, thereby obtaining an electrophotographic photoconductor.

COMPARATIVE EXAMPLE 19

Example 29 was repeated in the same manner as described except that dichloromethane was substituted for the cyclohexanone as a diluting solvent for the formation of a coating liquid for a charge generating layer, thereby obtaining an electrophotographic photoconductor.

Each of the photoconductors obtained in Examples 29-36 and Comparative Examples 17-19 was incorporated in a laser printer (SP-90 made by Ricoh Company, Ltd.) equipped with a non-contact type corona charging device, a laser image exposing device, a reverse development device and a transfer device. Solid and halftone images were repeatedly produced at a dark area potential of −800 V and a reverse development bias of −600V to obtain 100,000 prints in three different conditions of (a) ordinary environment (20° C., 50% relative humidity), low temperature and low humidity environment (12° C., 15% relative humidity) and high temperature and high humidity environment (32° C., 85 relative humidity). The results of the valuation of the initial image and the image of the 100,000th print are summarized in Table 7.

TABLE 7

| | Initial Image | | | Image of 100,000th print | | |
|---|---|---|---|---|---|---|
| Example | 20° C./ 50% RH | 12° C./ 15% RH | 32° C./ 85% RH | 20° C./ 50% RH | 12° C./ 15% RH | 32° C./ 85% RH |
| 29 | B1 | B1 | B1 | A | A | A |
| 30 | A | A | A | B1 | C1 | C1 |
| 31 | A | A | A | A | B3 | B3 |
| 32 | A | A | A | A | A | A |
| 33 | A | A | A | A | A | A |
| 34 | A | A | A | A | A | A |
| 35 | A | A | A | B2 | B2 | B2 |
| 36 | A | A | A | B2 | B2 | B2 |
| Comp. 17 | D | D | D | — | — | — |
| Comp. 18 | D | D | D | — | — | — |
| Comp. 19 | D | D | D | — | — | — |

As will be appreciated from the results shown in Table 7, the electrophotographic photoconductors according to the present invention gives under good images for a long period of service without depending upon environments under which the images are formed.

EXAMPLE 37

125 Parts of an alkyd resin (Beckozol 1307-60EL, made by Dainippon Ink & Chemicals, Inc.) and 125 parts of a melamine resin (Super Beckamine G-821-60, made by Dainippon Ink & Chemicals, Inc., solid content: 60% by weight) were dissolved in 500 parts of methyl ethyl ketone, in which 15.0 parts of polyethyleneglycol diacarboxylic acid ester (Ionet DS-300 manufactured by Sanyo Chemical Industries, Ltd.) were further dissolved. To the solution were added 570 parts of a titanium oxide powder (CR-EL made by Ishihara Sangyo Co., Ltd., non-surface treated product). The mixture was dispersed in a ball mill containing alumina balls for 30 hours to prepare a coating liquid for an undercoat layer. The coating liquid was then applied to an aluminum drum having a diameter of 30 mm and a length of 340 mm and the coating was dried at 135° C. for 20 minutes to form an undercoat layer having a thickness of 6.0 μm thereon.

18 Parts of A-type titanylphthalocyanin pigment were placed in a glass pot together with zirconia beads having a diameter of 2 mm, to which a solution obtained by dissolving 10 parts of a butyral resin (S-LEC BX, made by Sekisui Chemical Co., Ltd.) in 350 parts of methyl ethyl ketone. The mixture was then milled for 15 hours. The milled mixture was diluted with 600 parts of methyl ethyl ketone to obtain a coating liquid for forming a charge generating layer. The thus obtained coating liquid was applied to the aluminum drum on which the undercoat layer had been formed. The coating was dried at 70° C. for 20 minutes to form a charge generating layer having a thickness of about 0.3 μm.

90 Parts of a charge transporting material represented by the above formula CT-3, 100 parts of a polycarbonate resin (Panlite L-1250, made by Teijin Chemicals, Ltd.) and 0.02 part of a silicone oil (KF-50, made by Shin-Etsu Chemical Co., Ltd.) were dissolved in 400 parts of 1,3-dioxorane and 350 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 31 μm, thereby obtaining an electrophotographic photoconductor.

EXAMPLE 38

Example 37 was repeated in the same manner as described except that the thickness of the undercoat layer was reduced to 3 μm, thereby obtaining an electrophotographic photoconductor.

EXAMPLE 39

Example 37 was repeated in the same manner as described except that the thickness of the charge transporting layer was reduced to 25 μm, thereby obtaining an electrophotographic photoconductor.

COMPARATIVE EXAMPLE 20

Example 37 was repeated-in the same manner as described except that polyethyleneglycol dicarboxylic acid was not used at all, thereby obtaining an electrophotographic photoconductor.

COMPARATIVE EXAMPLE 21

Example 37 was repeated in the same manner as described except that dichloromethane was substituted for the mixed solvent of 1,3-dioxorane and tetrahydrofuran-for the formation of a coating liquid for a charge transporting layer, thereby obtaining an electrophotographic photoconductor.

COMPARATIVE EXAMPLE 22

Example 37 was repeated in the same manner as described except that dichloromethane was substituted for the cyclohexanone as a diluting solvent for the formation of a coating liquid for a charge generating layer, thereby obtaining an electrophotographic photoconductor.

Each of the photoconductors obtained in Examples 37-39 and Comparative Examples 20-22 was incorporated in a digital copying machine (IMAGIO MF2200 made by Ricoh Company, Ltd.) equipped with a contact type roll charging device, an exposing device, a reverse development device and a transfer device. Solid and halftone images were repeatedly produced at a dark area potential of −600 V and a reverse development bias of −400V in an ordinary environment (20° C., 50% relative humidity) to obtain 100,000 copies. The results of the valuation of the initial image and the image of 150,000th copy are summarized in Table 8.

TABLE 8

| Example | Initial Image 20° C./50% RH | Image of 150,000th copy 20° C./50% RH |
|---|---|---|
| 23 | A | A |
| 24 | A | B2 |
| 25 | A | B2 |
| Comp. 12 | D | — |
| Comp. 13 | D | — |
| Comp. 14 | D | — |

As will be appreciated from the results shown in Table 8, the electrophotographic photoconductors according to the present invention gives under good images for a long period of service.

EXAMPLE 40

125 Parts of an alkyd resin (Beckozol 1307-60EL, made by Dainippon Ink & Chemicals, Inc.) and 125 parts of a melamine resin (Super Beckamine G-821-60, made by Dainippon Ink & Chemicals, Inc., solid content: 60% by weight) were dissolved in 500 parts of methyl ethyl ketone, in which 5.0 parts of polyethyleneglycol distearate (Nonion DS-60HN manufactured by Nippon Yushi Co., Ltd.) were further dissolved. To the solution were added 570 parts of a titanium oxide powder (CR-EL made by Ishihara Sangyo Co., Ltd., non-surface treated product). The mixture was dispersed in a ball mill containing alumina balls for 30 hours to prepare a coating liquid for an undercoat layer. The coating liquid was then applied to an aluminum drum having a diameter of 30 mm and a length of 340 mm and the coating was dried at 135° C. for 20 minutes to form an undercoat layer having a thickness of 6.0 μm thereon.

60 Parts of a charge generating material represented by the above formula CG-4 and 330 parts of methyl ethyl ketone were milled for 200 hours, to which a solution obtained by dissolving 10 parts of a polyvinylbutyral resin (S-LEC BL-1, made by Sekisui Chemical Co., Ltd.) in 400 parts of methyl ethyl ketone and 1,850 parts of cyclohexanone was added. The mixture was then milled for 5 hours to obtain a coating liquid for forming a charge generating layer. The thus obtained coating liquid was applied to the aluminum drum on which the undercoat layer had been formed. The coating was dried at 130° C. for 20 minutes to form a charge generating layer having a thickness of about 0.5 μm.

85 Parts of a charge transporting material having a structure represented by the above formula (CT-2), 100 parts of a polycarbonate resin (Panlite L-2050, made by Teijin Chemicals, Ltd.) and 0.02 part of a silicone oil (KF-50, made by Shin-Etsu Chemical Co., Ltd.) were dissolved in 200 parts of 1,3-dioxorane and 550 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 30 μm, thereby obtaining an electrophotographic photoconductor.

EXAMPLE 41

Example 40 was repeated in the same manner as described except that the thickness of the undercoat layer was reduced to 2 μm, thereby obtaining an electrophotographic photoconductor.

EXAMPLE 42

Example 40 was repeated in the same manner as described except that the thickness of the charge transporting layer was reduced to 25 μm, thereby obtaining an electrophotographic photoconductor.

COMPARATIVE EXAMPLE 23

Example 41 was repeated in the same manner as described except that polyethyleneglycol distearate was not used at all and that the thickness of the charge transporting layer was reduced to 25 μm, thereby obtaining an electrophotographic photoconductor.

COMPARATIVE EXAMPLE 24

Example 42 was repeated in the same manner as described except that polyethyleneglycol distearate was not used at all, thereby obtaining an electrophotographic photoconductor.

Each of the photoconductors obtained in Examples 40-42 and Comparative Examples 23 and 24 was incorporated in an image forming machine (IPSiO NX720N made by Ricoh Company, Ltd.) equipped with a contact type roll charging device, an exposing device modified by changing the wavelength of the writing laser beam, a reverse development device and a transfer device. Images were produced at a dark area potential of −950 V and a reverse development bias of −600 V in an ordinary environment (20° C., 50% RH) until the formation of black spots by charge breakdown was observed. The image quality in the initial stage was evaluated and the occurrence of discharge breakdown was checked to give the results shown in Table 9.

TABLE 9

| Example | Initial Image | Charging breakdown |
|---|---|---|
| 40 | A | Not occurred in the 180,000th print |
| 41 | A | Occurred in the 160,000th print |
| 42 | A | Occurred in the 170,000th print |
| Comp. 23 | A | Occurred in the 80,000th print |
| Comp. 24 | D | Occurred in the 100,000th print |

As will be appreciated from the results shown in Table 9, the electrophotographic photoconductors according to the present invention gives under good images for a long period of service and has good durability.

EXAMPLE 43

150 Parts of an alkyd resin (Beckozol 1307-60EL, made by Dainippon Ink & Chemicals, Inc.) and 100 parts of a melamine resin (Super Beckamine G-821-60, made by Dainippon Ink & Chemicals, Inc., solid content: 60% by weight) were dissolved in 500 parts of methyl ethyl ketone, in which 5.5 parts of oxyethylene-oxypropylene copolymer (Newpole PE-61 manufactured by Sanyo Chemical Industries, Ltd.) were further dissolved. To the solution were added 600 parts of a titanium oxide powder (TA-300 made by Fuji Titanium Industry Co., Ltd., non-surface treated product). The mixture was dispersed in a ball mill containing alumina balls for 24 hours to prepare a coating liquid for an undercoat layer. The coating liquid was then applied to an aluminum drum having a diameter of 30 mm and a length of 340 mm and the coating was dried at 130° C. for 20 minutes to form an undercoat layer having a thickness of 5.0 μm thereon.

5 Parts of a butyral resin (S-LEC BMS, made by Sekisui Chemical Co., Ltd.) were dissolved in 150 parts of cyclohexanone, to which 15 parts of a charge generating material represented by the above formula CG-1 were milled in a ball mill containing alumina balls for 72 hours. The ball milling was further continued for 5 hours after addition of 210 parts of cyclohexanone. The-milled mixture was diluted with cyclohexanone with stirring until a solid content of 1.0% by weight was reached to obtain a coating liquid for forming a charge generating layer. The thus obtained coating liquid was applied to the aluminum drum on which the undercoat layer had been formed. The coating was dried at 120° C. for 10 minutes to form a charge generating layer having a thickness of about 0.2 μm.

80 Parts of a charge transporting material represented by the above structural formula CT-2, 100 parts of a polycarbonate resin (Panlite TS2050, made by Teijin Chemicals, Ltd.) and 0.02 part of a silicone oil (KF-50, made by Shin-Etsu Chemical Co., Ltd.) were dissolved in 770 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 28 μm, thereby obtaining an electrophotographic photoconductor.

EXAMPLE 44

Example 43 was repeated in the same manner as described except that zinc sulfide powder (manufactured by Shimakyu Pharmaceutical Inc.) was substituted for the titanium oxide, thereby obtaining an electrophotographic photoconductor.

EXAMPLE 45

Example 43 was repeated in the same manner as described except that alumina-treated titanium oxide (CR-60 manufactured by Ishihara Sangyo Co., Ltd.) was substituted for the titanium oxide, thereby obtaining an electrophotographic photoconductor.

EXAMPLE 46

Example 43 was repeated in the same manner as described except that 1,3-dioxorane was substituted for the tetrahydrofuran for the formation of the coating liquid for a charge transporting layer, thereby obtaining an electrophotographic photoconductor.

EXAMPLE 47

Example 43 was repeated in the same manner as described except that xylene was substituted for the tetrahydrofuran for the formation of the coating liquid for a charge transporting layer, thereby obtaining an electrophotographic photoconductor.

EXAMPLE 48

Example 43 was repeated in the same manner as described except that toluene was substituted for the tetrahydrofuran for the formation of a coating liquid for a charge transporting layer, thereby obtaining an electrophotographic photoconductor.

EXAMPLE 49

Example 43 was repeated in the same manner as described except that the thickness of the undercoat layer was reduced to 1.5 μm, thereby obtaining an electrophotographic photoconductor.

EXAMPLE 50

Example 43 was repeated in the same manner as described except that the thickness of the charge transporting layer was reduced to 20 μm, thereby obtaining an electrophotographic photoconductor.

COMPARATIVE EXAMPLE 25

Example 43 was repeated in the same manner as described except that oxyethylene-oxypropylene copolymer was not used at all, thereby obtaining an electrophotographic photoconductor.

COMPARATIVE EXAMPLE 26

Example 43 was repeated in the same manner as described except that dichloromethane was substituted for the tetrahydrofuran for the formation of a coating liquid for a charge transporting layer, thereby obtaining an electrophotographic photoconductor.

COMPARATIVE EXAMPLE 27

Example 43 was repeated in the same manner as described except that dichloromethane was substituted for the cyclohexanone as a diluting solvent for the formation of a coating liquid for a charge generating layer, thereby obtaining an electrophotographic photoconductor.

Each of the photoconductors obtained in Examples 29-36 and Comparative Examples 17-19 was incorporated in a laser printer (SP-90 made by Ricoh Company, Ltd.) equipped with a non-contact type corona charging device, a laser image exposing device, a reverse development device and a transfer device. Solid and halftone images were repeatedly produced at a dark area potential of −800 V and a reverse development bias of −600V to obtain 100,000 prints in three different conditions of (a) ordinary environment (20° C., 50% relative humidity), low temperature and low humidity environment (12° C., 15% relative humidity) and high temperature and high humidity environment (32° C., 85 relative humidity). The results of the evaluation of the initial image and the image of the 100,000th print are summarized in Table 10.

TABLE 10

| Example | Initial Image 20° C./50% RH | Initial Image 12° C./15% RH | Initial Image 32° C./85% RH | Image of 100,000th print 20° C./50% RH | Image of 100,000th print 12° C./15% RH | Image of 100,000th print 32° C./85% RH |
|---|---|---|---|---|---|---|
| 43 | B1 | B1 | B1 | A | A | A |
| 44 | A | A | A | B1 | C1 | C1 |
| 45 | A | A | A | A | B3 | B3 |
| 46 | A | A | A | A | A | A |
| 47 | A | A | A | A | A | A |
| 48 | A | A | A | A | A | A |
| 49 | A | A | A | B2 | B2 | B2 |
| 50 | A | A | A | B2 | B2 | B2 |
| Comp. 25 | D | D | D | — | — | — |
| Comp. 26 | D | D | D | — | — | — |
| Comp. 27 | D | D | D | — | — | — |

As will be appreciated from the results shown in Table 10, the electrophotographic photoconductors according to the present invention gives under good images for a long period of service without depending upon environments under which the images are formed.

EXAMPLE 51

125 Parts of an alkyd resin (Beckozol 1307-60EL, made by Dainippon Ink & Chemicals, Inc.) and 125 parts of a melamine resin (Super Beckamine G-821-60, made by Dainippon Ink & Chemicals, Inc., solid content: 60% by weight) were dissolved in 500 parts of methyl ethyl ketone, in which 10.0 parts of oxyethylene-oxypropylene copolymer (Newpole 75H-90000 manufactured by Sanyo Chemical Industries, Ltd.) were further dissolved. To the solution were added 570 parts of a titanium oxide powder (CR-EL made by Ishihara Sangyo Co., Ltd., non-surface treated product). The mixture was dispersed in a ball mill containing alumina balls for 30 hours to prepare a coating liquid for an undercoat layer. The coating liquid was then applied to an aluminum drum having a diameter of 30 mm and a length of 340 mm and the coating was dried at 135° C. for 20 minutes to form an undercoat layer having a thickness of 6.0 μm thereon.

18 Parts of A-type titanylphthalocyanin pigment were placed in a glass pot together with zirconia beads having a diameter of 2 mm, to which a solution obtained by dissolving 10 parts of a butyral resin (S-LEC BX, made by Sekisui Chemical Co., Ltd.) in 350 parts of methyl ethyl ketone. The mixture was then milled for 15 hours. The milled mixture was diluted with 600 parts of methyl ethyl ketone to obtain a coating liquid for forming a charge generating layer. The thus obtained coating liquid was applied to the aluminum drum on which the undercoat layer had been formed. The coating was dried at 70° C. for 20 minutes to form a charge generating layer having a thickness of about 0.3 μm.

90 Parts of a charge transporting material having a structure represented by the above structural formula CT-3, 100 parts of a polycarbonate resin (Panlite L-1250, made by Teijin Chemicals, Ltd.) and 0.02 part of a silicone oil (KF-50, made by Shin-Etsu Chemical Co., Ltd.) were dissolved in 400 parts of 1,3-dioxorane and 350 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 31 μm, thereby obtaining an electrophotographic photoconductor.

EXAMPLE 52

Example 51 was repeated in the same manner as described except that the thickness of the undercoat layer was reduced to 3 μm, thereby obtaining an electrophotographic photoconductor.

EXAMPLE 53

Example 51 was repeated in the same manner as described except that the thickness of the charge transporting layer was reduced to 25 μm, thereby obtaining an electrophotographic photoconductor.

COMPARATIVE EXAMPLE 28

Example 37 was repeated in the same manner as described except that oxyethylene-oxypropylene copolymer was not used at all, thereby obtaining an electrophotographic photoconductor.

COMPARATIVE EXAMPLE 29

Example 51 was repeated in the same manner as described except that dichloromethane was substituted for the mixed solvent of 1,3-dioxorane and tetrahydrofuran for the formation of a coating liquid for a charge transporting layer, thereby obtaining an electrophotographic photoconductor.

COMPARATIVE EXAMPLE 30

Example 51 was repeated in the same manner as described except that dichloromethane was substituted for the cyclohexanone as a diluting solvent for the formation of a coating liquid for a charge generating layer, thereby obtaining an electrophotographic photoconductor.

Each of the photoconductors obtained in Examples 51-53 and Comparative Examples 28-30 was incorporated in a digital copying machine (IMAGIO MF2200 made by Ricoh Company, Ltd.) equipped with a contact type-roll charging device, an exposing device, a reverse development device and a transfer device. Solid and halftone images were repeatedly produced at a dark area potential of −600 V and a reverse development bias of −400V in an ordinary environment (20° C., 50% relative humidity) to obtain 150,000 copies. The results of the valuation of the initial image and the image of the 150,000th copy are summarized in Table 11.

TABLE 11

| Example | Initial Image 20° C./50% RH | Image of 150,000th copy 20° C./50% RH |
|---|---|---|
| 51 | A | A |
| 52 | A | B2 |
| 53 | A | B2 |
| Comp. 28 | D | — |
| Comp. 29 | D | — |
| Comp. 30 | D | — |

As will be appreciated from the results shown in Table 11, the electrophotographic photoconductors according to the present invention gives under good images for a long period of service.

EXAMPLE 54

125 Parts of an alkyd resin (Beckozol 1307-60EL, made by Dainippon Ink & Chemicals, Inc.) and 125 parts of a melamine resin (Super Beckamine G-821-60, made by Dainippon Ink & Chemicals, Inc., solid content: 60% by weight) were dissolved in 500 parts of methyl ethyl ketone, in which 5.0 parts of oxyethylene-oxypropylene copolymer (Pronon 204 manufactured by Nippon Yushi Co., Ltd.) were further dissolved. To the solution were added 570 parts of a titanium oxide powder (CR-EL made by Ishihara Sangyo Co., Ltd., non-surface treated product). The mixture was dispersed in a ball mill containing alumina balls for 30 hours to prepare a coating liquid for an undercoat layer. The coating liquid was then applied to an aluminum drum having a diameter of 30 mm and a length of 340 mm and the coating was dried at 135° C. for 20 minutes to form an undercoat layer having a thickness of 6.0 μm thereon.

60 Parts of a charge generating material represented by the above formula CG-4 and 330 parts of methyl ethyl ketone were milled for 200 hours, to which a solution obtained by dissolving 10 parts of a polyvinylbutyral resin (S-LEC BL-1, made by Sekisui Chemical Co., Ltd.) in 400 parts of methyl ethyl ketone and 1,850 parts of cyclohexanone was added. The mixture was then milled for 5 hours to obtain a coating liquid for forming a charge generating layer. The thus obtained coating liquid was applied to the aluminum drum on which the undercoat layer had been formed. The coating was dried at 130° C. for 20 minutes to form a charge generating layer having a thickness of about 0.5 μm.

85 Parts of a charge transporting material having a structure represented by the above formula (CT-2), 100 parts of a polycarbonate resin (Panlite L-2050, made by Teijin Chemicals, Ltd.) and 0.02 part of a silicone oil (KF-50, made by Shin-Etsu Chemical Co., Ltd.) were dissolved in 200 parts of 1,3-dioxorane and 550 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 30 μm, thereby obtaining an electrophotographic photoconductor.

EXAMPLE 55

Example 54 was repeated in the same manner as described except that the thickness of the undercoat layer was reduced to 2 μm, thereby obtaining an electrophotographic photoconductor.

EXAMPLE 56

Example 54 was repeated in the same manner as described except that the thickness of the charge transporting layer was reduced to 25 μm, thereby obtaining an electrophotographic photoconductor.

COMPARATIVE EXAMPLE 31

Example 55 was repeated in the same manner as described except that oxyethylene-oxypropylene copolymer was not used at all and that the thickness of the charge transporting layer was reduced to 25 μm, thereby obtaining an electrophotographic photoconductor.

COMPARATIVE EXAMPLE 32

Example 42 was repeated in the same manner as described except that oxyethylene-oxypropylene copolymer was not used at all, thereby obtaining an electrophotographic photoconductor.

Each of the photoconductors obtained in Examples 54-56 and Comparative Examples 31 and 32 was incorporated in an image forming machine (IPSiO NX720N made by Ricoh Company, Ltd.) equipped with a contact type roll charging device, an exposing device modified by changing the wavelength of the writing laser beam, a reverse development device and a transfer device. Images were produced at a dark area potential of −950 V and a reverse development bias of −600 V in an ordinary environment (20° C., 50% RH) until the formation of black spots by charge breakdown was observed. The image quality in the initial stage was evaluated and the occurrence of discharge breakdown was checked to give the results shown in Table 12.

TABLE 12

| Example | Initial Image | Charging breakdown |
|---|---|---|
| 54 | A | Not occurred in the 180,000th print |
| 55 | A | Occurred in the 160,000th print |
| 56 | A | Occurred in the 170,000th print |
| Comp. 31 | A | Occurred in the 80,000th print |
| Comp. 32 | D | Occurred in the 100,000th print |

As will be appreciated from the results shown in Table 12, the electrophotographic photoconductors according to the present invention gives under good images for a long period of service and has good durability.

EXAMPLE 57

150 Parts of an alkyd resin (Beckozol 1307-60EL, made by Dainippon Ink & Chemicals, Inc.) and 100 parts of a melamine resin (Super Beckamine G-821-60, made by Dainippon Ink & Chemicals, Inc., solid content: 60% by weight) were dissolved in 500 parts of methyl ethyl ketone, in which 5.0 parts of tribenzo-18-crown-6 ether were further dissolved. To the solution were added 600 parts of a titanium oxide powder (TA-300 made by Fuji Titanium Industry Co., Ltd., non-surface treated product). The mixture was dispersed in a ball mill containing alumina balls for 24 hours to prepare a coating liquid for an undercoat layer. The coating liquid was then applied to an aluminum drum having a diameter of 30 mm and a length of 340 mm and the coating was dried at 130° C. for 20 minutes to form an undercoat layer having a thickness of 5.0 μm thereon.

5 Parts of a-butyral resin (S-LEC BMS, made by Sekisui Chemical Co., Ltd.) were dissolved in 150 parts of cyclohexanone, to which 15 parts of a charge generating material having a structure represented by the above formula CG-1 were milled in a ball mill containing alumina balls for 72 hours. The ball milling was further continued for 5 hours after addition of 210 parts of cyclohexanone. The milled mixture was diluted with cyclohexanone with stirring until a solid content of 1.0% by weight was reached to obtain a coating liquid for forming a charge generating layer. The thus obtained coating liquid was applied to the aluminum drum on which the undercoat layer had been formed. The coating was dried at 120° C. for 10 minutes to form a charge generating layer having a thickness of about 0.2 μm.

80 Parts of a charge transporting material having a structure represented by the above structural formula CT-2, 100 parts of a polycarbonate resin (Panlite TS2050, made by Teijin Chemicals, Ltd.), 0.4 part of 2,6-di-tert-butyl-4-methylphenol, 0.5 part of distearyl-3,3'-thiopropionate and 0.02 part of a silicone oil (KF-50, made by Shin-Etsu Chemical Co., Ltd.) were dissolved in 770 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 28 μm, thereby obtaining an electrophotographic photoconductor.

EXAMPLE 58

Example 57 was repeated in the same manner as described except that zinc sulfide powder (manufactured by Shimakyu Pharmaceutical Inc.) was substituted for the titanium oxide, thereby obtaining an electrophotographic photoconductor.

EXAMPLE 59

Example 57 was repeated in the same manner as described except that alumina-treated titanium oxide (CR-60 manufactured by Ishihara Sangyo Co., Ltd.) was substituted for the titanium oxide, thereby obtaining an electrophotographic photoconductor.

EXAMPLE 60

Example 57 was repeated in the same manner as described except that 1,3-dioxorane was substituted for the tetrahydrofuran for the formation of the coating liquid for a charge transporting layer, thereby obtaining an electrophotographic photoconductor.

EXAMPLE 61

Example 57 was repeated in the same manner as described except that xylene was substituted for the tetrahydrofuran for the formation of the coating liquid for a charge transporting layer, thereby obtaining an electrophotographic photoconductor.

EXAMPLE 62

Example 57 was repeated in the same manner as described except that toluene was substituted for the tetrahydrofuran for the formation of a coating liquid for a charge transporting layer, thereby obtaining an electrophotographic photoconductor.

EXAMPLE 63

Example 57 was repeated in the same manner as described except that the thickness of the undercoat layer was reduced to 1.8 μm, thereby obtaining an electrophotographic photoconductor.

EXAMPLE 64

Example 57 was repeated in the same manner as described except that the thickness of the charge transporting layer was reduced to 25 μm, thereby obtaining an electrophotographic photoconductor.

COMPARATIVE EXAMPLE 33

Example 57 was repeated in the same manner as described except that tribenzo-18-crown-6 ether was not used at all, thereby obtaining an electrophotographic photoconductor.

COMPARATIVE EXAMPLE 34

Example 57 was repeated in the same manner as described except that dichloromethane was substituted for the tetrahydrofuran for the formation of a coating liquid for a charge transporting layer, thereby obtaining an electrophotographic photoconductor.

COMPARATIVE EXAMPLE 35

Example 57 was repeated in the same manner as described except that dichloromethane was substituted for the cyclohexanone as a diluting solvent for the formation of a coating liquid for a charge generating layer, thereby obtaining an electrophotographic photoconductor.

EXAMPLE 57a

Example 57 was repeated in the same manner as described except that 2,6-di-tert-butyl-4-methylphenol was not used at all, thereby obtaining an electrophotographic photoconductor.

EXAMPLE 57b

Example 57 was repeated in the same manner as described except that distearyl-3,3'-thiopropionate was not used at all, thereby obtaining an electrophotographic photoconductor.

EXAMPLE 57c

Example 57 was repeated in the same manner as described except that neither 2,6-di-tert-butyl-4-methylphenol nor distearyl-3,3'-thiopropionate was used at all, thereby obtaining an electrophotographic photoconductor.

Each of the photoconductors obtained in Examples 57-64, Comparative Examples 33-35 and Examples 57a-57c was incorporated in a laser printer (SP-90-made by Ricoh Company, Ltd.) equipped with a non-contact type corona charging device, a laser image exposing device, a reverse development device and a transfer device. Solid and halftone images were repeatedly produced at a dark area potential of −800 V and a reverse development bias of −600V to obtain 200,000 prints in three different conditions of (a) ordinary environment (20° C., 50% relative humidity), low temperature and low humidity environment (12° C., 15% relative humidity) and high temperature and high humidity environment (32° C., 85 relative humidity). The results of the valuation of the initial image and the image of the 200,000th print are summarized in Table 13.

TABLE 13

| | Initial Image | | | Image of 200,000th print | | |
|---|---|---|---|---|---|---|
| Example | 20° C./ 50% RH | 12° C./ 15% RH | 32° C./ 85% RH | 20° C./ 50% RH | 12° C./ 15% RH | 32° C./ 85% RH |
| 57 | B1 | B1 | B1 | A | A | A |
| 58 | A | A | A | B1 | C1 | C1 |
| 59 | A | A | A | A | B3 | B3 |
| 60 | A | A | A | A | A | A |
| 61 | A | A | A | A | A | A |
| 62 | A | A | A | A | A | A |
| 63 | A | A | A | B2 | B2 | B2 |
| 64 | A | A | A | B2 | B2 | B2 |
| Comp. 33 | D | D | D | — | — | — |
| Comp. 34 | D | D | D | — | — | — |
| Comp. 35 | D | D | D | — | — | — |

TABLE 13-continued

| Example | Initial Image | | | Image of 200,000th print | | |
|---|---|---|---|---|---|---|
| | 20° C./ 50% RH | 12° C./ 15% RH | 32° C./ 85% RH | 20° C./ 50% RH | 12° C./ 15% RH | 32° C./ 85% RH |
| 57a | A | A | A | A* | A* | A* |
| 57b | A | A | A | A* | A* | A* |
| 57c | A | A | A | A* | A* | A* |

A*: Good up to 100,000 prints. But reduction of image density was observed in the 200,000th print.

As will be appreciated from the results shown in Table 13, the electrophotographic photoconductors according to the present invention gives under good images for a long period of service without depending upon environments under which the images are formed.

EXAMPLE 65

125 Parts of an alkyd resin (Beckozol 1307-60EL, made by Dainippon Ink & Chemicals, Inc.) and 125 parts of a melamine resin (Super Beckamine G-821-60, made by Dainippon Ink & Chemicals, Inc., solid content: 60% by weight) were dissolved in 500 parts of methyl ethyl ketone, in which 8.5 parts of tetrabenzo-24-crown-8 ether were further dissolved. To the solution were added 570 parts of a titanium oxide powder (TA-300 made by Fuji Titanium Kogyo Co., Ltd., non-surface treated product). The mixture was dispersed in a ball mill containing alumina balls for 30 hours to prepare a coating liquid for an undercoat layer. The coating liquid was then applied to an aluminum drum having a diameter of 30 mm and a length of 340 mm and the coating was dried at 135° C. for 20 minutes to form an undercoat layer having a thickness of 6.0 μm thereon.

18 Parts of A-type titanylphthalocyanin pigment were placed in a glass pot together with zirconia beads having a diameter of 2 mm, to which 350 parts of methyl ethyl ketone were further added. The mixture was then milled for 15 hours. To the milled mixture, a solution obtained by dissolving 10 parts of a butyral resin (S-LEC BX, made by Sekisui Chemical Co., Ltd.) in 600 parts of methyl ethyl ketone was added. The mixture was then milled for 2 hours to obtain a coating liquid for forming a charge generating layer. The thus obtained coating liquid was applied to the aluminum drum on which the undercoat layer had been formed. The coating was dried at 70° C. for 20 minutes to form a charge generating layer having a thickness of about 0.3 μm.

90 Parts of a charge transporting material having a structure represented by the above structural formula CT-3, 100 parts of a polycarbonate resin (Panlite L-1250, made by Teijin Chemicals, Ltd.), 0.5 part of 2,6-di-tert-butyl-4-methoxylphenol, 1 part of dimethyl-3,3'-thiopropionate and 0.02 part of a silicone oil (KF-50, made by Shin-Etsu Chemical Co., Ltd.) were dissolved in 300 parts of 1,3-dioxorane and 450 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 31 μm, thereby obtaining an electrophotographic photoconductor.

EXAMPLE 66

Example 65 was repeated in the same manner as described except that the thickness of the undercoat layer was reduced to 3.5 μm, thereby obtaining an electrophotographic photoconductor.

EXAMPLE 67

Example 65 was repeated in the same manner as described except that the thickness of the charge transporting layer was reduced to 26 μm, thereby obtaining an electrophotographic photoconductor.

COMPARATIVE EXAMPLE 36

Example 65 was repeated in the same manner as described except that the tetrabenzo-24-crown-8 ether was not used at all, thereby obtaining an electrophotographic photoconductor.

COMPARATIVE EXAMPLE 37

Example 65 was repeated in the same manner as described except that dichloromethane was substituted for the mixed solvent of 1,3-dioxorane and tetrahydrofuran for the formation of a coating liquid for a charge transporting layer, thereby obtaining an electrophotographic photoconductor.

COMPARATIVE EXAMPLE 38

Example 65 was repeated in the same manner as described except that a mixed solvent composed of 200 parts of methyl ethyl ketone and 400 parts of dichloromethane was substituted for the solvent (methyl ethyl ketone) for the formation of a coating liquid for a charge generating layer, thereby obtaining an electrophotographic photoconductor.

EXAMPLE 65a

Example 65 was repeated in the same manner as described except that 2,6-di-tert-butyl-4-methoxylphenol was not used at all, thereby obtaining an electrophotographic photoconductor.

EXAMPLE 65b

Example 65 was repeated in the same manner as described except that dimethyl-3,3'-thiopropionate was not used at all, thereby obtaining an electrophotographic photoconductor.

EXAMPLE 65c

Example 65 was repeated in the same manner as described except that neither 2,6-di-tert-butyl-4-methoxylphenol nor dimethyl-3,3'-thiopropionate was used at all, thereby obtaining an electrophotographic photoconductor.

Each of the photoconductors obtained in Examples 65-67, Comparative Examples 36-38 and Examples 65a-65c was incorporated in a digital copying machine (IMAGIO MF2200 made by Ricoh Company, Ltd.) equipped with a contact type roll charging device, an exposing device, a reverse development device and a transfer device. Solid and halftone images were repeatedly produced at a dark area potential of −600 V and a reverse development bias of −400V in an ordinary environment (20° C., 50% relative humidity) to obtain 300,000 copies. The results of the valuation of the initial image and the image of the 300,000th copy are summarized in Table 14.

TABLE 14

| Example | Initial Image 20° C./50% RH | Image of 300,000th copy 20° C./50% RH |
|---|---|---|
| 65 | A | A |
| 66 | A | B2 |
| 67 | A | B2 |
| Comp. 36 | D | — |
| Comp. 37 | D | — |
| Comp. 38 | D | — |
| 65a | A | A* |
| 65b | A | A* |
| 65c | A | A* |

A*: Good up to 150,000th copy. But reduction of image density was observed in the 300,000th copy.

As will be appreciated from the results shown in Table 14, the electrophotographic photoconductors according to the present invention gives under good images for a long period of service.

EXAMPLE 68

125 Parts of an alkyd resin (Beckozol 1307-60EL, made by Dainippon Ink & Chemicals, Inc.) and 125 parts of a melamine resin (Super Beckamine G-821-60, made by Dainippon Ink & Chemicals, Inc., solid content: 60% by weight) were dissolved in 500 parts of methyl ethyl ketone, in which 8.5 parts of 21-crown-7 ether were further dissolved. To the solution were added 570 parts of a titanium oxide powder (CR-EL made by Ishihara Sangyo Co., Ltd., non-surface treated product). The mixture was dispersed in a ball mill containing alumina balls for 30 hours to prepare a coating liquid for an undercoat layer. The coating liquid was then applied to an aluminum drum having a diameter of 30 mm and a length of 340 mm and the coating was dried at 135° C. for 20 minutes to form an undercoat layer having a thickness of 6.0 μm thereon.

60 Parts of a charge generating material represented by the above formula CG-4 and 330 parts of methyl ethyl ketone were milled for 200 hours, to which a solution obtained by dissolving 10 parts of a polyvinylbutyral resin (S-LEC BL-1, made by Sekisui Chemical-Co., Ltd.) in 400 parts of methyl ethyl ketone and 1,850 parts of cyclohexanone was added. The mixture was then milled for 5 hours to obtain a coating liquid for forming a charge generating layer. The thus obtained coating liquid was applied to the aluminum drum on which the undercoat layer had been formed. The coating was dried at 130° C. for 20 minutes to form a charge generating layer having a thickness of about 0.5 μm.

70 Parts of a charge transporting material having a structure represented by the above formula (CT-2), 100 parts of a polycarbonate resin (Panlite L-2050, made by Teijin Chemicals, Ltd.), 0.1 part of 2,4-dimethyl-6-tert-butylphenol, 0.5 part of dimyristyl-3,3'-thiopropionate and 0.02 part of a silicone oil (KF-50, made by Shin-Etsu Chemical Co., Ltd.) were dissolved in 200 parts of 1,3-dioxorane and 550 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 29 μm, thereby obtaining an electrophotographic photoconductor.

EXAMPLE 69

Example 68 was repeated in the same manner as described except that the thickness of the undercoat layer was reduced to 2 μm, thereby obtaining an electrophotographic photoconductor.

EXAMPLE 70

Example 68 was repeated in the same manner as described except that the thickness of the charge transporting layer was reduced to 25 μm, thereby obtaining an electrophotographic photoconductor.

EXAMPLE 68a

Example 68 was repeated in the same manner as described except that neither 2,4-dimethyl-6-tert-butylphenol nor dimyristyl-3,3'-thiopropionate was used at all, thereby obtaining an electrophotographic photoconductor.

COMPARATIVE EXAMPLE 39

Example 69 was repeated in the same manner as described except that 21-crown-7 ether was not used for the formation of the undercoat layer and that neither 2,4-dimethyl-6-tert-butylphenol nor dimyristyl-3,3'-thiopropionate was used in the charge transporting layer, thereby obtaining an electrophotographic photoconductor.

COMPARATIVE EXAMPLE 40

Example 70 was repeated in the same manner as described except that 21-crown-7 ether was not used for the formation of the undercoat layer and that neither 2,4-dimethyl-6-tert-butylphenol nor dimyristyl-3,3'-thiopropionate was used in the charge transporting layer, thereby obtaining an electrophotographic photoconductor.

Each of the photoconductors obtained in Examples 68-70 and 68a and Comparative Examples 39 and 40 was incorporated in an image forming machine (IPSiO NX720N made by Ricoh Company, Ltd.) equipped with a contact type roll charging device, an exposing device modified by changing the wavelength of the writing laser beam, a reverse development device and a transfer device. Images were produced at a dark area potential of −950 V and a reverse development bias of −600 V in an ordinary environment (20° C., 50% RH) until the formation of black spots by charge breakdown was observed. The image quality in the initial stage and in the 200,000th print was evaluated and the occurrence of discharge breakdown was checked to give the results shown in Table 15.

TABLE 15

| Example | Initial Image | Charging breakdown | Image of 200,000th Print |
|---|---|---|---|
| 68 | A | Not occurred in 200,000th print | A |
| 69 | A | Occurred in 160,000th print | — |
| 70 | A | Occurred in 170,000th print | — |
| 68a | A | Not occurred in 200,000th print | A* |
| Comp. 39 | D | Occurred in 80,000th print | — |

TABLE 15-continued

| Example | Initial Image | Charging breakdown | Image of 200,000th Print |
|---|---|---|---|
| Comp. 40 | D | Occurred in 100,000th print | — |

A*: Good up to 100,000 prints. But reduction of image density was observed in the 200,000th print.

As will be appreciated from the results shown in Table 15, the electrophotographic photoconductors according to the present invention gives under good images for a long period of service and has good durability.

EXAMPLE 71

150 Parts of an alkyd resin (Beckozol 1307-60EL, made by Dainippon Ink & Chemicals, Inc.) and 100 parts of a melamine resin (Super Beckamine G-821-60, made by Dainippon Ink & Chemicals, Inc., solid content: 60% by weight) were dissolved in 500 parts of methyl ethyl ketone, in which 20.0 parts of polyethyleneglycol monoalkyl ether (Emulmin 180 manufactured by Sanyo Chemical Industries, Ltd.) were further dissolved. To the solution were added 600 parts of a titanium oxide powder (TA-300 made by Fuji Titanium Kogyo Co., Ltd., non-surface treated product). The mixture was dispersed in a ball mill containing alumina balls for 24 hours to prepare a coating liquid for an undercoat layer. The coating liquid was then applied to an aluminum drum having a diameter of 30 mm and a length of 340 mm and the coating was dried at 130° C. for 20 minutes to form an undercoat layer having a thickness of 5.0 μm thereon.

5 Parts of a butyral resin (S-LEC BMS, made by Sekisui Chemical Co., Ltd.) were dissolved in 150 parts of cyclohexanone, to which 15 parts of a charge generating material having a structure represented by the above formula CG-1 were milled in a ball mill containing alumina balls for 72 hours. The ball milling was further continued for 5 hours after addition of 210 parts of cyclohexanone. The milled mixture was diluted with cyclohexanone with stirring until a solid content of 1.0% by weight was reached to obtain a coating liquid for forming a charge generating layer. The thus obtained coating liquid was applied to the aluminum drum on which the undercoat layer had been formed. The coating was dried at 120° C. for 10 minutes to form a charge generating layer having a thickness of about 0.2 μm.

80 Parts of a charge transporting material having a structure represented by the above structural formula CT-2, 100 parts of a polycarbonate resin (Panlite TS2050, made by Teijin Chemicals, Ltd.), 0.4 part of 2,6-di-tert-butyl-4-methylphenol, 0.5 part of distearyl-3,3'-thiopropionate and 0.02 part of a silicone oil (KF-50, made by Shin-Etsu Chemical Co., Ltd.) were dissolved in 770 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 28 μm, thereby obtaining an electrophotographic photoconductor.

EXAMPLE 72

Example 71 was repeated in the same manner as described except that zinc sulfide powder (manufactured by Shimakyu Pharmaceutical Inc.) was substituted for the titanium oxide, thereby obtaining an electrophotographic photoconductor.

EXAMPLE 73

Example 71 was repeated in the same manner as described except that alumina-treated titanium oxide (CR-60 manufactured by Ishihara Sangyo Co., Ltd.) was substituted for the titanium oxide, thereby obtaining an electrophotographic photoconductor.

EXAMPLE 74

Example 71 was repeated in the same manner as described except that 1,3-dioxorane was substituted for the tetrahydrofuran for the formation of the coating liquid for a charge transporting layer, thereby obtaining an electrophotographic photoconductor.

EXAMPLE 75

Example 71 was repeated in the same manner as described except that xylene was substituted for the tetrahydrofuran for the formation of the coating liquid for a charge transporting layer, thereby obtaining an electrophotographic photoconductor.

EXAMPLE 76

Example 71 was repeated in the same manner as described except that toluene was substituted for the tetrahydrofuran for the formation of a coating liquid for a charge transporting layer, thereby obtaining an electrophotographic photoconductor.

EXAMPLE 77

Example 71 was repeated in the same manner as described except that the thickness of the undercoat layer was reduced to 1.8 μm, thereby obtaining an electrophotographic photoconductor.

EXAMPLE 78

Example 71 was repeated in the same manner as described except that the thickness of the charge transporting layer was reduced to 25 μm, thereby obtaining an electrophotographic photoconductor.

COMPARATIVE EXAMPLE 41

Example 71 was repeated in the same manner as described except that the polyethyleneglycol monoalkyl ether was not used at all, thereby obtaining an electrophotographic photoconductor.

COMPARATIVE EXAMPLE 42

Example 71 was repeated in the same manner as described except that dichloromethane was substituted for the tetrahydrofuran for the formation of a coating liquid for a charge transporting layer, thereby obtaining an electrophotographic photoconductor.

COMPARATIVE EXAMPLE 43

Example 71 was repeated in the same manner as described except that dichloromethane was substituted for the cyclohexanone as a diluting solvent for the formation of a coating liquid for a charge generating layer, thereby obtaining an electrophotographic photoconductor.

EXAMPLE 71a

Example 71 was repeated in the same manner as described except that 2,6-di-tert-butyl-4-methylphenol was not used at all, thereby obtaining an electrophotographic photoconductor.

EXAMPLE 71b

Example 71 was repeated in the same manner as described except that distearyl-3,3'-thiopropionate was not used at all, thereby obtaining an electrophotographic photoconductor.

EXAMPLE 71c

Example 71 was repeated in the same manner as described except that neither 2,6-di-tert-butyl-4-methylphenol nor distearyl-3,3'-thiopropionate was used at all, thereby obtaining an electrophotographic photoconductor.

Each of the photoconductors obtained in Examples 71-78, Comparative Examples 41-43 and Examples 71a-71c was incorporated in a laser printer (SP-90 made by Ricoh Company, Ltd.) equipped with a non-contact type corona charging device, a laser image exposing device, a reverse development device and a transfer device. Solid and halftone images were repeatedly produced at a dark area potential of −800 V and a reverse development bias of −600V to obtain-200,000 prints in three different conditions of (a) ordinary environment (20° C., 50% relative humidity), low temperature and low humidity environment (12° C., 15% relative humidity) and high temperature and high humidity environment (32° C., 85 relative humidity). The results of the valuation of the initial image and the image of the 200,000th print are summarized in Table 16.

TABLE 16

| | Initial Image | | | Image of 200,000th print | | |
|---|---|---|---|---|---|---|
| Example | 20° C./ 50% RH | 12° C./ 15% RH | 32° C./ 85% RH | 20° C./ 50% RH | 12° C./ 15% RH | 32° C./ 85% RH |
| 71 | B1 | B1 | B1 | A | A | A |
| 72 | A | A | A | B1 | C1 | C1 |
| 73 | A | A | A | A | B3 | B3 |
| 74 | A | A | A | A | A | A |
| 75 | A | A | A | A | A | A |
| 76 | A | A | A | A | A | A |
| 77 | A | A | A | B2 | B2 | B2 |
| 78 | A | A | A | B2 | B2 | B2 |
| Comp. 41 | D | D | D | — | — | — |
| Comp. 42 | D | D | D | — | — | — |
| Comp. 43 | D | D | D | — | — | — |
| 71a | A | A | A | A* | A* | A* |
| 72b | A | A | A | A* | A* | A* |
| 73c | A | A | A | A* | A* | A* |

A*: Good up to 100,000 prints. But reduction of image density was observed in the 200,000th print.

As will be appreciated from the results shown in Table 16, the electrophotographic photoconductors according to the present invention gives under good images for a long period of service without depending upon environments under which the images are formed.

EXAMPLE 79

125 Parts of an alkyd resin (Beckozol 1307-60EL, made by Dainippon Ink & Chemicals, Inc.) and 125 parts of a melamine resin (Super Beckamine G-821-60, made by Dainippon Ink & Chemicals, Inc., solid content: 60% by weight) were dissolved in 500 parts of methyl ethyl ketone, in which 7.0 parts of polypropyleneglycol monoalkyl ether (Newpole LB300X manufactured by Sanyo Chemical Industries, Ltd.) were further dissolved. To the solution were added 570 parts of a titanium oxide powder (CR-EL-made by Ishihara Sangyo Co., Ltd., non-surface treated product). The mixture was dispersed in a ball mill containing alumina balls for 30 hours to prepare a coating liquid for an undercoat layer. The coating liquid was then applied to an aluminum drum having a diameter of 30 mm and a length of 340 mm and the coating was dried at 135° C. for 20 minutes to form an undercoat layer having a thickness of 6.0 μm thereon.

18 Parts of A-type titanylphthalocyanin pigment were placed in a glass pot together with zirconia beads having a diameter of 2 mm, to which 350 parts of methyl ethyl ketone were further added. The mixture was then milled for 15 hours. To the milled mixture, a solution obtained by dissolving 10 parts of a butyral resin (S-LEC BX, made by Sekisui Chemical Co., Ltd.) in 600 parts of methyl ethyl ketone was added. The mixture was then milled for 2 hours to obtain a coating liquid for forming a charge generating layer. The thus obtained coating liquid was applied to the aluminum drum on which the undercoat layer had been formed. The coating was dried at 70° C. for 20 minutes to form a charge generating layer having a thickness of about 0.3 μm.

90 Parts of a charge transporting material having a structure represented by the above structural formula CT-3, 100 parts of a polycarbonate resin (Panlite L-1250, made by Teijin Chemicals, Ltd.), 0.5 part of 2,6-di-tert-butyl-4-methoxylphenol, 1 part of dimethyl-3,3'-thiopropionate and 0.02 part of a silicone oil (KF-50, made by Shin-Etsu Chemical Co., Ltd.) were dissolved in 300 parts of 1,3-dioxorane and 450 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 31 μm, thereby obtaining an electrophotographic photoconductor.

EXAMPLE 80

Example 79 was repeated in the same manner as described except that the thickness of the undercoat layer was reduced to 3.5 μm, thereby obtaining an electrophotographic photoconductor.

EXAMPLE 81

Example 79 was repeated in the same manner as described except that the thickness of the charge transporting layer was reduced to 26 μm, thereby obtaining an electrophotographic photoconductor.

COMPARATIVE EXAMPLE 44

Example 79 was repeated in the same manner as described except that the polypropyleneglycol monoalkyl ether was not used at all, thereby obtaining an electrophotographic photoconductor.

COMPARATIVE EXAMPLE 45

Example 79 was repeated in the same manner as described except that dichloromethane was substituted for the mixed solvent of 1,3-dioxorane and tetrahydrofuran for the formation of a coating liquid for a charge transporting-layer, thereby obtaining an electrophotographic photoconductor.

COMPARATIVE EXAMPLE 46

Example 79 was repeated in the same manner as described except that a mixed solvent composed of 200 parts of methyl ethyl ketone and 400 parts of dichloromethane was substituted for the solvent (methyl ethyl ketone) for the formation of a coating liquid for a charge generating layer, thereby obtaining an electrophotographic photoconductor.

EXAMPLE 79a

Example 79 was repeated in the same manner as described except that 2,6-di-tert-butyl-4-methoxylphenol was not used at all, thereby obtaining an electrophotographic photoconductor.

EXAMPLE 79b

Example 79 was repeated in the same manner as described except that dimethyl-3,3'-thiopropionate was not used at all, thereby obtaining an electrophotographic photoconductor.

EXAMPLE 79c

Example 79 was repeated in the same manner as described except that neither 2,6-di-tert-butyl-4-methoxylphenol nor dimethyl-3,3'-thiopropionate was used at all, thereby obtaining an electrophotographic photoconductor.

Each of the photoconductors obtained in Examples 79-81, Comparative Examples 44-46 and Examples 79a-79c was incorporated in a digital copying machine (IMAGIO MF2200 made by Ricoh Company, Ltd.) equipped with a contact type roll charging device, an exposing device, a reverse development device and a transfer device. Solid and halftone images were repeatedly produced at a dark area potential of −600 V and a reverse development bias of −400V in an ordinary environment (20° C., 50% relative humidity) to obtain 300,000 copies. The results of the valuation of the initial image and the image of the 300,000th copy are summarized in Table 17.

TABLE 17

| Example | Initial Image 20° C./50% RH | Image of 300,000th copy 20° C./50% RH |
|---|---|---|
| 79 | A | A |
| 80 | A | B2 |
| 81 | A | B2 |
| Comp. 44 | D | — |
| Comp. 45 | D | — |
| Comp. 46 | D | — |
| 79a | A | A* |
| 79b | A | A* |
| 79c | A | A* |

A*: Good up to 150,000th copy. But reduction of image density was observed in the 300,000th copy.

As will be appreciated from the results shown in Table 17, the electrophotographic photoconductors according to the present invention gives under good images for a long period of service.

EXAMPLE 82

125 Parts-of an alkyd resin (Beckozol 1307-60EL, made by Dainippon Ink & Chemicals, Inc.) and 125 parts of a melamine resin (Super Beckamine G-821-60, made by Dainippon Ink & Chemicals, Inc., solid content: 60% by weight) were dissolved in 500 parts of methyl ethyl ketone, in which 7.0 parts of polyethyleneglycol monoalkyl ether (Nonion K-220 manufactured by Nippon Yushi Co., Ltd.) were further dissolved. To the solution were added 570 parts of a titanium oxide powder (CR-EL made by Ishihara Sangyo Co., Ltd., non-surface treated product). The mixture was dispersed in a ball mill containing alumina balls for 30 hours to prepare a coating liquid for an undercoat layer. The coating liquid was then applied to an aluminum drum having a diameter of 30 mm and a length of 340 mm and the coating was dried at 135° C. for 20 minutes to form an undercoat layer having a thickness of 6.0 μm thereon.

60 Parts of a charge generating material represented by the above formula CG-4 and 330 parts of methyl ethyl ketone were milled for 200 hours, to which a solution obtained by dissolving 10 parts of a polyvinylbutyral resin (S-LEC BL-1, made by Sekisui Chemical Co., Ltd.) in 400 parts of methyl ethyl ketone and 1,850 parts of cyclohexanone was added. The mixture was then milled for 5 hours to obtain a coating liquid for forming a charge generating layer. The thus obtained coating liquid was applied to the aluminum drum on which the undercoat layer had been formed. The coating was dried at 130° C. for 20 minutes to form a charge generating layer having a thickness of about 0.5 μm.

70 Parts of a charge transporting material having a structure represented by the above formula (CT-2), 100 parts of a polycarbonate resin (Panlite L-2050, made by Teijin Chemicals, Ltd.), 0.1 part of 2,4-dimethyl-6-tert-butylphenol, 0.5 part of dimyristyl-3,3'-thiopropionate and 0.02 part of a silicone oil (KF-50, made by Shin-Etsu Chemical Co., Ltd.) were dissolved in 200 parts of 1,3-dioxorane and 550 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a-thickness of about 29 μm, thereby obtaining an electrophotographic photoconductor.

EXAMPLE 83

Example 82 was repeated in the same manner as described except that the thickness of the undercoat layer was reduced to 2 μm, thereby obtaining an electrophotographic photoconductor.

EXAMPLE 84

Example 82 was repeated in the same manner as described except that the thickness of the charge transporting layer was reduced to 25 μm, thereby obtaining an electrophotographic photoconductor.

EXAMPLE 82a

Example 82 was repeated in the same manner as described except that neither 2,4-dimethyl-6-tert-butylphenol nor dimyristyl-3,3'-thiopropionate was used at all, thereby obtaining an electrophotographic photoconductor.

COMPARATIVE EXAMPLE 47

Example 83 was repeated in the same manner as described except that the polyethyleneglycol monoalkyl ether was not used for the formation of the undercoat layer and that neither 2,4-dimethyl-6-tert-butylphenol nor dimyristyl-3,3'-thiopropionate was used in the charge transporting layer, thereby obtaining an electrophotographic photoconductor.

COMPARATIVE EXAMPLE 48

Example 84 was repeated in the same manner as described except that the polyethyleneglycol monoalkyl ether was not used for the formation of the undercoat layer and that neither 2,4-dimethyl-6-tert-butylphenol nor dimyristyl-3,3'-thiopropionate was used in the charge transporting layer, thereby obtaining an electrophotographic photoconductor.

Each of the photoconductors obtained in Examples 82-84 and 82a and Comparative Examples 47 and 48 was incorporated in an image forming machine (IPSiO NX720N made by Ricoh Company, Ltd.) equipped with a contact type roll charging device, an exposing device modified by changing the wavelength of the writing laser beam, a reverse development device and a transfer device. Images were produced at a dark area potential of −950 V and a reverse development bias of −600 V in an ordinary environment (20° C., 50% RH) until the formation of black spots by charge breakdown was observed. The image quality in the initial stage and in the 200,000th print was evaluated and the occurrence of discharge breakdown was checked to give the results shown in Table 18.

TABLE 18

| Example | Initial Image | Charging breakdown | Image of 200,000th Print |
|---|---|---|---|
| 82 | A | Not occurred in 200,000th print | A |
| 83 | A | Occurred in 160,000th print | — |
| 84 | A | Occurred in 170,000th print | — |
| 82a | A | Not occurred in 200,000th print | A* |
| Comp. 47 | D | Occurred in 80,000th print | — |
| Comp. 48 | D | Occurred in 100,000th print | — |

A*: Good up to 100,000 prints. But reduction of image density was observed in the 200,000th print.

As will be appreciated from the results shown in Table 18, the electrophotographic photoconductors according to the present invention gives under good images for a long period of service and has good durability.

EXAMPLE 85

150 Parts of an alkyd resin (Beckozol 1307-60EL, made by Dainippon Ink & Chemicals, Inc.) and 100 parts of a melamine resin (Super Beckamine G-821-60, made by Dainippon Ink & Chemicals, Inc., solid content: 60% by weight) were dissolved in 500 parts of methyl ethyl ketone, in which 20.0 parts of polyethyleneglycol monocarboxylic acid ester (Ionet MO-200 manufactured by Sanyo Chemical Industries, Ltd.) were further dissolved. To the solution were added 600 parts of a titanium oxide powder (TA-300 made by Fuji Titanium Kogyo Co., Ltd., non-surface treated product). The mixture was dispersed in a ball mill containing alumina balls for 24 hours to prepare a coating liquid for an undercoat layer. The coating liquid was then applied to an aluminum drum having a diameter of 30 mm and a length of 340 mm and the coating was dried at 130° C. for 20 minutes to form an undercoat layer having a thickness of 5.0 μm thereon.

5 Parts of a butyral resin (S-LEC BMS, made by Sekisui Chemical Co., Ltd.) were dissolved in 150 parts of cyclohexanone, to which 15 parts of a charge generating material having a structure represented by the above formula CG-1 were milled in a ball mill containing alumina balls for 72 hours. The ball milling was further continued for 5 hours after addition of 210 parts of cyclohexanone. The milled mixture was diluted with cyclohexanone with stirring until a solid content of 1.0% by weight was reached to obtain a coating liquid for forming a charge generating layer. The thus obtained coating liquid was applied to the aluminum drum on which the undercoat layer had been formed. The coating was dried at 120° C. for 10 minutes to form a charge generating layer having a thickness of about 0.2 μm.

80 Parts of a charge transporting material having a structure represented by the above structural formula CT-2, 100 parts of a polycarbonate resin (Panlite TS2050, made by Teijin Chemicals, Ltd.), 0.4 part of 2,6-di-tert-butyl-4-methylphenol, 0.5 part of distearyl-3,3'-thiopropionate and 0.02 part of a silicone oil (KF-50, made by Shin-Etsu Chemical Co., Ltd.) were dissolved in 770 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 28 μm, thereby obtaining an electrophotographic photoconductor.

EXAMPLE 86

Example 85 was repeated in the same manner as described except that zinc sulfide powder (manufactured by Shimakyu Pharmaceutical Inc.) was substituted for the titanium oxide, thereby obtaining an electrophotographic photoconductor.

EXAMPLE 87

Example 85 was repeated in the same manner as described except that alumina-treated titanium oxide (CR-60 manufactured by Ishihara Sangyo Co., Ltd.) was substituted for the titanium oxide, thereby obtaining an electrophotographic photoconductor.

EXAMPLE 88

Example 85 was repeated in the same manner as described except that 1,3-dioxorane was substituted for the tetrahydrofuran for the formation of the coating liquid for a charge transporting layer, thereby obtaining an electrophotographic photoconductor.

EXAMPLE 89

Example 85 was repeated in the same manner as described except that xylene was substituted for the tetrahydrofuran for the formation of the coating liquid for a charge transporting layer, thereby obtaining an electrophotographic photoconductor.

EXAMPLE 90

Example 85 was repeated in the same manner as described except that toluene was substituted for the tetrahydrofuran for the formation of a coating liquid for a charge transporting layer, thereby obtaining an electrophotographic photoconductor.

EXAMPLE 91

Example 85 was repeated in the same manner as described except that the thickness of the undercoat layer was reduced to 1.8 μm, thereby obtaining an electrophotographic photoconductor.

EXAMPLE 92

Example 85 was repeated in the same manner as described except that the thickness of the charge transporting layer was reduced to 25 μm, thereby obtaining an electrophotographic photoconductor.

COMPARATIVE EXAMPLE 49

Example 85 was repeated in the same manner as described except that the polyethyleneglycol monocarboxylic acid ester was not used at all, thereby obtaining an electrophotographic photoconductor.

COMPARATIVE EXAMPLE 50

Example 85 was repeated in the same manner as described except that dichloromethane was substituted for the tetrahydrofuran for the formation of a coating liquid for a charge transporting layer, thereby obtaining an electrophotographic photoconductor.

COMPARATIVE EXAMPLE 51

Example 85 was repeated in the same manner as described except that dichloromethane was substituted for the cyclohexanone as a diluting solvent for the formation of a coating liquid for a charge generating layer, thereby obtaining an electrophotographic photoconductor.

EXAMPLE 85a

Example 85 was repeated in the same manner as described except that 2,6-di-tert-butyl-4-methylphenol was not used at all, thereby obtaining an electrophotographic photoconductor.

EXAMPLE 85b

Example 71 was repeated in the same manner as described except that distearyl-3,3'-thiopropionate was not used at all, thereby obtaining an electrophotographic photoconductor.

EXAMPLE 85c

Example 85 was repeated in the same manner as described except that neither 2,6-di-tert-butyl-4-methylphenol nor distearyl-3,3'-thiopropionate was used at all, thereby obtaining an electrophotographic photoconductor.

Each of the photoconductors obtained in Examples 85-92, Comparative Examples 49-51 and Examples 85a-85c was incorporated in a laser printer (SP-90 made by Ricoh Company, Ltd.) equipped with a non-contact type corona charging device, a laser image exposing device, a reverse development device and a transfer device. Solid and halftone images were repeatedly produced at a dark area potential of −800 V and a reverse development bias of −600V to obtain 200,000 prints in three different conditions of (a) ordinary environment (20° C., 50% relative humidity), low temperature and low humidity environment (12° C., 15% relative humidity) and high temperature and high humidity environment (32° C., 85 relative humidity). The results of the valuation of the initial image and the image of the 200,000th print are summarized in Table 19.

TABLE 19

| | Initial Image | | | Image of 200,000th print | | |
|---|---|---|---|---|---|---|
| Example | 20° C./ 50% RH | 12° C./ 15% RH | 32° C./ 85% RH | 20° C./ 50% RH | 12° C./ 15% RH | 32° C./ 85% RH |
| 85 | B1 | B1 | B1 | A | A | A |
| 86 | A | A | A | B1 | C1 | C1 |
| 87 | A | A | A | A | B3 | B3 |
| 88 | A | A | A | A | A | A |
| 89 | A | A | A | A | A | A |
| 90 | A | A | A | A | A | A |
| 91 | A | A | A | B2 | B2 | B2 |
| 92 | A | A | A | B2 | B2 | B2 |
| Comp. 49 | D | D | D | — | — | — |
| Comp. 50 | D | D | D | — | — | — |
| Comp. 51 | D | D | D | — | — | — |
| 85a | A | A | A | A* | A* | A* |
| 85b | A | A | A | A* | A* | A* |
| 85c | A | A | A | A* | A* | A* |

A*: Good up to 100,000 prints. But reduction of image density was observed in the 200,000th print.

As will be appreciated from the results shown in Table 19, the electrophotographic photoconductors according to the present invention gives under good images for a long period of service without depending upon environments under which the images are formed.

EXAMPLE 93

125 Parts of an alkyd resin (Beckozol 1307-60EL, made by Dainippon Ink & Chemicals, Inc.) and 125 parts of a melamine resin (Super Beckamine G-821-60, made by Dainippon Ink & Chemicals, Inc., solid content: 60% by weight) were dissolved in 500 parts of methyl ethyl ketone, in which 12.5 parts of polyethyleneglycol dicarboxylic acid ester (Ionet DS-400 manufactured by Sanyo Chemical Industries, Ltd.) were further dissolved. To the solution were added 570 parts of a titanium oxide powder (CR-EL made by Ishihara Sangyo Co., Ltd., non-surface treated product). The mixture was dispersed in a ball mill containing alumina balls for 30 hours to prepare a coating liquid for an undercoat layer. The coating liquid was then applied to an aluminum drum having a diameter of 30 mm and a length of 340 mm and the coating was dried at 135° C. for 20 minutes to form an undercoat layer having a thickness of 6.0 μm thereon.

18 Parts of A-type titanylphthalocyanin pigment were placed in a glass pot together with zirconia beads having a diameter of 2 mm, to which 350 parts of methyl ethyl ketone were further added. The mixture was then milled for 15 hours. To the milled mixture, a solution obtained by dissolving 10 parts of a butyral resin (S-LEC BX, made by Sekisui Chemical Co., Ltd.) in 600 parts of methyl ethyl ketone was added. The mixture was then milled for 2 hours to obtain a coating liquid for forming a charge generating layer. The thus obtained coating liquid was applied to the aluminum drum on which the undercoat layer had been formed. The coating was dried at 70° C. for 20 minutes to form a charge generating layer having a thickness of about 0.3 μm.

90 Parts of a charge transporting material having a structure represented by the above structural formula CT-3, 100 parts of a polycarbonate resin (Panlite L-1250, made by Teijin Chemicals, Ltd.), 0.5 part of 2,6-di-tert-butyl-4-methoxylphenol, 1 part of dimethyl-3,3'-thiopropionate and 0.02 part of a silicone oil (KF-50, made by Shin-Etsu Chemical Co., Ltd.) were dissolved in 300 parts of 1,3-dioxorane and 450 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 31 μm, thereby obtaining an electrophotographic photoconductor.

EXAMPLE 94

Example 93 was repeated in the same manner as described except that the thickness of the undercoat layer was reduced to 3.5 μm, thereby obtaining an electrophotographic photoconductor.

EXAMPLE 95

Example 93 was repeated in the same manner as described except that the thickness of the charge transporting layer was reduced to 26 μm, thereby obtaining an electrophotographic photoconductor.

COMPARATIVE EXAMPLE 52

Example 93 was repeated in the same manner as described except that the polyethyleneglycol dicarboxylic acid ester was not used at all, thereby obtaining an electrophotographic photoconductor.

COMPARATIVE EXAMPLE 53

Example 93 was repeated in the same manner as described except that dichloromethane was substituted for the mixed solvent of 1,3-dioxorane and tetrahydrofuran for the formation of a coating liquid for a charge transporting layer, thereby obtaining an electrophotographic photoconductor.

COMPARATIVE EXAMPLE 54

Example 93 was repeated in the same manner as described except that a mixed solvent composed of 200 parts of methyl ethyl ketone and 400 parts of dichloromethane was substituted for the solvent (methyl ethyl ketone) for the formation of a coating liquid for a charge generating layer, thereby obtaining an electrophotographic photoconductor.

EXAMPLE 93a

Example 93 was repeated in the same manner as described except that 2,6-di-tert-butyl-4-methoxylphenol was not used at all, thereby obtaining an electrophotographic photoconductor.

EXAMPLE 93b

Example 93 was repeated in the same manner as described except that dimethyl-3,3'-thiopropionate was not used at all, thereby obtaining an electrophotographic photoconductor.

EXAMPLE 93c

Example 93 was repeated in the same manner as described except that neither 2,6-di-tert-butyl-4-methoxylphenol nor dimethyl-3,3'-thiopropionate was used at all, thereby obtaining an electrophotographic photoconductor.

Each of the photoconductors obtained in Examples 93-95, Comparative Examples 52-54 and Examples-93a-93c was incorporated in a digital copying machine (IMAGIO MF2200 made by Ricoh Company, Ltd.) equipped with a contact type roll charging device, an exposing device, a reverse development device and a transfer device. Solid and halftone images were repeatedly produced at a dark area potential of −600 V and a reverse development bias of −400V in an ordinary environment (20° C., 50% relative humidity) to obtain 300,000 copies. The results of the valuation of the initial image and the image of the 300,000th copy are summarized in Table 20.

TABLE 20

| Example | Initial Image 20° C./50% RH | Image of 300,000th copy 20° C./50% RH |
|---|---|---|
| 93 | A | A |
| 94 | A | B2 |
| 95 | A | B2 |
| Comp. 52 | D | — |
| Comp. 53 | D | — |
| Comp. 54 | D | — |
| 93a | A | A* |
| 93b | A | A* |
| 93c | A | A* |

A*: Good up to 150,000th copy. But reduction of image density was observed in the 300,000th copy.

As will be appreciated from the results shown in Table 20, the electrophotographic photoconductors according to the present invention gives under good images for a long period of service.

EXAMPLE 96

125 Parts of an alkyd resin (Beckozol 1307-60EL, made by Dainippon Ink & Chemicals, Inc.) and 125 parts of a melamine resin (Super Beckamine G-821-60, made by Dainippon Ink & Chemicals, Inc., solid content: 60% by weight) were dissolved in 500 parts of methyl ethyl ketone, in which 12.5 parts of polyethyleneglycol distearate (Nonion DS-60HN manufactured by Nippon Yushi Co., Ltd.) were further dissolved. To the solution were added 570 parts of a titanium oxide powder (CR-EL made by Ishihara Sangyo Co., Ltd., non-surface treated product). The mixture was dispersed in a ball mill containing alumina balls for 30 hours to prepare a coating liquid for an undercoat layer. The coating liquid was then applied to an aluminum drum having a diameter of 30 mm and a length of 340 mm and the coating was dried at 135° C. for 20 minutes to form an undercoat layer having a thickness of 6.0 μm thereon.

60 Parts of a charge generating material represented by the above formula CG-4 and 330 parts of methyl ethyl ketone were milled for 200 hours, to which a solution obtained by dissolving 10 parts of a polyvinylbutyral resin (S-LEC BL-1, made by Sekisui Chemical Co., Ltd.) in 400 parts of methyl ethyl ketone and 1,850 parts of cyclohexanone was added. The mixture was then milled for 5 hours to obtain a coating liquid for forming a charge generating layer. The thus obtained coating liquid was applied to the aluminum drum on which the undercoat layer had been formed. The coating was dried at 130° C. for 20 minutes to form a charge generating layer having a thickness of about 0.5 μm.

70 Parts of a charge transporting material having a structure represented by the above formula (CT-2), 100 parts of a polycarbonate resin (Panlite L-2050, made by Teijin Chemicals, Ltd.), 0.1 part of 2,4-dimethyl-6-tert-butylphenol, 0.5 part of dimyristyl-3,3'-thiopropionate and 0.02 part of a silicone oil (KF-50, made by Shin-Etsu Chemical Co., Ltd.) were dissolved in 200 parts of 1,3-dioxorane and 550 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 29 μm, thereby obtaining an electrophotographic photoconductor.

EXAMPLE 97

Example 96 was repeated in the same manner as described except that the thickness of the undercoat layer was reduced to 2 μm, thereby obtaining an electrophotographic photoconductor.

EXAMPLE 98

Example 96 was repeated in the same manner as described except that the thickness of the charge transporting layer was reduced to 25 μm, thereby obtaining an electrophotographic photoconductor.

EXAMPLE 96a

Example 96 was repeated in the same manner as described except that neither 2,4-dimethyl-6-tert-butylphenol nor dimyristyl-3,3'-thiopropionate was used at all, thereby obtaining an electrophotographic photoconductor.

COMPARATIVE EXAMPLE 55

Example 97 was repeated in the same manner as described except that the polyethyleneglycol distearate was not used for the formation of the undercoat layer and that neither 2,4-dimethyl-6-tert-butylphenol nor dimyristyl-3,3'-thiopropionate was used in the charge transporting layer, thereby obtaining an electrophotographic photoconductor.

COMPARATIVE EXAMPLE 56

Example 98 was repeated in the same manner as described except that the polyethyleneglycol distearate was not used for the formation of the undercoat layer and that neither 2,4-dimethyl-6-tert-butylphenol nor dimyristyl-3,3'-thiopropionate was used in the charge transporting layer, thereby obtaining an electrophotographic photoconductor.

Each of the photoconductors obtained in Examples 96-98 and 96a and Comparative Examples 55 and 56 was incorporated in an image forming machine (IPSiO NX720N made by Ricoh Company, Ltd.) equipped with a contact type roll charging device, an exposing device modified by changing the wavelength of the writing laser beam, a reverse development device and a transfer device. Images were produced at a dark area potential of −950 V and a reverse development bias of −600 V in an ordinary environment (20° C., 50% RH) until the formation of black spots by charge breakdown was observed. The image quality in the initial stage and in the 200,000th print was evaluated and the occurrence of discharge breakdown was checked to give the results shown in Table 21.

TABLE 21

| Example | Initial Image | Charging breakdown | Image of 200,000th Print |
|---|---|---|---|
| 96 | A | Not occurred in 200,000th print | A |
| 97 | A | Occurred in 160,000th print | — |
| 98 | A | Occurred in 170,000th print | — |
| 96a | A | Not occurred in 200,000th print | A* |
| Comp. 55 | D | Occurred in 80,000th print | — |
| Comp. 56 | D | Occurred in 100,000th print | — |

A*: Good up to 100,000 prints. But reduction of image density was observed in the 200,000th print.

As will be appreciated from the results shown in Table 21, the electrophotographic photoconductors according to the present invention gives under good images for a long period of service and has good durability.

EXAMPLE 99

150 Parts of an alkyd resin (Beckozol 1307-60EL, made by Dainippon Ink & Chemicals, Inc.) and 100 parts of a melamine resin (Super Beckamine G-821-60, made by Dainippon Ink & Chemicals, Inc., solid content: 60% by weight) were dissolved in 500 parts of methyl ethyl ketone, in which 6.0 parts of oxyethylene-oxypropylene copolymer (Newpole PE-88 manufactured by Sanyo Chemical Industries, Ltd.) were further dissolved. To the solution were added 600 parts of a titanium oxide powder (CR-EL made by Ishihara Sangyo Co., Ltd., non-surface treated product). The mixture was dispersed in a ball mill containing alumina balls for 24 hours to prepare a coating liquid for an undercoat layer. The coating liquid was then applied to an aluminum drum having a diameter of 30 mm and a length of 340 mm and the coating was dried at 130° C. for 20 minutes to form an undercoat layer having a thickness of 5.0 μm thereon.

5 Parts of a butyral resin (S-LEC BMS, made by Sekisui Chemical Co., Ltd.) were dissolved in 150 parts of cyclohexanone, to which 15 parts of a charge generating material having a structure represented by the above formula CG-1 were milled in a ball mill containing alumina balls for 72 hours. The ball milling was further continued for 5 hours after addition of 210 parts of cyclohexanone. The milled mixture was diluted with cyclohexanone with stirring until a solid content of 1.0% by weight was reached to obtain a coating liquid for forming a charge generating layer. The thus obtained coating liquid was applied to the aluminum drum on which the undercoat layer had been formed. The coating was dried at 120° C. for 10 minutes to form a charge generating layer having a thickness of about 0.2 μm.

80 Parts of a charge transporting material having a structure represented by the above structural formula CT-2, 100 parts of a polycarbonate resin (Panlite TS2050, made by Teijin Chemicals, Ltd.), 0.4 part of 2,6-di-tert-butyl-4-methylphenol, 0.5 part of distearyl-3,3'-thiopropionate and 0.02 part of a silicone oil (KF-50, made by Shin-Etsu Chemical Co., Ltd.) were dissolved in 770 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 28 μm, thereby obtaining an electrophotographic photoconductor.

EXAMPLE 100

Example 99 was repeated in the same manner as described except that zinc sulfide powder (manufactured by Shimakyu Pharmaceutical Inc.) was substituted for the titanium oxide, thereby obtaining an electrophotographic photoconductor.

EXAMPLE 101

Example 99 was repeated in the same manner as described except that alumina-treated titanium oxide (CR-60 manufactured by Ishihara Sangyo Co., Ltd.) was substituted for the titanium oxide, thereby obtaining an electrophotographic photoconductor.

EXAMPLE 102

Example 99 was repeated in the same manner as described except that 1,3-dioxorane was substituted for the tetrahydrofuran for the formation of the coating liquid for a charge transporting layer, thereby obtaining an electrophotographic photoconductor.

EXAMPLE 103

Example 99 was repeated in the same manner as described except that xylene was substituted for the tetrahydrofuran for the formation of the coating liquid for a charge transporting layer, thereby obtaining an electrophotographic photoconductor.

EXAMPLE 104

Example 99 was repeated in the same manner as described except that toluene was substituted for the tetrahydrofuran for the formation of a coating liquid for a charge transporting layer, thereby obtaining an electrophotographic photoconductor.

EXAMPLE 105

Example 99 was repeated in the same manner as described except that the thickness of the undercoat layer was reduced to 1.8 μm, thereby obtaining an electrophotographic photoconductor.

EXAMPLE 106

Example 99 was repeated in the same manner as described except that the thickness of the charge transporting layer was reduced to 25 μm, thereby obtaining an electrophotographic photoconductor.

COMPARATIVE EXAMPLE 57

Example 99 was repeated in the same manner as described except that the oxyethylene-oxypropylene copolymer was not used at all, thereby obtaining an electrophotographic photoconductor.

COMPARATIVE EXAMPLE 58

Example 99 was repeated in the same manner as described except that dichloromethane was substituted for the tetrahydrofuran for the formation of a coating liquid for a charge transporting layer, thereby obtaining an electrophotographic photoconductor.

COMPARATIVE EXAMPLE 59

Example 99 was repeated in the same manner as described except that dichloromethane was substituted for the cyclohexanone as a diluting solvent for the formation of a coating liquid for a charge generating layer, thereby obtaining an electrophotographic photoconductor.

EXAMPLE 99a

Example 99 was repeated in the same manner as described except that 2,6-di-tert-butyl-4-methylphenol was not used at all, thereby obtaining an electrophotographic photoconductor.

EXAMPLE 99b

Example 99 was repeated in the same manner as described except that distearyl-3,3'-thiopropionate was not used at all, thereby obtaining an electrophotographic photoconductor.

EXAMPLE 99c

Example 99 was repeated in the same manner as described except that neither 2,6-di-tert-butyl-4-methylphenol nor distearyl-3,3'-thiopropionate was used at all, thereby obtaining an electrophotographic photoconductor.

Each of the photoconductors obtained in Examples 99-106, Comparative Examples 57-59 and Examples 99a-99c was incorporated in a laser printer (SP-90 made by Ricoh Company, Ltd.) equipped with a non-contact type corona charging device, a laser image exposing device, a reverse development device and a transfer device. Solid and halftone images were repeatedly produced at a dark area potential of −800 V and a reverse development bias of −600V to obtain 200,000 prints in three different conditions of (a) ordinary environment (20° C., 50% relative humidity), low temperature and low humidity environment (12° C., 15% relative humidity) and high temperature and high humidity environment (32° C., 85 relative humidity). The results of the valuation of the initial image and the image of the 200,000th print are summarized in Table 22.

TABLE 22

| | Initial Image | | | Image of 200,000th print | | |
|---|---|---|---|---|---|---|
| Example | 20° C./ 50% RH | 12° C./ 15% RH | 32° C./ 85% RH | 20° C./ 50% RH | 12° C./ 15% RH | 32° C./ 85% RH |
| 99 | B1 | B1 | B1 | A | A | A |
| 100 | A | A | A | B1 | C1 | C1 |
| 101 | A | A | A | A | B3 | B3 |
| 102 | A | A | A | A | A | A |
| 103 | A | A | A | A | A | A |
| 104 | A | A | A | A | A | A |
| 105 | A | A | A | B2 | B2 | B2 |
| 106 | A | A | A | B2 | B2 | B2 |
| Comp. 57 | D | D | D | — | — | — |
| Comp. 58 | D | D | D | — | — | — |
| Comp. 59 | D | D | D | — | — | — |

TABLE 22-continued

| Example | Initial Image | | | Image of 200,000th print | | |
|---|---|---|---|---|---|---|
| | 20° C./ 50% RH | 12° C./ 15% RH | 32° C./ 85% RH | 20° C./ 50% RH | 12° C./ 15% RH | 32° C./ 85% RH |
| 99a | A | A | A | A* | A* | A* |
| 99b | A | A | A | A* | A* | A* |
| 99c | A | A | A | A* | A* | A* |

A*: Good up to 100,000 prints. But reduction of image density was observed in the 200,000th print.

As will be appreciated from the results shown in Table 19, the electrophotographic photoconductors according to the present invention gives under good images for a long period of service without depending upon environments under which the images are formed.

EXAMPLE 107

125 Parts of an alkyd resin (Beckozol 1307-60EL, made by Dainippon Ink & Chemicals, Inc.) and 125 parts of a melamine resin (Super Beckamine G-821-60, made by Dainippon Ink & Chemicals, Inc., solid content: 60% by weight) were dissolved in 500 parts of methyl ethyl ketone, in which 12.5 parts of polyethyleneglycol dicarboxylic acid ester (Newpole PE-2700 manufactured by Sanyo Chemical Industries, Ltd.) were further dissolved. To the solution were added 570 parts of a titanium oxide powder (TA-300 made by Fuji Titanium Kogyo Co., Ltd., non-surface treated product). The mixture was dispersed in a ball mill containing alumina balls for 30 hours to prepare a coating liquid for an undercoat layer. The coating liquid was then applied to an aluminum drum having a diameter of 30 mm and a length of 340 mm and the coating was dried at 135° C. for 20 minutes to form an undercoat layer having a thickness of 6.0 μm thereon.

18 Parts of A-type titanylphthalocyanin pigment were placed in a glass pot together with zirconia beads having a diameter of 2 mm, to which 350 parts of methyl ethyl ketone were further added. The mixture was then milled for 15 hours. To the milled mixture, a solution obtained by dissolving 10 parts of a butyral resin (S-LEC BX, made by Sekisui Chemical Co., Ltd.) in 600 parts of methyl ethyl ketone was added. The mixture was then milled for 2 hours to obtain a coating liquid for forming a charge generating layer. The thus obtained coating liquid was applied to the aluminum drum on which the undercoat layer had been formed. The coating was dried at 70° C. for 20 minutes to form a charge generating layer having a thickness of about 0.3 μm.

90 Parts of a charge transporting material having a structure represented by the above structural formula CT-3, 100 parts of a polycarbonate resin (Panlite L-1250, made by Teijin Chemicals, Ltd.), 0.5 part of 2,6-di-tert-butyl-4-methoxylphenol, 1 part of dimethyl-3,3'-thiopropionate and 0.02 part of a silicone oil (KF-50, made by Shin-Etsu Chemical Co., Ltd.) were dissolved in 300 parts of 1,3-dioxorane and 450 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 31 μm, thereby obtaining an electrophotographic photoconductor.

EXAMPLE 108

Example 107 was repeated in the same manner as described except that the thickness of the undercoat layer was reduced to 3.5 μm, thereby obtaining an electrophotographic photoconductor.

EXAMPLE 109

Example 107 was repeated in the same manner as described except that the thickness of the charge transporting layer was reduced to 26 μm, thereby obtaining an electrophotographic photoconductor.

COMPARATIVE EXAMPLE 60

Example 107 was repeated in the same manner as described except that the oxyethylene-oxypropylene copolymer was not used at all, thereby obtaining an electrophotographic photoconductor.

COMPARATIVE EXAMPLE 61

Example 107 was repeated in the same manner as described except that dichloromethane was substituted for the mixed solvent of 1,3-dioxorane and tetrahydrofuran for the formation of a coating liquid for a charge transporting layer, thereby obtaining an electrophotographic photoconductor.

COMPARATIVE EXAMPLE 62

Example 107 was repeated in the same manner as described except that a mixed solvent composed of 200 parts of methyl ethyl ketone and 400 parts of dichloromethane was substituted for the solvent (methyl ethyl ketone) for the formation of a coating liquid for a charge generating layer, thereby obtaining an electrophotographic photoconductor.

EXAMPLE 107a

Example 107 was repeated in the same manner as described except that 2,6-di-tert-butyl-4-methoxylphenol was not used at all, thereby obtaining an electrophotographic photoconductor.

EXAMPLE 107b

Example 107 was repeated in the same manner as described except that dimethyl-3,3'-thiopropionate was not used at all, thereby obtaining an electrophotographic photoconductor.

EXAMPLE 107c

Example 107 was repeated in the same manner as described except that neither 2,6-di-tert-butyl-4-methoxylphenol nor dimethyl-3,3'-thiopropionate was used at all, thereby obtaining an electrophotographic photoconductor.

Each of the photoconductors obtained in Examples 107-109, Comparative Examples 60-62 and Examples 107a-107c was incorporated in a digital copying machine (IMAGIO MF2200 made by Ricoh Company, Ltd.) equipped with a contact type roll charging device, an exposing device, a reverse development device and a transfer device. Solid and halftone images were repeatedly produced at a dark area potential of −600 V and a reverse development bias of −400V in an ordinary environment (20° C., 50% relative humidity) to obtain 300,000 copies. The results of the valuation of the initial image and the image of the 300,000th copy are summarized in Table 23.

TABLE 23

| Example | Initial Image 20° C./50% RH | Image of 300,000th copy 20° C./50% RH |
|---|---|---|
| 107 | A | A |
| 108 | A | B2 |
| 109 | A | B2 |
| Comp. 60 | D | — |
| Comp. 61 | D | — |
| Comp. 62 | D | — |
| 107a | A | A* |
| 107b | A | A* |
| 107c | A | A* |

A*: Good up to 150,000th copy. But reduction of image density was observed in the 300,000th copy.

As will be appreciated from the results shown in Table 23, the electrophotographic photoconductors according to the present invention gives under good images for a long period of service.

EXAMPLE 110

125 Parts of an alkyd resin (Beckozol 1307-60EL, made by Dainippon Ink & Chemicals, Inc.) and 125 parts of a melamine resin (Super Beckamine G-821-60, made by Dainippon Ink & Chemicals, Inc., solid content: 60% by weight) were dissolved in 500 parts of methyl ethyl ketone, in which 12.5 parts of polyethyleneglycol distearate (Pronon 201 manufactured by Nippon Yushi Co., Ltd.) were further dissolved. To the solution were added 570 parts of a titanium oxide powder (CR-EL made by Ishihara Sangyo Co., Ltd., non-surface treated product). The mixture was dispersed in a ball mill containing alumina balls for 30 hours to prepare a coating liquid for an undercoat layer. The coating liquid was then applied to an aluminum drum having a diameter of 30 mm and a length of 340 mm and the coating was dried at 135° C. for 20 minutes to form an undercoat layer having a thickness of 6.0 μm thereon.

60 Parts of a charge generating material represented by the above formula CG-4 and 330 parts of methyl ethyl ketone were milled for 200 hours, to which a solution obtained by dissolving 10 parts of a polyvinylbutyral resin (S-LEC BL-1, made by Sekisui Chemical Co., Ltd.) in 400 parts of methyl ethyl ketone and 1,850 parts of cyclohexanone was added. The mixture was then milled for 5 hours to obtain a coating liquid for forming a charge generating layer. The thus obtained coating liquid was applied to the aluminum drum on which the undercoat layer had been formed. The coating was dried at 130° C. for 20 minutes to form a charge generating layer having a thickness of about 0.5 μm.

70 Parts of a charge transporting material having a structure represented by the above formula (CT-2), 100 parts of a polycarbonate resin (Panlite L-2050, made by Teijin Chemicals, Ltd.), 0.1 part of 2,4-dimethyl-6-tert-butylphenol, 0.5 part of dimyristyl-3,3'-thiopropionate and 0.02 part of a silicone oil (KF-50, made by Shin-Etsu Chemical Co., Ltd.) were dissolved in 200 parts of 1,3-dioxorane and 550 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 20 minutes to form a charge transporting layer having a thickness of about 29 μm, thereby obtaining an electrophotographic photoconductor.

EXAMPLE 111

Example 110 was repeated in the same manner as described except that the thickness of the undercoat layer was reduced to 2 μm, thereby obtaining an electrophotographic photoconductor.

EXAMPLE 112

Example 110 was repeated in the same manner as described except that the thickness of the charge transporting layer was reduced to 25 μm, thereby obtaining an electrophotographic photoconductor.

EXAMPLE 110a

Example 110 was repeated in the same manner as described except that neither 2,4-dimethyl-6-tert-butylphenol nor dimyristyl-3,3'-thiopropionate was used at all, thereby obtaining an electrophotographic photoconductor.

COMPARATIVE EXAMPLE 63

Example 111 was repeated in the same manner as described except that the oxyethylene-oxypropylene copolymer was not used for the formation of the undercoat layer and that neither 2,4-dimethyl-6-tert-butylphenol nor dimyristyl-3,3'-thiopropionate was used in the charge transporting layer, thereby obtaining an electrophotographic photoconductor.

COMPARATIVE EXAMPLE 64

Example 112 was repeated in the same manner as described except that the oxyethylene-oxypropylene copolymer was not used for the formation of the undercoat layer and that neither 2,4-dimethyl-6-tert-butylphenol nor dimyristyl-3,3'-thiopropionate was used in the charge transporting layer, thereby obtaining an electrophotographic photoconductor.

Each of the photoconductors obtained in Examples 110-112 and 110a and Comparative Examples 63 and 64 was incorporated in an image forming machine (IPSiO NX720N made by Ricoh Company, Ltd.) equipped with a contact type roll charging device, an exposing device modified by changing the wavelength of the writing laser beam, a reverse development device and a transfer device. Images were produced at a dark area potential of −950 V and a reverse development bias of −600 V in an ordinary environment (20° C., 50% RH) until the formation of black spots by charge breakdown was observed. The image quality in the initial stage and in the 200,000th print was evaluated and the occurrence of discharge breakdown was checked to give the results shown in Table 24.

TABLE 24

| Example | Initial Image | Charging breakdown | Image of 200,000th Print |
|---|---|---|---|
| 110 | A | Not occurred in 200,000th print | A |
| 111 | A | Occurred in 160,000th print | — |
| 112 | A | Occurred in 170,000th print | — |
| 110a | A | Not occurred in 200,000th print | A* |
| Comp. 63 | D | Occurred in 80,000th print | — |

TABLE 24-continued

| Example | Initial Image | Charging breakdown | Image of 200,000th Print |
|---|---|---|---|
| Comp. 64 | D | Occurred in 100,000th print | — |

A*: Good up to 100,000 prints. But reduction of image density was observed in the 200,000th print.

As will be appreciated from the results shown in Table 24, the electrophotographic photoconductors according to the present invention gives under good images for a long period of service and has good durability.

EXAMPLE 113

160 Parts of an alkyd resin (Beckolite M6401-50, made by Dainippon Ink & Chemicals, Inc., solid content: 50% by weight) and 90 parts of a melamine resin (Super Beckamine G-821-60, made by Dainippon Ink & Chemicals, Inc., solid content: 60% by weight) were dissolved in a mixed solvent composed of 400 parts of methyl ethyl ketone and 100 parts of cyclohexanone, in which 13.0 parts of tetrabenzo-24-crown-8 ether were further dissolved. To the solution were added 600 parts of a titanium oxide powder (CR-EL made by Ishihara Sangyo Co., Ltd., non-surface treated product). The mixture was dispersed in a ball mill containing alumina balls for 72 hours to prepare a coating liquid for an undercoat layer. The coating liquid was then applied to an aluminum drum having a diameter of 30 mm and a length of 340 mm and the coating was dried at 130° C. for 20 minutes to form an undercoat layer having a thickness of 5.0 μm thereon.

5 Parts of a polybutyral resin (XYHL, made by Union Carbide Plastic Co., Ltd.) were dissolved in 150 parts of cyclohexanone, to which 13 parts of a charge generating material having a structure represented by the above formula CG-1 were added and milled in a ball mill containing alumina balls for 72 hours. The ball milling was further continued for 5 hours after addition of 210 parts of cyclohexanone. The milled mixture was diluted with the above mixed solvent with stirring until a solid content of 1.0% by weight was reached to obtain a coating liquid for forming a charge generating layer. The thus obtained coating liquid was applied to the aluminum drum on which the undercoat layer had been formed. The coating was dried at 120° C. for 10 minutes to form a charge generating layer having a thickness of about 0.2 μm.

75 Parts of a charge transporting material having a structure represented by the above structural formula CT-3, 100 parts of a polycarbonate resin (Panlite TS2040, made by Teijin Chemicals, Ltd.), 0.6 part of 2,6-di-tert-butylphenol, 0.7 part of o-thiocresol and 0.02 part of a silicone oil (KF-50, made by Shin-Etsu Chemical Co., Ltd.) were dissolved in 770 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 25 minutes to form a charge transporting layer having a thickness of about 28 μm, thereby obtaining an electrophotographic photoconductor.

EXAMPLE 114

Example 113 was repeated in the same manner as described except that zinc sulfide powder (manufactured by Shimakyu Pharmaceutical Inc.) was substituted for the titanium oxide, thereby obtaining an electrophotographic photoconductor.

EXAMPLE 115

Example 113 was repeated in the same manner as described except that alumina-treated titanium oxide (CR-97 manufactured by Ishihara Sangyo Co., Ltd.) was substituted for the titanium oxide, thereby obtaining an electrophotographic photoconductor.

EXAMPLE 116

Example 113 was repeated in the same manner as described except that 1,3-dioxorane was substituted for the tetrahydrofuran for the formation of the coating liquid for a charge transporting layer, thereby obtaining an electrophotographic photoconductor.

EXAMPLE 117

Example 113 was repeated in the same manner as described except that xylene was substituted for the tetrahydrofuran for the formation of the coating liquid for a charge transporting layer, thereby obtaining an electrophotographic photoconductor.

EXAMPLE 118

Example 113 was repeated in the same manner as described except-that toluene was substituted for the tetrahydrofuran for the formation of a coating liquid for a charge transporting layer, thereby obtaining an electrophotographic photoconductor.

EXAMPLE 119

Example 113 was repeated in the same manner as described except that the thickness of the undercoat layer was reduced to 2.0 μm, thereby obtaining an electrophotographic photoconductor.

EXAMPLE 120

Example 113 was repeated in the same manner as described except that the thickness of the charge transporting layer was reduced to 25 μm, thereby obtaining an electrophotographic photoconductor.

COMPARATIVE EXAMPLE 65

Example 113 was repeated in the same manner as described except that tetrabenzo-24-crown-8 ether was not used at all, thereby obtaining an electrophotographic photoconductor.

COMPARATIVE EXAMPLE 66

Example 113 was repeated in the same manner as described except that dichloromethane was substituted for the tetrahydrofuran for the formation of a coating liquid for a charge transporting layer, thereby obtaining an electrophotographic photoconductor.

COMPARATIVE EXAMPLE 67

Example 113 was repeated in the same manner as described except that dichloromethane was substituted for the mixed solvent as a diluting solvent for the formation of a coating liquid for a charge generating layer, thereby obtaining an electrophotographic photoconductor.

EXAMPLE 113a

Example 113 was repeated in the same manner as described except that 2,6-di-tert-butylphenol was not used at all, thereby obtaining an electrophotographic photoconductor.

EXAMPLE 113b

Example 113 was repeated in the same manner as described except that o-thiocresol was not used at all, thereby obtaining an electrophotographic photoconductor.

EXAMPLE 113c

Example 113 was repeated in the same manner as described except that neither 2,6-di-tert-butylphenol nor o-thiocresol was used at all, thereby obtaining an electrophotographic photoconductor.

Each of the photoconductors obtained in Examples 113-120 and 113a-113c and Comparative Examples 65-67 was incorporated in a laser printer (IPSiO NX700 made by Ricoh Company, Ltd.) having detachably mounted thereon a process cartridge including a photoconductor, a contact type roll charging device, a reverse development device and a cleaning blade. Images were repeatedly produced at a dark area potential of −700 V and a reverse development bias of −450 V in an ordinary environment (20° C., 50% RH) to obtain 50,000 prints. The image quality in the initial stage and in the 50,000th print was evaluated to give the results shown in Table 25.

TABLE 25

| Example | Initial Image | Image of 5,000th Print |
|---|---|---|
| 113 | A | A |
| 114 | B1 | B1 |
| 115 | A | A |
| 116 | A | A |
| 117 | A | A |
| 118 | A | A |
| 119 | A | B2 |
| 120 | A | B2 |
| Comp. 65 | D | — |
| Comp. 66 | D | — |
| Comp. 67 | D | — |
| 113a | A | B3 |
| 113b | A | B3 |
| 113c | A | B3 |

As will be appreciated from the results shown in Table 25, the electrophotographic photoconductors according to the present invention gives under good images for a long period of service and has good durability.

EXAMPLE 121

160 Parts of an alkyd resin (Beckolite M6401-50, made by Dainippon Ink & Chemicals, Inc., solid content: 50% by weight) and 90 parts of a melamine resin (Super Beckamine G-821-60, made by Dainippon Ink & Chemicals, Inc., solid content: 60% by weight) were dissolved in a mixed solvent composed of 400 parts of methyl ethyl ketone and 100 parts of cyclohexanone, in which 10.0 parts of polypropylene monoalkyl ether (Newpole L1145 manufactured by Sanyo Chemical Industries, Ltd.) were further dissolved. To the solution were added 600 parts of a titanium oxide powder (CR-EL made by Ishihara Sangyo Co., Ltd., non-surface treated product). The mixture was dispersed in a ball mill containing alumina balls for 72 hours to prepare a coating liquid for an undercoat layer. The coating liquid was then applied to an aluminum drum having a diameter of 30 mm and a length of 340 mm and the coating was dried at 130° C. for 20 minutes to form an undercoat layer having a thickness of 5.0 μm thereon.

5 Parts of a polybutyral resin (XYHL, made by Union Carbide Plastic Co., Ltd.) were dissolved in 150 parts of cyclohexanone, to which 13 parts of a charge generating material having a structure represented by the above formula CG-1 were added and-milled in a ball mill containing alumina balls for 72 hours. The ball milling was further continued for 5 hours after addition of 210 parts of cyclohexanone. The milled mixture was diluted with the above mixed solvent with stirring until a solid content of 1.0% by weight was reached to obtain a coating liquid for forming a charge generating layer. The thus obtained coating liquid was applied to the aluminum drum on which the undercoat layer had been formed. The coating was dried at 120° C. for 10 minutes to form a charge generating layer having a thickness of about 0.2 μm.

75 Parts of a charge transporting material having a structure represented by the above structural formula CT-3, 100 parts of a polycarbonate resin (Panlite TS2040, made by Teijin Chemicals, Ltd.), 0.6 part of 2,6-di-tert-butylphenol, 0.7 part of o-thiocresol and 0.02 part of a silicone oil (KF-50, made by Shin-Etsu Chemical Co., Ltd.) were dissolved in 770 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 25 minutes to form a charge transporting layer having a thickness of about 28 μm, thereby obtaining an electrophotographic photoconductor.

EXAMPLE 122

Example 121 was repeated in the same manner as described except that zinc sulfide powder (manufactured by Shimakyu Pharmaceutical Inc.) was substituted for the titanium oxide, thereby obtaining an electrophotographic photoconductor.

EXAMPLE 123

Example 121 was repeated in the same manner as described except that alumina-treated titanium oxide (CR-97 manufactured by Ishihara Sangyo Co., Ltd.) was substituted for the titanium oxide, thereby obtaining an electrophotographic photoconductor.

EXAMPLE 124

Example 121 was repeated in the same manner as described except that 1,3-dioxorane was substituted for the tetrahydrofuran for the formation of the coating liquid for a charge transporting layer, thereby obtaining an electrophotographic photoconductor.

EXAMPLE 125

Example 121 was repeated in the same manner as described except that xylene was substituted for the tetrahydrofuran for the formation of the coating liquid for a charge transporting layer, thereby obtaining an electrophotographic photoconductor.

EXAMPLE 126

Example 121 was repeated in the same manner as described except that toluene was substituted for the tetrahydrofuran for the formation of a coating liquid for a charge transporting layer, thereby obtaining an electrophotographic photoconductor.

EXAMPLE 127

Example 121 was repeated in the same manner as described except that the thickness of the undercoat layer was reduced to 2.0 μm, thereby obtaining an electrophotographic photoconductor.

EXAMPLE 128

Example 121 was repeated in the same manner as described except that the thickness of the charge transporting layer was reduced to 25 μm, thereby obtaining an electrophotographic photoconductor.

COMPARATIVE EXAMPLE 68

Example 121 was repeated in the same manner as described except that the polypropylene monoalkyl ether was not used at all, thereby obtaining an electrophotographic photoconductor.

COMPARATIVE EXAMPLE 69

Example 121 was repeated in the same manner as described except that dichloromethane was substituted for the tetrahydrofuran for the formation of a coating liquid for a charge transporting layer, thereby obtaining an electrophotographic photoconductor.

COMPARATIVE EXAMPLE 70

Example 121 was repeated in the same manner as described except that dichloromethane was substituted for the mixed solvent as a diluting solvent for the formation of a coating liquid for a charge generating layer, thereby obtaining an electrophotographic photoconductor.

EXAMPLE 121a

Example 121 was repeated in the same manner as described except that 2,6-di-tert-butylphenol was not used at all, thereby obtaining an electrophotographic photoconductor.

EXAMPLE 121b

Example 121 was repeated in the same manner as described except that o-thiocresol was not used at all, thereby obtaining an electrophotographic photoconductor.

EXAMPLE 121c

Example 121 was repeated in the same manner as described except that neither 2,6-di-tert-butylphenol nor o-thiocresol was used at all, thereby obtaining an electrophotographic photoconductor.

Each of the photoconductors obtained in Examples 121-128 and 121a-121c and Comparative Examples 68-70 was incorporated in a laser printer (IPSiO NX700 made by Ricoh Company, Ltd.) having detachably mounted thereon a process cartridge including a photoconductor, a contact type roll charging device, a reverse development device and a cleaning blade. Images were repeatedly produced at a dark area potential of −700 V and a reverse development bias of −450 V in an ordinary environment (20° C., 50% RH) to obtain 50,000 prints. The image quality in the initial stage and in the 50,000th print was evaluated to give the results shown in Table 26.

TABLE 26

| Example | Initial Image | Image of 5,000th Print |
|---|---|---|
| 121 | A | A |
| 122 | B1 | B1 |
| 123 | A | A |
| 124 | A | A |
| 135 | A | A |
| 126 | A | A |
| 127 | A | B2 |
| 128 | A | B2 |
| Comp. 68 | D | — |
| Comp. 69 | D | — |
| Comp. 70 | D | — |
| 121a | A | B3 |
| 121b | A | B3 |
| 121c | A | B3 |

As will be appreciated from the results shown in Table 26, the electrophotographic photoconductors according to the present invention gives under good images for a long period of service and has good durability.

EXAMPLE 129

160 Parts of an alkyd resin (Beckolite M6401-50, made by Dainippon Ink & Chemicals, Inc., solid content: 50% by weight) and 90 parts of a melamine resin (Super Beckamine G-821-60, made by Dainippon Ink & Chemicals, Inc., solid content: 60% by weight) were dissolved in a mixed solvent composed of 400 parts of methyl ethyl ketone and 100 parts of cyclohexanone, in which 10.0 parts of polyethyleneglycol dicarboxylic acid ester (Santopal GE-70 manufactured by Sanyo Chemical Industries, Ltd.) were further dissolved. To the solution were added 600 parts of a titanium oxide powder (CR-EL made by Ishihara Sangyo Co., Ltd., non-surface treated product). The mixture was dispersed in a ball mill containing alumina balls for 72 hours to prepare a coating liquid for an undercoat layer. The coating liquid was then applied to an aluminum drum having a diameter of 30 mm and a length of 340 mm and the coating was dried at 130° C. for 20 minutes to form an undercoat layer having a thickness of 5.0 μm thereon.

5 Parts of a polybutyral resin (XYHL, made by Union Carbide Plastic Co., Ltd.) were dissolved in 150 parts of cyclohexanone, to which 13 parts of a charge generating material having a structure represented by the above formula CG-1 were added and milled in a ball mill containing alumina balls for 72 hours. The ball milling was further continued for 5 hours after addition of 210 parts of cyclohexanone. The milled mixture was diluted with the above mixed solvent with stirring until a solid content of 1.0% by weight was reached to obtain a coating liquid for forming a charge generating layer. The thus obtained coating liquid was applied to the aluminum drum on which the undercoat layer had been formed. The coating was dried at 120° C. for 10 minutes to form a charge generating layer having a thickness of about 0.2 μm.

75 Parts of a charge transporting material having a structure represented by the above structural formula CT-3, 100 parts of a polycarbonate resin (Panlite TS2040, made by Teijin Chemicals, Ltd.), 0.6 part of 2,6-di-tert-butylphenol, 0.7 part of o-thiocresol and 0.02 part of a silicone oil (KF-50, made by Shin-Etsu Chemical Co., Ltd.) were dissolved in 770 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 25 minutes to form a charge transporting layer having a thickness of about 28 μm, thereby obtaining an electrophotographic photoconductor.

EXAMPLE 130

Example 129 was repeated in the same manner as described except that zinc sulfide powder (manufactured by Shimakyu Pharmaceutical Inc.) was substituted for the titanium oxide, thereby obtaining an electrophotographic photoconductor.

EXAMPLE 131

Example 129 was repeated in the same manner as described except that alumina-treated titanium oxide (CR-97 manufactured by Ishihara Sangyo Co., Ltd.) was substituted for the titanium oxide, thereby obtaining an electrophotographic photoconductor.

EXAMPLE 132

Example 129 was repeated in the same manner as described except that 1,3-dioxorane was substituted for the tetrahydrofuran for the formation of the coating liquid for a charge transporting layer, thereby obtaining an electrophotographic photoconductor.

EXAMPLE 133

Example 129 was repeated in the same manner as described except that xylene was substituted for the tetrahydrofuran for the formation of the coating liquid for a charge transporting layer, thereby obtaining an electrophotographic photoconductor.

EXAMPLE 134

Example 129 was repeated in the same manner as described except that toluene was substituted for the tetrahydrofuran for the formation of a coating liquid for a charge transporting layer, thereby obtaining an electrophotographic photoconductor.

EXAMPLE 135

Example 129 was repeated in the same manner as described except that the thickness of the undercoat layer was reduced to 2.0 μm, thereby obtaining an electrophotographic photoconductor.

EXAMPLE 136

Example 129 was repeated in the same manner as described except that the thickness of the charge transporting layer was reduced to 25 μm, thereby obtaining an electrophotographic photoconductor.

COMPARATIVE EXAMPLE 71

Example 129 was repeated in the same manner as described except that the polyethylene dicarboxylic acid ester was not used at all, thereby obtaining an electrophotographic photoconductor.

COMPARATIVE EXAMPLE 72

Example 129 was repeated in the same manner as described except that dichloromethane was substituted for the tetrahydrofuran for the formation of a coating liquid for a charge transporting layer, thereby obtaining an electrophotographic photoconductor.

COMPARATIVE EXAMPLE 73

Example 129 was repeated in the same manner as described except that dichloromethane was substituted for the mixed solvent as a diluting solvent for the formation of a coating liquid for a charge generating layer, thereby obtaining an electrophotographic photoconductor.

EXAMPLE 129a

Example 129 was repeated in the same manner as described except that 2,6-di-tert-butylphenol was not used at all, thereby obtaining an electrophotographic photoconductor.

EXAMPLE 129b

Example 129 was repeated in the same manner as described except that o-thiocresol was not used at all, thereby obtaining an electrophotographic photoconductor.

EXAMPLE 129c

Example 129 was repeated in-the same manner as described except that neither 2,6-di-tert-butylphenol nor o-thiocresol was used at all, thereby obtaining an electrophotographic photoconductor.

Each of the photoconductors obtained in Examples 129-136 and 129a-129c and Comparative Examples 71-73 was incorporated in a laser printer (IPSiO NX700 made by Ricoh Company, Ltd.) having detachably mounted thereon a process cartridge including a photoconductor, a contact type roll charging device, a reverse development device and a cleaning blade. Images were repeatedly produced at a dark area potential of −700 V and a reverse development bias of −450 V in an ordinary environment (20° C., 50% RH) to obtain 50,000 prints. The image quality in the initial stage and in the 50,000th print was evaluated to give the results shown in Table 27.

TABLE 27

| Example | Initial Image | Image of 5,000th Print |
|---|---|---|
| 129 | A | A |
| 130 | B1 | B1 |
| 131 | A | A |
| 132 | A | A |
| 133 | A | A |
| 134 | A | A |
| 135 | A | B2 |
| 136 | A | B2 |
| Comp. 71 | D | — |
| Comp. 72 | D | — |
| Comp. 73 | D | — |

TABLE 27-continued

| Example | Initial Image | Image of 5,000th Print |
|---|---|---|
| 129a | A | B3 |
| 129b | A | B3 |
| 129c | A | B3 |

As will be appreciated from the results shown in Table 27, the electrophotographic photoconductors according to the present invention gives under good images for a long period of service and has good durability.

EXAMPLE 137

160 Parts of an alkyd resin (Beckolite M6401-50, made by Dainippon Ink & Chemicals, Inc., solid content: 50% by weight) and 90 parts of a melamine resin (Super Beckamine G-821-60, made by Dainippon Ink & Chemicals, Inc., solid content: 60% by weight) were dissolved in a mixed solvent composed of 400 parts of methyl ethyl ketone and 100 parts of cyclohexanone, in which 20.0 parts of oxyethylene-oxypropylene copolymer (Newpole PE-108 manufactured be Sanyo Chemical Industries, Ltd.) were further dissolved. To the solution were added 600 parts of a titanium oxide powder (CR-EL made by Ishihara Sangyo Co., Ltd., non-surface treated product). The mixture was dispersed in a ball mill containing alumina balls for 72 hours to prepare a coating liquid for an undercoat layer. The coating liquid was then applied to an aluminum drum having a diameter of 30 mm and a length of 340 mm and the coating was dried at 130° C. for 20 minutes to form an undercoat layer having a thickness of 5.0 μm thereon.

5 Parts of a polybutyral resin (XYHL, made by Union Carbide Plastic Co., Ltd.) were dissolved in 150 parts of cyclohexanone, to which 13 parts of a charge generating material having a structure represented by the above formula CG-1 were added and milled in a ball mill containing alumina balls for 72 hours. The ball milling was further continued for 5 hours after addition of 210 parts of cyclohexanone. The milled mixture was diluted with the above mixed solvent with stirring until a solid content of 1.0% by weight was reached to obtain a coating liquid for forming a charge generating layer. The thus obtained coating liquid was applied to the aluminum drum on which the undercoat layer had been formed. The coating was dried at 120° C. for 10 minutes to form a charge generating layer having a thickness of about 0.2 μm.

75 Parts of a charge transporting material having a structure represented by the above structural formula CT-3, 100 parts of a polycarbonate resin (Panlite TS2040, made by Teijin Chemicals, Ltd.), 0.6 part of 2,6-di-tert-butylphenol, 0.7 part of o-thiocresol and 0.02 part of a silicone oil (KF-50, made by Shin-Etsu Chemical Co., Ltd.) were dissolved in 770 parts of tetrahydrofuran to obtain a coating liquid for forming a charge transporting layer. The resulting coating liquid was applied to the aluminum drum on which the undercoat layer and the charge generating layer had been formed. The coating was dried at 135° C. for 25 minutes to form a charge transporting layer having a thickness of about 28 μm, thereby obtaining an electrophotographic photoconductor.

EXAMPLE 138

Example 137 was repeated in the same manner as described except that zinc sulfide powder (manufactured by Shimakyu Pharmaceutical Inc.) was substituted for the titanium oxide, thereby obtaining an electrophotographic photoconductor.

EXAMPLE 139

Example 137 was repeated in the same manner as described except that alumina-treated titanium oxide (CR-97 manufactured by Ishihara Sangyo Co., Ltd.) was substituted for the titanium oxide, thereby obtaining an electrophotographic photoconductor.

EXAMPLE 140

Example 137 was repeated in the same manner as described except that 1,3-dioxorane was substituted for the tetrahydrofuran for the formation of the coating liquid for a charge transporting layer, thereby obtaining an electrophotographic photoconductor.

EXAMPLE 141

Example 137 was repeated in the same manner as described except that xylene was substituted for the tetrahydrofuran for the formation of the coating liquid for a charge transporting layer, thereby obtaining an electrophotographic photoconductor.

EXAMPLE 142

Example 137 was repeated in the same manner as described except that toluene was substituted for the tetrahydrofuran for the formation of a coating liquid for a charge transporting layer, thereby obtaining an electrophotographic photoconductor.

EXAMPLE 143

Example 137 was repeated in the same manner as described except that the thickness of the undercoat layer was reduced to 2.0 μm, thereby obtaining an electrophotographic photoconductor.

EXAMPLE 144

Example 137 was repeated in the same manner as described except that the thickness of the charge transporting layer was reduced to 25 μm, thereby obtaining an electrophotographic photoconductor.

COMPARATIVE EXAMPLE 74

Example 137 was repeated in the same manner as described except that the oxyethylene-oxypropylene copolymer was not used at all, thereby obtaining an electrophotographic photoconductor.

COMPARATIVE EXAMPLE 75

Example 137 was repeated in the same manner as described except that dichloromethane was substituted for the tetrahydrofuran for the formation of a coating liquid for a charge transporting layer, thereby obtaining an electrophotographic photoconductor.

COMPARATIVE EXAMPLE 76

Example 137 was repeated in the same manner as described except that dichloromethane was substituted for the mixed solvent as a diluting solvent for the formation of a coating liquid for a charge generating layer, thereby obtaining an electrophotographic photoconductor.

EXAMPLE 137a

Example 137 was repeated in the same manner as described except that 2,6-di-tert-butylphenol was not used at all, thereby obtaining an electrophotographic photoconductor.

EXAMPLE 137b

Example 137 was repeated in the same manner as described except that o-thiocresol was not used at all, thereby obtaining an electrophotographic photoconductor.

EXAMPLE 137c

Example 137 was repeated in the same manner as described except that neither 2,6-di-tert-butylphenol nor o-thiocresol was used at all, thereby obtaining an electrophotographic photoconductor.

Each of the photoconductors obtained in Examples 137-144 and 137a-137c and Comparative Examples 74-76 was incorporated in a laser printer (IPSiO NX700 made by Ricoh Company, Ltd.) having detachably mounted thereon a process cartridge including a photoconductor, a contact type roll charging device, a reverse development device and a cleaning blade. Images were repeatedly produced at a dark area potential of −700 V and a reverse development bias of −450 V in an ordinary environment (20° C., 50% RH) to obtain 50,000 prints. The image quality in the initial stage and in the 50,000th print was evaluated to give the results shown in Table 28.

TABLE 28

| Example | Initial Image | Image of 5,000th Print |
|---|---|---|
| 137 | A | A |
| 138 | B1 | B1 |
| 139 | A | A |
| 140 | A | A |
| 141 | A | A |
| 142 | A | A |
| 143 | A | B2 |
| 144 | A | B2 |
| Comp. 74 | D | — |
| Comp. 75 | D | — |
| Comp. 76 | D | — |
| 137a | A | B3 |
| 137b | A | B3 |
| 138c | A | B3 |

As will be appreciated from the results shown in Table 28, the electrophotographic photoconductors according to the present invention gives under good images for a long period of service and has good durability.

EXAMPLE 145

150 Parts of an alkyd resin (Beckozol 1307-60EL, made by Dainippon Ink & Chemicals, Inc., solid content: 60% by weight) and 100 parts of a melamine resin (Super Beckamine G-821-60, made by Dainippon Ink & Chemicals, Inc., solid content: 60% by weight) were dissolved in 500 parts of methyl ethyl ketone, to which 450 parts of a titanium oxide powder (CR-EL made by Ishihara Sangyo Co., Ltd.) were added. The mixture was dispersed in a ball mill containing alumina balls for 36 hours to prepare a coating liquid for forming an undercoat layer. The coating liquid was then applied to an aluminum drum having a diameter of 30 mm and a length of 301 mm and the coating was dried at 140° C. for 20 minutes to form an undercoat layer having a thickness of 5.0 μm thereon.

5 Parts of a butyral resin (S-LEC BMS, made by Sekisui Chemical Co., Ltd.) were dissolved in 150 parts of cyclohexanone, to which 30 parts of a charge generating material having a structure represented by the above formula (CG-1) were milled in a ball mill containing alumina balls for 72 hours. The ball milling was further continued for 5 hours after addition of 210 parts of cyclohexanone. The milled mixture was diluted with cyclohexanone with stirring until a solid content of 2.0% by weight was reached, in which 10.0 parts of 12-crown-4 ether were dissolved to obtain a coating liquid for forming a charge generating layer. The thus obtained coating liquid was applied to the undercoat layer which had been formed on the aluminum drum. The coating was dried at 130° C. for 20 minutes to form a charge generating layer having a thickness of about 0.2 μm 80 Parts of a charge transporting material having a structure represented by the above formula (CT-3), 100 parts of a polycarbonate resin (Panlite TS2050, made by Teijin Chemicals, Ltd.) and 0.02 parts of a silicone oil (KF-50, made by Shin-Etsu Chemical Co., Ltd.) were dissolved in 770 parts of tetrahydrofuran to obtain a coating liquid for forming a charge transporting layer. The resulting coating liquid was applied to the charge generating layer formed on the undercoat layer which in turn had been formed on the aluminum drum. The coating was dried at 135° C. for 20 minutes to form a charge transporting layer having a thickness of about 28 μm, thereby obtaining an electrophotographic photoconductor.

EXAMPLE 146

Example 145 was repeated in the same manner as described except that the thickness of the undercoat layer was reduced to 1.8 μm, thereby obtaining an electrophotographic photoconductor.

EXAMPLE 147

Example 145 was repeated in the same manner as described except that the thickness of the charge transporting layer was reduced to 25 μm, thereby obtaining an electrophotographic photoconductor.

COMPARATIVE EXAMPLE 77

Example 145 was repeated in the same manner as described except that 12-crown-6 ether was not used at all, thereby obtaining an electrophotographic photoconductor.

Each of the photoconductors obtained in Examples 145-147 and Comparative Example 77 was incorporated in an image forming machine (RIFAX SL3300 made by Ricoh Company, Ltd.) equipped with a non-contact type corona charging device, a laser image exposing device, a reverse development device and a transfer device. Images were repeatedly produced in a copying mode at a dark area potential of −750 V and an exposed are potential of −150 V to obtain 100,000 copies in three different conditions of (a) ordinary environment (20° C., 50% relative humidity), low temperature and low humidity environment (10° C., 15% relative humidity) and high temperature and high humidity environment (30° C., 90% relative humidity). The dark area potential (VD) and exposed area potential (VL) after the production of 100,000 copies were measured. The results are summarized in Tables 29 to 31.

TABLE 29

| | 20° C./50% RH | | | |
|---|---|---|---|---|
| | Initial | | After 100,000 copies | |
| Example | VD (V) | VL (V) | VD (V) | VL (V) |
| 145 | −750 | −150 | −730 | −160 |
| 146 | −750 | −150 | −710 | −160 |
| 147 | −750 | −150 | −700 | −160 |
| Comp. 77 | −750 | −150 | −730 | −220 |

TABLE 30

| | 10° C./15% RH | | | |
|---|---|---|---|---|
| | Initial | | After 100,000 copies | |
| Example | VD (V) | VL (V) | VD (V) | VL (V) |
| 145 | −750 | −150 | −735 | −170 |
| 146 | −750 | −150 | −715 | −165 |
| 147 | −750 | −150 | −710 | −170 |
| Comp. 77 | −750 | −150 | −730 | −245 |

TABLE 31

| | 30° C./90% RH | | | |
|---|---|---|---|---|
| | Initial | | After 100,000 copies | |
| Example | VD (V) | VL (V) | VD (V) | VL (V) |
| 145 | −750 | −150 | −720 | −155 |
| 146 | −750 | −150 | −700 | −155 |
| 147 | −750 | −150 | −695 | −155 |
| Comp. 77 | −750 | −150 | −720 | −205 |

EXAMPLE 148

30 Parts of a methoxymethylated nylon fine resin (FR-301, made by Namariichi Co., Ltd., methoxymethylation rate: 20%) and 50 parts of a butylated melamine resin, (Super Beckamine G-821-60, made by Dainippon Ink & Chemicals, Inc., nonvolatile content: 60% by weight) were dissolved in a mixed solvent of 200 parts methanol, 50 parts of n-butanol, and 250 parts of methyl ethyl ketone, to which 240 parts of a titanium oxide powder (TA-300, made by Fuji Titanium Industry Co., Ltd.) were added. The mixture was dispersed in a ball mill for 72 hours and mixed with 60.0 parts of a methanol solution of maleic acid (solid content: 10% by weight) to prepare a coating liquid for forming an undercoat layer. The coating liquid then was applied to an aluminum drum having a diameter of 30 mm and a length of 340 mm and the coating was dried at 140° C. for 20 minutes to form an undercoat layer having a thickness of 6.0 μm thereon.

22.0 Parts of a charge generating material having a structure represented by the above formula (CG-4) and 10.0 parts of a τ-type non-metallophthalocyanine pigment (TPA-891, made by Toyo Ink Mfg. Co., Ltd.) and 330 parts of methyl ethyl ketone were milled in a ball mill for 168 hours, to which a resin liquid obtained by dissolving 12 parts of polyvinyl butyral (S-Lec BL-1, made by Sekisui Chemical Co., Ltd.) in a mixture of 390 parts of methyl ethyl ketone and 1680 parts of cyclohexanone were added. The resulting mixture was dispersed for 5 hours, in which 15.0 parts of tribenzo-18-crown-ether (made by made by Sanyo Chemical Industries, Ltd.) were dissolved to prepare a coating liquid for forming a charge generating layer. The thus obtained coating liquid was applied to the undercoat layer which had been formed on the aluminum drum. The coating was dried at 130° C. for 20 minutes to form a charge generating layer having a thickness of about 0.3 μm.

90 Parts of a charge transporting material having a structure represented by the above formula (CT-2), 100 parts of a polycarbonate resin (Panlite L1250, made by Teijin Chemicals Ltd.), 0.5 parts of 2,6-di-tert-butyl-4-methoxyphenol, 1.0 part of dimethyl-3,3'-thiopropyonate, and 0.02 parts of a silicone oil (KF-50, made by Shin-Etsu Chemical Co., Ltd.) were dissolved in a mixture of 300 parts of 1,3-dioxolane and 450 parts of tetrahydrofuran to obtain a coating liquid for forming a charge transporting layer. The resulting coating liquid was applied to the charge generating layer formed on the undercoat layer which in turn had been formed on the aluminum drum. The coating was dried at 130° C. for 20 minutes to form a charge transporting layer having a thickness of 31 μm, thereby obtaining an electrophotographic photoconductor.

EXAMPLE 149

Example 148 was repeated in the same manner as described except that the thickness of the undercoat layer was reduced to 3.5 μm, thereby obtaining an electrophotographic photoconductor.

EXAMPLE 150

Example 148 was repeated in the same manner as described except that the thickness of the charge transporting layer was reduced to 26 μm, thereby obtaining an electrophotographic photoconductor.

COMPARATIVE EXAMPLE 78

Example 148 was repeated in the same manner as described except that tribenzo-18-crown-6-ether was not used at all, thereby obtaining an electrophotographic photoconductor.

Each of the photoconductors obtained in Examples 148-150 and Comparative Example 78 was incorporated in a digital copying machine (Imagio Neo 270, manufactured by Ricoh company, Ltd.), equipped with a contact charging device in the form of a charging roller, image exposure device, a reverse developing device and a transfer device. Images were repeatedly produced at a dark area potential of −750 V and a reverse development bias of −400 V to obtain 300,000 copies in conditions of an ordinary environment (20° C., 50% relative humidity). The image densities of black solid parts having a diameter of 10 mm in images at an initial stage and after making 300,000 copies were measured with a Macbeth densitometer to evaluate the decrease in image density. Also, non-image parts of the copies at an initial stage and-after making 300,000 copies were evaluated. The results are summarized in Tables 32 and 33.

TABLE 32

| | Image density | | |
|---|---|---|---|
| Example | At initial stage | After making 300,000 copies | Decrease |
| 148 | 1.40 | 1.38 | 0.02 |
| 149 | 1.40 | 1.38 | 0.02 |

TABLE 32-continued

| Example | Image density At initial stage | After making 300,000 copies | Decrease |
|---|---|---|---|
| 150 | 1.40 | 1.38 | 0.02 |
| Comp. 78 | 1.40 | 1.05 | 0.35 |

TABLE 33

| Example | Non-image part At initial stage | After making 300,000 copies |
|---|---|---|
| 148 | Good | Good |
| 149 | Good | Stained with fine black spots (Acceptable for practical use). |
| 150 | Good | Stained with fine black spots (Acceptable for practical use). |
| Comp. 78 | Good | Good |

EXAMPLE 151

A photoconductor was obtained in the same manner as in Example 148 except that the charge generating layer and the charge transporting layer were formed as follows.

16 Parts of a titanylphthalocyanine pigment were charged in a glass pot together with zirconia beads having a diameter of 2 mm and a solution of 18.0 parts of dicyclohexano-24-crown-8-ether in 350 parts of methyl ethyl ketone and milled for 15 hours. The ball milling was further continued for 2 hours after addition of a resin solution of 10 parts of a polyvinyl butyral resin (S-Lec BX-1, made by Sekisui Chemical Co., Ltd.) in 600 parts of methyl ethyl ketone to obtain a coating liquid for forming a charge generating layer.

The thus obtained coating liquid was applied to the undercoat layer which had been formed on the aluminum drum. The coating was dried at 80° C. for 20 minutes to form a charge generating layer having a thickness of about 0.5 μm.

70 Parts of a charge transporting material having a structure represented by the above formula (CT-2), 100 parts of a polycarbonate resin (Panlite TS2050, made by Teijin Chemicals Ltd.), and 0.02 parts of a silicone oil (KF-50, made by Shin-Etsu Chemical Co., Ltd.) were dissolved in a mixture of 200 parts of 1,3-dioxolane and 550 parts of tetrahydrofuran to obtain a charge transporting layer coating liquid.

The resulting coating liquid was applied to the charge generating layer formed on the under coat layer which in turn had been formed on the aluminum drum. The coating was dried at 135° C. for 20 minutes to form a charge transporting layer having a thickness of 34 μm.

EXAMPLE 152

Example 151 was repeated in the same manner as described except that the thickness of the undercoat layer was reduced to 3.0 μm, thereby obtaining an electrophotographic photoconductor.

EXAMPLE 153

Example 151 was repeated in the same manner as described except that the thickness of the charge transporting layer was reduced to 25 μm, thereby obtaining an electrophotographic photoconductor.

COMPARATIVE EXAMPLE 79

Example 152 was repeated in the same manner as described except that dicyclohexano-24-crown-8-ether was not used at all, thereby obtaining an electrophotographic photoconductor.

COMPARATIVE EXAMPLE 80

Example 153 was repeated in the same manner as described except that dicyclohexano-24-crown-8-ether was not used at all, thereby obtaining an electrophotographic photoconductor.

Each of the photoconductors obtained in Examples 151-153 and Comparative Example 79 and 80 was incorporated in a digital copying machine (IMAGIO MF2200, manufactured by Ricoh company, Ltd.), equipped with a contact charging device in the form of a charging roller, image exposure device, a reverse developing device and a transfer device. Images were repeatedly produced at a dark area potential of −900 V and a reverse development bias of −600 V to obtain 200,000 copies in conditions of an ordinary environment (20° C., 50% relative humidity). The number of copies before black spots due to discharge breakdown took place was counted. Also, the image densities of black solid parts having a diameter of 10 mm in images at an initial stage and after making 200,000 copies were measured with a Macbeth densitometer to evaluate the decrease in image density. The results are summarized in Table 34.

TABLE 34

| Example | Number of copies produced before occurrence of discharge breakdown | Decrease in image density |
|---|---|---|
| 151 | Not occurred. | 0.03 |
| 152 | 100K | 0.03 |
| 153 | 120K | 0.03 |
| Comp. 79 | 100K | 0.30 (Image density decreased.) |
| Comp. 80 | 120K | 0.30 (Image density decreased.) |

EXAMPLE 154

150 Parts of an alkyd resin (Beckolite M6401-50, made by Dainippon Ink & Chemicals, Inc., solid content: 50% by weight) and 100 parts of a melamine resin, (Super Beckamine G-821-60, made by Dainippon Ink & Chemicals, Inc., solid content: 60% by weight) were dissolved in 500 parts of methyl ethyl ketone, to which 350 parts of a titanium oxide powder (CR-EL, made by Ishihara Sangyo Co., Ltd.), 80 parts of a titanium oxide powder (CR-67, made by Ishihara Sangyo Co., Ltd.) were added. The mixture was dispersed in a ball mill containing alumina balls for 36 hours to prepare a coating liquid for forming an undercoat layer. The coating liquid was then applied to an aluminum drum having a diameter of 30 mm and a length of 340 mm and the coating was dried at 140° C. for 20 minutes to form an undercoat layer having a thickness of 5.0 μm thereon.

4 Parts of a polyvinyl butyral resin (S-Lec HL-S, made by Sekisui Chemical Co., Ltd.) were dissolved in 150 parts of cyclohexanone, to which 8 parts of a charge generating material having a structure represented by the above formula (CG-4) were milled in a ball mill for 48 hours. The ball milling was further continued for 3 hours after addition of 210 parts of cyclohexanone. The milled mixture was diluted with cyclohexanone until a solid content of 1.5% by weight was reached, in which 5.0 parts of 18-crown-6-ether were dissolved to obtain a coating liquid for forming a charge generating layer. The thus obtained coating liquid was applied to the undercoat layer which had been formed on the aluminum drum. The coating was dried at 130° C. for 20 minutes to form a charge generating layer having a thickness of 0.2 μm.

75 Parts of a charge transporting material having a structure represented by the above formula (CT-3), 100 parts of a polycarbonate resin (Panlite TS2050, made by Teijin Chemicals Ltd.), and 0.02 parts of a silicone oil (KF-50, made by Shin-Etsu Chemical Co., Ltd.) were dissolved in 770 parts of tetrahydrofuran to obtain a coating liquid for forming a charge transporting layer. The resulting coating liquid was applied to the charge generating layer formed on the undercoat layer which in turn had been formed on the aluminum drum. The coating was dried at 135° C. for 20 minutes to form a charge transporting layer having a thickness of 29 μm, thereby obtaining an electrophotographic photoconductor.

Three more electrophotographic photoconductor were obtained in the same manner. The four electrophotographic photoconductor were incorporated in an image forming apparatus shown in FIG. 3 (a belt of PVDF resin in which carbon black is dispersed was used as the intermediate transfer member). After making 100,000 color copies, full color half tone images corresponding to 600 dpi and 1200 dpi were outputted and evaluated.

COMPARATIVE EXAMPLE 81

Example 154 was repeated in the same manner as described except that 18-crown-6-ether was not used at all, thereby obtaining electrophotographic photoconductors. The same evaluation as Example 154 was performed.

PREPARATION EXAMPLE OF ELASTIC BELT

A cylindrical mold was immersed in a dispersion obtained by uniformly dispersing 18 parts of carbon black, 3 parts of a dispersing gent and 400 parts of toluene in 100 parts of polyvinylidene fluoride (PVDF) and gently drawn up at a rate of 10 mm/sec. This was dried at room temperature to obtain a uniform PVDF film having a thickness of 75 μm. The cylindrical mold on which the PVDF film having a thickness of 75 μm had been formed was again immersed in the same dispersion and gently drawn up at a rate of 10 mm/sec. This was dried at room temperature to obtain a PVDF film having a thickness of 150 μm. The cylindrical mold on which the PVDF film having a thickness of 150 μm had been formed was immersed in-a dispersion obtained by uniformly dispersing 100 parts of a polyurethane prepolymer, 3 parts of a curing agent (isocyanate), 20 parts of carbon black, 3 parts of a dispersing agent and 500 parts of MEK and drawn up at 30 mm/sec. After air-drying, the process was repeated, whereby a urethane polymer layer having a thickness of 150 μm was formed.

100 Parts of a polyurethane prepolymer, 3 parts of a curing agent (isocyanate), 50 parts of PTFE fine particles, 4 parts of a dispersing agent and 500 parts of MEK were uniformly dispersed to prepare a coating liquid for forming a surface layer.

The cylindrical mold on which the urethane prepoymer film having a thickness of 150 μm had been formed was immersed in the surface layer coating liquid and drawn up at 30 mm/sec. After air-drying, the above process was repeated, thereby forming a urethane polymer surface layer having a thickness of 5 μm in which the PTFE fine particles were uniformly dispersed. After drying at room temperature, this was subjected to crosslinking for 2 hours at 130° C., thereby obtaining a transfer belt having a three-layer structure consisting of a resin layer; 150 μm, an elastic layer; 150 μm and a surface layer; 5 μm.

EXAMPLE 155

The intermediate transfer belt in the image forming apparatus used in Example 154 was replaced by the above elastic belt, and the same evaluation as Example 154 was performed.

COMPARATIVE EXAMPLE 82

The intermediate transfer belt in the image forming apparatus used in Comparative Example 81 was replaced by the above elastic belt, and the same evaluation was performed.

The results are summarized in Table 35.

TABLE 35

| Example | 600 dpi full color half tone | 1200 dpi full color half tone |
|---|---|---|
| 154 | There were small white voids (acceptable for practical use). | There were small white voids (acceptable for practical use). |
| Comp. 81 | Color tone was changed from an initial image. | Color tone was changed from an initial image. |
| 155 | There were white voids. Good. | There were white voids. Good. |
| Comp. 82 | Color tone was changed from an initial image. | Color tone was changed from an initial image. |

EXAMPLE 156

150 Parts of an alkyd resin (Beckozol 1307-60EL, made by Dainippon Ink & Chemicals, Inc., solid content: 60% by weight) and 100 parts of a melamine resin (Super Beckamine G-821-60, made by Dainippon Ink & Chemicals, Inc., solid content: 60% by weight) were dissolved in 500 parts of methyl ethyl ketone, to which 450 parts of a titanium oxide powder (CR-EL, made by Ishihara Sangyo Co., Ltd.) were added. The mixture was dispersed in a ball mill containing alumina balls for 36 hours to prepare a coating liquid for forming an undercoat layer. The coating liquid was applied to an aluminum drum having a diameter of 30 mm and a length of 301 mm and the coating was dried at 140° C. for 20 minutes to form an undercoat layer having a thickness of 5.0 μm thereon.

5 Parts of a butyral resin (S-Lec BMS, made by Sekisui Chemical Co., Ltd.) were dissolved in 150 parts of cyclohexanone, to which 25 parts of a charge generating material having a structure represented by the above formula (CG-1) were added. The mixture was dispersed in a ball mill for 72 hours. The ball milling was further continued for 5 hours after addition of 210 parts of cyclohexanone. The milled mixture was diluted with cyclohexanone with stirring until a solid content of 2.0% by weight was reached, in which 5.0 parts of Ionet DS-300 (made by Sanyo Chemical Industries, Ltd.) were dissolved to obtain a coating liquid for forming a charge generating layer. The thus obtained coating liquid was applied to the undercoat layer which had been formed on the aluminum drum. The coating was dried at 130° C. for 20 minutes to form a charge generating layer having a thickness of about 0.2 μm.

80 Parts of a charge transporting material having a structure represented by the above formula (CT-3), 100 parts of a polycarbonate resin (Panlite TS2050, made by Teijin Chemicals Ltd.), and 0.02 parts of a silicone oil (KF-50, made by Shin-Etsu Chemical Co., Ltd.) were dissolved in 770 parts of tetrahydrofuran to obtain a coating liquid for forming a charge transporting layer. The resulting coating liquid was applied to the charge generating layer formed on the undercoat layer which in turn had been formed on the aluminum drum. The coating was dried at 135° C. for 20 minutes to form a charge transporting layer having a thickness of 28 μm Thereby, obtaining an electrophotographic photoconductor.

EXAMPLE 157

Example 156 was repeated in the same manner as described except that the thickness of the undercoat layer was reduced to 1.8 μm, thereby obtaining an electrophotographic photoconductor.

EXAMPLE 158

Example 156 was repeated in the same manner as described except that the thickness of the charge transporting layer was reduced to 25 μm, thereby obtaining an electrophotographic photoconductor.

COMPARATIVE EXAMPLE 83

Example 156 was repeated in the same manner as described except that Ionet DS-300 (made by Sanyo Chemical Industries, Ltd.) was not used at all, thereby obtaining an electrophotographic photoconductor.

The photoconductors obtained in Example 156-158 and Comparative Example 83 were evaluated in the same manner as in Example 145. The results are summarized in Tables 36 to 38.

TABLE 36

| | 20° C./50% RH | | | |
|---|---|---|---|---|
| | Initial | | After 100,000 copies | |
| Example | VD (V) | VL (V) | VD (V) | VL (V) |
| 156 | −750 | −150 | −730 V | −160 V |
| 157 | −750 | −150 | −710 V | −160 V |
| 158 | −750 | −150 | −700 V | −160 V |
| Comp. 83 | −750 | −150 | −730 V | −230 V |

TABLE 37

| | 10° C./15% RH | | | |
|---|---|---|---|---|
| | Initial | | After 100,000 copies | |
| Example | VD (V) | VL (V) | VD (V) | VL (V) |
| 156 | −750 | −150 | −735 V | −170 V |
| 157 | −750 | −150 | −715 V | −165 V |
| 158 | −750 | −150 | −710 V | −170 V |
| Comp. 83 | −750 | −150 | −730 V | −250 V |

TABLE 38

| | 30° C./90% RH | | | |
|---|---|---|---|---|
| | Initial | | After 100,000 copies | |
| Example | VD (V) | VL (V) | VD (V) | VL (V) |
| 156 | −750 | −150 | −720 V | −155 V |
| 157 | −750 | −150 | −700 V | −155 V |
| 158 | −750 | −150 | −695 V | −155 V |
| Comp. 83 | −750 | −150 | −720 V | −210 V |

EXAMPLE 159

Example 148 was repeated in the same manner as described except that 6.0 parts of Ionet MS-400 (made by Sanyo Chemical Industries, Ltd.) was used instead of 15.0 parts of 18-crown-6-ether, and the amounts of the material having a structure represented by the above formula (CG-4) and the phthalocyanine pigment were changed to 24.0 parts and 12.0 parts, respectively, thereby obtaining an electrophotographic photoconductor.

EXAMPLE 160

Example 159 was repeated in the same manner as described except that the thickness of the undercoat layer was reduced to 3.5 μm, thereby obtaining an electrophotographic photoconductor.

EXAMPLE 161

Example 159 was repeated in the same manner as described except that the thickness of the charge transporting layer was reduced to 26 μm, thereby obtaining an electrophotographic photoconductor.

COMPARATIVE EXAMPLE 84

Example 159 was repeated in the same manner as described except that Ionet MS-400 (made by Sanyo Chemical Industries, Ltd.) was not used at all, thereby obtaining an electrophotographic photoconductor.

The photoconductors obtained in Example 159-161 and Comparative Example 84 were evaluated in the same manner as in Example 148. The results are summarized in Table 39 and 40.

TABLE 39

| | Image density | | |
|---|---|---|---|
| Example | At initial stage | After making 300,000 copies | Decrease |
| 159 | 1.40 | 1.37 | 0.03 |
| 160 | 1.40 | 1.38 | 0.02 |
| 161 | 1.40 | 1.37 | 0.03 |
| Comp. 84 | 1.40 | 1.05 | 0.33 |

TABLE 40

| | Non-image part | |
|---|---|---|
| Example | At initial stage | After making 300,000 copies |
| 159 | Good | Good |
| 160 | Good | Stained with fine black dots (acceptable for practical use). |

TABLE 40-continued

| Example | Non-image part | |
|---|---|---|
| | At initial stage | After making 300,000 copies |
| 161 | Good | Stained with fine black dots (acceptable for practical use). |
| Comp. 84 | Good | Good |

EXAMPLE 162

An electrophotographic photoconductor was obtained in the same manner as in Example 159 except that the charge generating layer and the charge transporting layer were formed as follows.

18 Parts of a titanylphthalocyanine pigment is charged in a glass pot together with zirconia beads having a diameter of 2 mm and a solution of 5 parts of Nonion DS-60HN (made by NOF Corporation) in 350 parts of methyl ethyl ketone and milled for 15 hours. The ball milling was further continued for 2 hours after addition of a resin solution of 10 parts of a polyvinyl butyral resin (S-Lec BX-1, made by Sekisui Chemical Co., Ltd.) in 600 parts of methyl ethyl ketone to obtain a coating liquid for forming a charge generating layer.

The thus obtained coating liquid was applied to the undercoat layer which had been formed on the aluminum drum. The coating was dried at 80° C. for 20 minutes to form a charge generating layer having a thickness of about 0.5 μm.

70 Parts of a charge transporting material having a structure represented by the above formula (CT-2), 100 parts of a polycarbonate resin (Panlite TS2050, made by Teijin Chemicals Ltd.), and 0.02 parts of a silicone oil (KF-50, made by Shin-Etsu Chemical Co., Ltd.) were dissolved in a mixture of 200 parts of 1,3-dioxolane and 550 parts of tetrahydrofuran to obtain a coating liquid for forming a charge transporting layer.

The resulting coating liquid was applied to the charge generating layer formed on the under coat layer which in turn had been formed on the aluminum drum. The coating was dried at 135° C. for 20 minutes to form a charge transporting layer having a thickness of 34 μm.

EXAMPLE 163

Example 162 was repeated in the same manner as described except that the thickness of the undercoat layer was reduced to 3.0 μm, thereby obtaining an electrophotographic photoconductor.

EXAMPLE 164

Example 162 was repeated in the same manner as described except that the thickness of the charge transporting layer was reduced to 25 μm, thereby obtaining an electrophotographic photoconductor.

COMPARATIVE EXAMPLE 85

Example 163 was repeated in the same manner as described except that Nonion DS-60HN (made by NOF Corporation) was not used at all, thereby obtaining an electrophotographic photoconductor.

COMPARATIVE EXAMPLE 86

Example 164 was repeated in the same manner as described except that Nonion DS-60HN (made by NOF Corporation) was not used at all, thereby obtaining an electrophotographic photoconductor.

The photoconductors obtained in-Example 162-164 and Comparative Examples 85 and 86 were evaluated in the same manner as in Example 151. The results are summarized in Table 41.

TABLE 41

| Example | Number of copies produced before occurrence of discharge breakdown | Decrease in image density |
|---|---|---|
| 162 | Not occurred. | 0.02 |
| 163 | 100K | 0.02 |
| 164 | 120K | 0.02 |
| Comp. 85 | 100K | 0.30 (Image density decreased.) |
| Comp. 86 | 120K | 0.30 (Image density decreased.) |

EXAMPLE 165

Example 154 was repeated in the same manner as described except that 4.0 parts of Ionet DS-300 (made by Sanyo Chemical Industries, Ltd.) was used instead of 5.0 parts of 18-crown-6-ether, thereby obtaining electrophotographic photoconductors. The same evaluation as Example 154 was performed.

COMPARATIVE EXAMPLE 87

Example 165 was repeated in the same-manner as described except that Ionet DS-300 (made by Sanyo Chemical Industries, Ltd.) was not used at all, thereby obtaining electrophotographic photoconductors. The same evaluation as Example 154 was performed.

EXAMPLE 166

The intermediate transfer belt in the image forming apparatus used in Example 165 was replaced by the above elastic belt, and the same evaluation as in Example 154 was performed.

COMPARATIVE EXAMPLE 88

The intermediate transfer belt in the image forming apparatus used in Comparative Example 87 was replaced by the above elastic belt, and the same evaluation as in Example 154 was performed.

The results are summarized in Table 42.

TABLE 42

| Example | 600 dpi full color half tone | 1200 dpi full color half tone |
|---|---|---|
| 165 | There were small white voids (acceptable for practical use). | There were small white voids (acceptable for practical use). |
| Comp. 87 | Color tone was changed from an initial image. There were white voids. | Color tone was changed from an initial image. There were white voids. |
| 166 | Good | Good |

TABLE 42-continued

| Example | 600 dpi full color half tone | 1200 dpi full color half tone |
|---|---|---|
| Comp. 88 | Color tone was changed from an initial image. There were white voids. | Color tone was changed from an initial image. There were white voids. |

EXAMPLE 167

Example 156 was repeated in the same manner as described except that 12.0 parts of Emulmine 110 (made by Sanyo Chemical Industries, Ltd.) was used instead of 5.0 parts of Ionet DS-300, and the amount of the material having a structure represented by the above formula (CG-1) was changed to 20 parts, thereby obtaining an electrophotographic photoconductor.

EXAMPLE 168

Example 167 was repeated in the same manner as described except that the thickness of the undercoat layer was reduced to 1.8 μm, thereby obtaining an electrophotographic photoconductor.

EXAMPLE 169

Example 167 was repeated in the same manner as described except that the thickness of the charge transporting layer was reduced to 25 μm, thereby obtaining an electrophotographic photoconductor.

COMPARATIVE EXAMPLE 89

Example 167 was repeated in the same manner as described except that Emulmine 110 (made by Sanyo Chemical Industries Ltd.) was not used at all, thereby obtaining an electrophotographic photoconductor.

The photoconductors obtained in Example 167-169 and Comparative Example 89 were evaluated in the same manner as in Example 145. The results are summarized in Tables 43 to 45.

TABLE 43

| | 20° C./50% RH | | | |
|---|---|---|---|---|
| | Initial | | After 100,000 copies | |
| Example | VD (V) | VL (V) | VD (V) | VL (V) |
| 167 | −750 | −150 | −730 V | −160 V |
| 168 | −750 | −150 | −710 V | −160 V |
| 169 | −750 | −150 | −700 V | −160 V |
| Comp. 89 | −750 | −150 | −730 V | −250 V |

TABLE 44

| | 10° C./15% RH | | | |
|---|---|---|---|---|
| | Initial | | After 100,000 copies | |
| Example | VD (V) | VL (V) | VD (V) | VL (V) |
| 167 | −750 | −150 | −735 V | −170 V |
| 168 | −750 | −150 | −715 V | −165 V |

TABLE 44-continued

| | 10° C./15% RH | | | |
|---|---|---|---|---|
| | Initial | | After 100,000 copies | |
| Example | VD (V) | VL (V) | VD (V) | VL (V) |
| 169 | −750 | −150 | −710 V | −170 V |
| Comp. 89 | −750 | −150 | −730 V | −260 V |

TABLE 45

| | 30° C./90% RH | | | |
|---|---|---|---|---|
| | Initial | | After 100,000 copies | |
| Example | VD (V) | VL (V) | VD (V) | VL (V) |
| 167 | −750 | −150 | −720 | −155 |
| 168 | −750 | −150 | −700 | −155 |
| 169 | −750 | −150 | −695 | −155 |
| Comp. 89 | −750 | −150 | −720 | −220 |

EXAMPLE 170

Example 148 was repeated in the same manner as described except that 10.0 parts of Newpole LB400XY (made by Sanyo Chemical Industries,. Ltd.) was used instead of 15.0 parts of 18-crown-6-ether, and the amounts of the material having a structure represented by the above formula (CG-4) and the phthalocyanine pigment were changed to 26.0 parts and 15.0 parts, respectively, thereby obtaining an electrophotographic photoconductor.

EXAMPLE 171

Example 170 was repeated in the same manner as described except that the thickness of the undercoat layer was reduced to 3.5 μm, thereby obtaining an electrophotographic photoconductor.

EXAMPLE 172

Example 170 was repeated in the same manner as described except that the thickness of the charge transporting layer was reduced to 26 μm, thereby obtaining an electrophotographic photoconductor.

COMPARATIVE EXAMPLE 90

Example 170 was repeated in the same manner as described except that Newpole LB400XY (made by Sanyo Chemical Industries, Ltd.) was not used at all, thereby obtaining an electrophotographic photoconductor.

The photoconductors obtained in Example 170-172 and Comparative Example 90 were evaluated in the same manner as in Example 148. The results are summarized in Tables 46 and 47.

TABLE 46

| Example | Image Density At initial stage | After making 300,000 copies | Decrease |
|---|---|---|---|
| 170 | 1.40 | 1.37 | 0.02 |
| 171 | 1.40 | 1.38 | 0.02 |
| 172 | 1.40 | 1.37 | 0.03 |
| Comp. 90 | 1.40 | 1.10 | 0.30 |

TABLE 47

| Example | Non-image part At initial stage | After making 300,000 copies |
|---|---|---|
| 170 | Good | Good |
| 171 | Good | Stained with fine black dots (acceptable for practical use). |
| 172 | Good | Stained with fine black dots (acceptable for practical use). |
| Comp. 90 | Good | Good |

EXAMPLE 173

An electrophotographic photoconductor was obtained in the same manner as in Example 170 except that the charge generating layer and the charge transporting layer were formed as follows.

20 Parts of a titanylphthalocyanine pigment is charged in a glass pot together with zirconia beads having a diameter of 2 mm and a solution of 20.0 parts of Persoft NK-60 (made by NOF Corporation) in 350 parts of methyl ethyl ketone and milled for 15 hours. The ball milling was further continued for 2 hours after addition of a resin solution of 10 parts of a polyvinyl butyral resin (S-Lec BX-1, made by Sekisui Chemical Co., Ltd.) in 600 parts of methyl ethyl ketone to obtain a coating liquid for forming a charge generating layer.

The thus obtained coating liquid was applied to the undercoat layer which had been formed on the aluminum drum. The coating was dried at 80° C. for 20 minutes to form a charge generating layer having a thickness of about 0.5 μm.

70 Parts of a charge transporting material having a structure represented by the above formula (CT-2), 100 parts of a polycarbonate resin (Panlite TS2050, made by Teijin Chemicals Ltd.), and 0.02 parts of a-silicone oil (kF-50, made by Shin-Etsu Chemical Co., Ltd.) were dissolved in a mixture of 200 parts of 1,3-dioxolane and 550 parts of tetrahydrofuran to obtain a coating liquid for forming a charge transporting layer.

The resulting coating liquid was applied to the charge generating layer formed on the under coat layer which in turn had been formed on the aluminum drum. The coating was dries at 135° C. for 20 minutes to form a charge transporting layer having a thickness of 34 μm.

EXAMPLE 174

Example 173 was repeated in the same manner as described except that the thickness of the undercoat layer was reduced to 3.0 μm, thereby obtaining an electrophotographic photoconductor.

EXAMPLE 175

Example 173 was repeated in the same manner as described except that the thickness of the charge transporting layer was reduced to 25 μm, thereby obtaining an electrophotographic photoconductor.

COMPARATIVE EXAMPLE 91

Example 174 was repeated in the same manner as described except that Persoft NK-60 (made by NOF Corporation) was not used at all, thereby obtaining an electrophotographic photoconductor.

COMPARATIVE EXAMPLE 92

Example 175 was repeated in the same manner as described except that Persoft NK-60 (made by NOF Corporation) was not used at all, thereby obtaining an electrophotographic photoconductor.

The photoconductors obtained in Example 173-175 and Comparative Examples 91 and 92 were evaluated in the same manner as in Example 151. The results are summarized in Table 48.

TABLE 48

| Example | Number of copies produced before occurrence of discharge breakdown | Decrease in image density |
|---|---|---|
| 173 | Not occurred. | 0.02 |
| 174 | 100K | 0.02 |
| 175 | 120K | 0.02 |
| Comp. 91 | 100K | 0.29 (Image density decreased.) |
| Comp. 92 | 120K | 0.29 (Image density decreased.) |

EXAMPLE 176

Example 154 was repeated in the same manner as described except that 5.0 parts of Octapole 100 (made by Sanyo Chemical Industries, Ltd.) was used instead of 5.0 parts of 18-crown-6-ether, thereby obtaining, electrophotographic photoconductors. The same evaluation as Example 154 was performed.

COMPARATIVE EXAMPLE 93

Example 176 was repeated in the same manner as described except that Octapole 100 (made by Sanyo Chemical Industries, Ltd.) was not used at all, thereby obtaining electrophotographic photoconductors. The same evaluation as Example 154 was performed.

EXAMPLE 177

The intermediate transfer belt in the image forming apparatus used in Example 176 was replaced by the above elastic belt, and the same evaluation as in Example 154 was performed.

COMPARATIVE EXAMPLE 94

The intermediate transfer belt in the image forming apparatus used in Comparative Example 93 was replaced by the above elastic belt, and the same evaluation as in. Example 154 was performed.

The results are summarized in Table 49.

TABLE 49

| Example | 600 dpi full color half tone | 1200 dpi full color half tone |
|---|---|---|
| 176 | There were small white voids (acceptable for practical use). | There were small white voids (acceptable for practical use). |
| Comp. 93 | Color tone was changed from an initial image. There were white voids. | Color tone was changed from an initial image. There were white voids. |
| 177 | Good | Good |
| Comp. 94 | Color tone was changed from an initial image. | Color tone was changed from an initial image. |

EXAMPLE 178

Example 156 was repeated in the same manner as described except that 5.0 parts of Newpole PE-85 (made by Sanyo Chemical Industries, Ltd.) was used instead of 5.0 parts of Ionet DS-300, and the amount of the material having a structure represented by the above formula (CG-1) was changed to 24 parts, thereby obtaining an electrophotographic photoconductor.

EXAMPLE 179

Example 178 was repeated in the same manner as described except that the thickness of the undercoat layer was reduced to 1.8 μm, thereby obtaining an electrophotographic photoconductor.

EXAMPLE 180

Example 178 was repeated in the same manner as described except that the thickness of the charge transporting layer was reduced to 25 μm, thereby obtaining an electrophotographic photoconductor.

COMPARATIVE EXAMPLE 95

Example 178 was repeated in the same manner as described except that Newpole PE-85 (made by Sanyo Chemical Industries, Ltd.) was not used at all, thereby obtaining an electrophotographic photoconductor.

The photoconductors obtained in Example 178-180 and Comparative Example 95 were evaluated in the same manner as in Example 145. The results are summarized in Tables 50 to 52.

TABLE 50

| | 20° C./50% RH | | | |
|---|---|---|---|---|
| | Initial | | After 100,000 copies | |
| Example | VD (V) | VL (V) | VD (V) | VL (V) |
| 178 | −750 | −150 | −730 V | −160 V |
| 179 | −750 | −150 | −710 V | −160 V |
| 180 | −750 | −150 | −700 V | −160 V |
| Comp. 95 | −750 | −150 | −730 V | −230 V |

TABLE 51

| | 10° C./15% RH | | | |
|---|---|---|---|---|
| | Initial | | After 100,000 copies | |
| Example | VD (V) | VL (V) | VD (V) | VL (V) |
| 178 | −750 | −150 | −735 V | −170 V |
| 179 | −750 | −150 | −715 V | −165 V |
| 180 | −750 | −150 | −710 V | −170 V |
| Comp. 95 | −750 | −150 | −730 V | −250 V |

TABLE 52

| | 30° C./90% RH | | | |
|---|---|---|---|---|
| | Initial | | After 100,000 copies | |
| Example | VD (V) | VL (V) | VD (V) | VL (V) |
| 178 | −750 | −150 | −720 | −155 |
| 179 | −750 | −150 | −700 | −155 |
| 180 | −750 | −150 | −695 | −155 |
| Comp. 95 | −750 | −150 | −720 | −210 |

EXAMPLE 181

Example 148 was repeated in the same manner as described except that 6.0 parts of Newpole PE-2700 (made by Sanyo Chemical Industries, Ltd.) was used instead of 15.0 parts of 18-crown-6-ether, and the amounts of the material having a structure represented by the above formula (CG-4) was changed to 26.0 parts, thereby obtaining an electrophotographic photoconductor.

EXAMPLE 182

Example 181 was repeated in the same manner as described except that the thickness of the undercoat layer was reduced to 3.5 μm, thereby obtaining an electrophotographic photoconductor.

EXAMPLE 183

Example 181 was repeated in the same manner as described except that the thickness of the charge transporting layer was reduced to 26 μm, thereby obtaining an electrophotographic photoconductor.

COMPARATIVE EXAMPLE 96

Example 181 was repeated in the same manner as described except that Newpole PE-2700 (made by Sanyo Chemical Industries, Ltd.) was not used at all, thereby obtaining an electrophotographic photoconductor.

The photoconductors obtained in Example 181-183 and Comparative Example 96 were evaluated in the same manner as in Example 148. The results are summarized in Tables 53 and 54.

TABLE 53

| Example | Image density: At initial stage | After making 300,000 copies | Decrease |
|---|---|---|---|
| 181 | 1.40 | 1.37 | 0.03 |
| 182 | 1.40 | 1.38 | 0.02 |
| 183 | 1.40 | 1.37 | 0.03 |
| Comp. 96 | 1.40 | 1.07 | 0.33 |

TABLE 54

| Example | Non-image part: At initial stage | After making 300,000 copies) |
|---|---|---|
| 181 | Good | Good |
| 182 | Good | Stained with fine black dots (acceptable for practical use). |
| 183 | Good | Stained with fine black dots (acceptable for practical use). |
| Comp. 96 | Good | Good |

EXAMPLE 184

An electrophotographic photoconductor was obtained in the same manner as in Example 181 except that the charge generating layer and the charge transporting layer were formed as follows.

18 Parts of a titanylphthalocyanine pigment is charged in a glass pot together with zirconia beads having a diameter of 2 mm and a solution of 24.0 parts of Pronon 204 (made by NOF Corporation) in 350 parts of methyl ethyl ketone and milled for 15 hours. The ball milling was further continued for 2 hours after addition of a resin solution of 8 parts of a polyvinyl butyral resin (S-Lec BX-1 made by Sekisui Chemical Co., Ltd.) in 600 parts of methyl ethyl ketone to obtain a coating liquid for forming a charge generating layer.

The thus obtained coating liquid was applied to the undercoat layer which had been formed on the aluminum drum. The coating was dried at 80° C. for 20 minutes to form a charge generating layer having a thickness of about 0.5 μm.

70 Parts of a charge transporting material having a structure represented by the above formula (CT-2), 100 parts of a polycarbonate resin (Panlite TS2050, made by Teijin Chemicals Ltd.), and 0.02 parts of a silicone oil KF-50 (made by Shin-Etsu Chemical Co., Ltd.) were dissolved in a mixture of 200 parts of 1,3-dioxolane and 550 parts of tetrahydrofuran to obtain a coating liquid for forming a charge transporting layer.

The resulting coating liquid was applied to the charge generating layer formed on the under coat layer which in turn had been formed on the aluminum drum. The coating was dries at 135° C. for 20 minutes to form a charge transporting layer having a thickness of 34 μm.

EXAMPLE 185

Example 184 was repeated in the same manner as described except that the thickness of the undercoat layer was reduced to 3.0 μm, thereby obtaining an electrophotographic photoconductor.

EXAMPLE 186

Example 184 was repeated in the same manner as described except that the thickness of the charge transporting layer was reduced to 25 μm, thereby obtaining an electrophotographic photoconductor.

COMPARATIVE EXAMPLE 97

Example 185 was repeated in the same manner as described except that Pronon 204 (made by NOF Corporation) was not used at all, thereby obtaining an electrophotographic photoconductor.

COMPARATIVE EXAMPLE 98

Example 186 was repeated in the same manner as described except that Pronon 204 (made by NOF Corporation) was not used at all, thereby obtaining an electrophotographic photoconductor.

The photoconductors obtained in Example 184-186 and Comparative Examples 97 and 98 were evaluated in the same manner as in Example 151. The results are summarized in Table 55.

TABLE 55

| Example | Number of copies produced before occurrence of discharge breakdown | Decrease in image density |
|---|---|---|
| 184 | Not occurred. | 0.02 |
| 185 | 100K | 0.02 |
| 186 | 120K | 0.02 |
| Comp. 97 | 100K | 0.28 (Image density decreased.) |
| Comp. 98 | 120K | 0.28 (Image density decreased.) |

EXAMPLE 187

Example 154 was repeated in the same manner as described except that 5.0 parts of Newpole PE-61 (made by Sanyo Chemical Industries, Ltd.) was used instead of 5.0 parts of 18-crown-6-ether, thereby obtaining electrophotographic photoconductors. The same evaluation as Example 154 was performed.

COMPARATIVE EXAMPLE 99

Example 187 was repeated in the same manner as described except that Newpole PE-61 (made by Sanyo Chemical Industries, Ltd.) was not used at all, thereby obtaining electrophotographic photoconductors. The same evaluation as Example 154 was performed.

EXAMPLE 188

The intermediate transfer belt in the image forming apparatus used in Example 187 was replaced by the above elastic belt, and the same evaluation as in Example 154 was performed.

COMPARATIVE EXAMPLE 100

The intermediate transfer belt in the image forming apparatus used in Comparative Example 99 was replaced by the above elastic belt, and the same evaluation as in Example 154 was performed.

The results are summarized in Table 56.

TABLE 56

| Example | 600 dpi full color half tone | 1200 dpi full color half tone |
|---|---|---|
| 187 | There were small white voids (acceptable for practical use). | There were small white voids (acceptable for practical use). |
| Cpmp. 99 | Color tone was changed from an initial image. There were white voids. | Color tone was changed from an initial image. There were white voids. |
| 188 | Good | Good |
| Comp. 100 | Color tone was changed from an initial image. | Color tone was changed from an initial image. |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

The teachings of Japanese Patent Applications No. 2002-168628, filed Jun. 10, 2002 and No. 2002-271227, filed Sep. 18, 2002, inclusive of the specifications, claims and drawings, are hereby incorporated by reference herein.

What is claimed is:

1. An electrophotographic photoconductor, comprising:

an electrically conductive substrate, an undercoat layer having a thickness of at least 5 μm, provided on said substrate, and a photoconductive layer, provided on said undercoat layer;

wherein said photoconductive layer comprises at least one phenol compound and at least one organic sulfur compound; and wherein said undercoat layer comprises a binder resin comprising a combination of an alkyd resin and a melamine resin, wherein an amount of alkyd resin is 50 to 60% by weight based on the weight of the binder resin, an inorganic filler, and at least one compound selected from the group consisting of polyalkylene glycol ethers.

2. An electrophotographic photoconductor as claimed in claim 1, wherein said inorganic filler is titanium oxide.

3. An electrophotographic photoconductor as claimed in claim 2, wherein said titanium oxide is surface-untreated titanium oxide powder.

4. An electrophotographic photoconductor as claimed in claim 1, wherein said photoconductive layer comprises a charge generating layer containing a binder resin and a charge generating compound, and a charge transporting layer containing a binder resin and a charge transporting compound, each of said charge generating and charge transporting layers being a dried coating of a composition containing at least one solvent selected from the group consisting of cyclic ethers, ketones and aromatic hydrocarbons.

5. An image forming apparatus comprising a photoconductor according to claim 1, a charging device for charging a surface of said photoconductor, an exposing device for exposing the charged surface to form an electrostatic latent image, a developing device for reverse-developing the latent image with a toner, and a transferring device for transferring the developed image to a transfer sheet.

6. An image forming apparatus as claimed in claim 5, wherein said charging device is a contact-type charger.

7. An image forming process comprising exposing a photoconductor according to claim 1 with light to form an electrostatic latent image thereon, reverse-developing said latent image with a toner, and transferring the developed image to a transfer sheet.

8. An image forming process as claimed in claim 7, wherein said latent image has a dark area potential of greater than 600 V in absolute value.

9. A process cartridge freely detachable from an image forming apparatus, comprising a photoconductor according to claim 1, and at least one device selected from the group consisting of a charger, an image exposing device, a developing device, an image transferring device, and a cleaning device.

10. A method of producing a photoconductor, comprising:

forming, on an electrically conductive substrate, an undercoat layer comprising a binder resin, an inorganic filler, and at least one compound selected from the group consisting of polyalkyleneglycol ethers, applying to the undercoat layer a first coating liquid comprising a charge generating material and at least one solvent selected from the group consisting of cyclic ethers, ketones and aromatic hydrocarbons to form a charge generating layer, and applying to the charge generating layer a second coating liquid comprising a charge transporting material and at least one solvent selected from the group consisting of cyclic ethers, ketones and aromatic hydrocarbons to form a charge transporting layer;

wherein said binder resin of said undercoat layer comprises a combination of an alkyd resin and a melamine resin; and wherein an amount of alkyd resin is 50 to 60% by weight based on the weight of the binder resin, and wherein said second coating liquid additionally comprises at least one phenol compound and at least one organic sulfur compound.

* * * * *